US008114221B2

(12) United States Patent
Labib et al.

(10) Patent No.: US 8,114,221 B2
(45) Date of Patent: Feb. 14, 2012

(54) METHOD AND COMPOSITION FOR CLEANING TUBULAR SYSTEMS EMPLOYING MOVING THREE-PHASE CONTACT LINES

(75) Inventors: Mohamed Emam Labib, Princeton, NJ (US); Stanislav S. Dukhin, Goldens Bridge, NY (US); Joseph J. Murawski, Plainfield, NJ (US); Yacoob Tabani, Basking Ridge, NJ (US); Ching-Yue Lai, Pennington, NJ (US)

(73) Assignee: Princeton Trade & Technology, Inc., Princeton, NJ (US)

( * ) Notice: Subject to any disclaimer, the term of this patent is extended or adjusted under 35 U.S.C. 154(b) by 399 days.

(21) Appl. No.: 12/286,749

(22) Filed: Sep. 30, 2008

(65) Prior Publication Data

US 2010/0078047 A1 Apr. 1, 2010

(51) Int. Cl.
*B08B 9/032* (2006.01)

(52) U.S. Cl. ..... 134/22.12; 134/22.1; 134/22.11

(58) Field of Classification Search ..... 134/22.1, 134/22.11, 22.12

See application file for complete search history.

(56) References Cited

U.S. PATENT DOCUMENTS

| | | | |
|---|---|---|---|
| 2,151,671 | A | 3/1939 | Wright |
| 2,222,516 | A | 11/1940 | Powell et al. |
| 3,119,399 | A | 1/1964 | Bender |
| 3,162,427 | A | 12/1964 | Knudson et al. |
| 3,467,314 | A | 9/1969 | Grubb |
| 3,551,331 | A | 12/1970 | Cescon |
| 3,625,231 | A | 12/1971 | Littrell, Jr. |
| 3,811,408 | A | 5/1974 | Thompson |
| 4,166,031 | A | 8/1979 | Hardy |
| 4,169,123 | A | 9/1979 | Moore et al. |
| 4,209,402 | A | 6/1980 | Gentles |
| 4,219,333 | A | 8/1980 | Harris |
| 4,311,618 | A | 1/1982 | Schafer-Burkhard |
| 4,375,413 | A | 3/1983 | Geel et al. |
| 4,380,477 | A | 4/1983 | Saunders |
| 4,400,220 | A | 8/1983 | Cole, Jr. |

(Continued)

FOREIGN PATENT DOCUMENTS

DE 893595 10/1953

(Continued)

OTHER PUBLICATIONS

Machine translation of EP 490,117A1.*

(Continued)

*Primary Examiner* — Michael Kornakov
*Assistant Examiner* — Douglas Lee
(74) *Attorney, Agent, or Firm* — Merchant & Gould, P.C.

(57) ABSTRACT

The narrow diameter channel has a diameter of about 0.02 centimeter to about 1.6 centimeters and a length of about 0.75 meter to about 5 meters. The internal surface of the narrow diameter channel is hydrophobic, and the surface flow entities exhibit an advancing contact angle of greater than 50 degrees and a receding contact angle of greater than zero degree. The detachment of contaminants from the internal surface of the narrow diameter channel is produced by a sweeping of the internal surface of the narrow diameter channel with the three-phase contact lines of the surface flow entities, the cleaning medium is not predispersed in the gas before entering the channel, and less that 10% of the surface of the channel is covered by a contiguous annular film.

16 Claims, 15 Drawing Sheets

U.S. PATENT DOCUMENTS

| | | | | |
|---|---|---|---|---|
| 4,444,597 | A | 4/1984 | Gortz et al. | |
| 4,477,438 | A | 10/1984 | Willcockson et al. | |
| 4,517,081 | A | 5/1985 | Amiot et al. | |
| 4,525,220 | A | 6/1985 | Sasa et al. | |
| 4,622,140 | A | 11/1986 | Lee et al. | |
| 4,695,385 | A | 9/1987 | Boag | |
| 4,707,335 | A | 11/1987 | Fentress et al. | |
| 4,710,233 | A | 12/1987 | Hohmann et al. | |
| 4,744,951 | A | 5/1988 | Cummings et al. | |
| 4,767,539 | A | 8/1988 | Ford | |
| 4,781,764 | A | 11/1988 | Leenaars | |
| 4,787,404 | A | 11/1988 | Klosterman et al. | |
| 4,863,688 | A | 9/1989 | Schmidt et al. | |
| 4,881,563 | A | 11/1989 | Christian | |
| 4,902,352 | A | 2/1990 | Christian | |
| 5,007,461 | A | 4/1991 | Naf | |
| 5,045,352 | A | 9/1991 | Mueller | |
| 5,077,008 | A | 12/1991 | Kralovic et al. | |
| 5,127,961 | A | 7/1992 | Aiton | |
| 5,139,675 | A | 8/1992 | Arnold et al. | |
| 5,160,548 | A | 11/1992 | Boisture | |
| 5,178,830 | A | 1/1993 | Riera Aixala | |
| 5,244,468 | A | 9/1993 | Harris | |
| 5,279,799 | A | 1/1994 | Moser | |
| 5,286,301 | A | 2/1994 | Albrecht | |
| 5,322,571 | A | 6/1994 | Plummer et al. | |
| 5,344,652 | A | 9/1994 | Hall, II et al. | |
| 5,395,456 | A | 3/1995 | Abrams et al. | |
| 5,408,991 | A | 4/1995 | Iida et al. | |
| 5,415,191 | A | 5/1995 | Mashino et al. | |
| 5,425,815 | A | 6/1995 | Parker et al. | |
| 5,480,565 | A | 1/1996 | Levin et al. | |
| 5,494,530 | A | 2/1996 | Graf | |
| 5,529,701 | A | 6/1996 | Grisham et al. | |
| 5,589,507 | A | 12/1996 | Hall, II et al. | |
| 5,615,695 | A | 4/1997 | Chambers | |
| 5,616,616 | A | 4/1997 | Hall, II et al. | |
| 5,628,959 | A | 5/1997 | Kross | |
| 5,635,195 | A | 6/1997 | Hall, II et al. | |
| 5,651,893 | A | 7/1997 | Kenley et al. | |
| 5,656,302 | A | 8/1997 | Cosentino et al. | |
| 5,658,466 | A | 8/1997 | Kawaguchi et al. | |
| 5,662,811 | A | 9/1997 | Grisham et al. | |
| 5,698,100 | A | 12/1997 | Levin et al. | |
| 5,714,060 | A | 2/1998 | Kenley et al. | |
| 5,772,624 | A | 6/1998 | Utterberg et al. | |
| 5,795,404 | A | 8/1998 | Murphy et al. | |
| 5,840,343 | A | 11/1998 | Hall, II et al. | |
| 5,855,216 | A | 1/1999 | Robinson | |
| 5,896,828 | A | 4/1999 | Kronschnabel et al. | |
| 5,915,395 | A | 6/1999 | Smith | |
| 5,931,845 | A | 8/1999 | Amyette | |
| 5,934,566 | A | 8/1999 | Kanno et al. | |
| 5,941,257 | A | 8/1999 | Gruszczynski | |
| 5,944,997 | A | 8/1999 | Pedersen et al. | |
| 5,961,937 | A | 10/1999 | Gobbato | |
| 5,972,875 | A | 10/1999 | Crutcher et al. | |
| 6,027,572 | A | 2/2000 | Labib et al. | |
| 6,050,278 | A | 4/2000 | Arnal et al. | |
| 6,179,954 | B1 | 1/2001 | Kawana et al. | |
| 6,192,900 | B1 | 2/2001 | Arnal et al. | |
| 6,193,890 | B1 | 2/2001 | Pedersen et al. | |
| 6,207,201 | B1 | 3/2001 | Piacenza | |
| 6,261,457 | B1 | 7/2001 | Wenthold et al. | |
| 6,326,340 | B1 | 12/2001 | Labib et al. | |
| 6,423,152 | B1 | 7/2002 | Landaas | |
| 6,447,990 | B1 | 9/2002 | Alfa | |
| 6,454,871 | B1 | 9/2002 | Labib et al. | |
| 6,619,302 | B2 | 9/2003 | Labib et al. | |
| 6,717,019 | B2 | 4/2004 | Lassila | |
| 6,823,881 | B1 | 11/2004 | Mishkin et al. | |
| 6,857,436 | B2 | 2/2005 | Labib et al. | |
| 6,908,891 | B2 * | 6/2005 | Biering et al. | 510/161 |
| 6,945,257 | B2 | 9/2005 | Tabani et al. | |
| 2001/0047813 | A1 | 12/2001 | Labib et al. | |
| 2002/0072654 | A1 * | 6/2002 | Takase | 600/139 |
| 2002/0112743 | A1 | 8/2002 | Tabani et al. | |
| 2002/0189647 | A1 | 12/2002 | Labib et al. | |
| 2003/0062066 | A1 | 4/2003 | Gruszczynski et al. | |
| 2004/0007255 | A1 * | 1/2004 | Labib et al. | 134/30 |
| 2004/0118413 | A1 | 6/2004 | Williams et al. | |
| 2004/0118437 | A1 | 6/2004 | Nguyen | |
| 2005/0028845 | A1 | 2/2005 | Labib et al. | |
| 2005/0085694 | A1 * | 4/2005 | Nakao | 600/153 |
| 2005/0126599 | A1 | 6/2005 | Labib et al. | |
| 2005/0150831 | A1 | 7/2005 | Tabani et al. | |
| 2007/0027359 | A1 | 2/2007 | Salman | |
| 2008/0264454 | A1 | 10/2008 | Tabani et al. | |
| 2009/0229632 | A1 | 9/2009 | Labib et al. | |
| 2010/0078046 | A1 * | 4/2010 | Labib et al. | 134/22.12 |

FOREIGN PATENT DOCUMENTS

| | | | |
|---|---|---|---|
| EP | 0 490 117 | | 6/1992 |
| EP | 490117 | A1 * | 6/1992 |
| EP | 213157 | B1 | 10/1992 |
| EP | 160014 | B1 | 1/1993 |
| EP | 289523 | B1 | 1/1995 |
| EP | 634229 | B1 | 1/1995 |
| JP | 49-102159 | A | 9/1974 |
| JP | 49-116868 | | 11/1974 |
| JP | 59-69019 | A | 4/1984 |
| JP | 60-67896 | A | 4/1985 |
| JP | 6121769 | | 5/1994 |
| JP | 8019556 | | 5/1994 |
| JP | 6121769 | | 1/1996 |
| JP | 8019556 | | 1/1996 |
| JP | 8-289687 | A | 11/1996 |
| JP | 11-104636 | | 4/1999 |
| JP | 2002-66486 | A | 3/2002 |
| SU | 1042826 | A | 2/1981 |
| WO | WO 85/01449 | | 4/1985 |
| WO | WO 86/05116 | | 9/1986 |
| WO | WO 88/00494 | | 1/1988 |
| WO | WO 95/10349 | | 4/1995 |
| WO | WO 96/20737 | | 7/1996 |
| WO | WO 98/58632 | | 12/1998 |
| WO | WO 99/29401 | | 6/1999 |
| WO | WO 00/00306 | | 1/2000 |
| WO | WO 01/91931 | | 12/2001 |

OTHER PUBLICATIONS

Translation of DE 893595 filed by Applicant.*

International Search Report for PCT/US2009/058838, dated Jan. 12, 2010.

Azzopardi, B., "Drops in annular two-phase flow," *Int. J. Multiphase Flow*, vol. 23, Suppl., pp. 1-53 (1997).

Barajas, A. et al., "The effects of contact angle on two-phase flow in capillary tubes," *Int. J. Multiphase Flow*, vol. 19, No. 2, pp. 337-346 (1993).

Henstock, W. et al., "The Interfactial Drag and the Height of the Wall Layer in Annular Flows," *AIChE Journal*, vol. 22, No. 6, pp. 990-999 (Nov. 1976).

Hewitt, G. et al., "Annular Two-Phase Flow," *Pergamon Press*, pp. v-vii, 1-20, chapters 1-2 (Date Unknown).

Hobbe et al. "Use of Nuclepore Filters for Counting Bacteria by Fluorescence Microscopy," *Appl. and Environ. Microbiol.*, vol. 33, No. 5, pp. 1226-1228 (May 1977).

Klauer, J., "Piping: An examination of pipe self cleaning in high-purity water systems," *Ultrapure Water*, pp. 56-60 (Mar. 2001).

Kogure et al., "A tentative direct microscopic method for counting living marine bacteria," *Can. J. Microbiol.*, vol. 25, pp. 415-420 (1997).

Leypoldt, John K. & Cheung, Alfred K., "Characterization of Molecular Transport in Artificial Kidneys," Artificial Organs, International Socity for Artificial Organs, vol. 20, No. 5, pp. 381-389, Jan. 1996.

Reinemann, D., "Dairy operators guide to milking machine cleaning and sanitation," *Paper written for presnetation at the NRAES the Milking Systems and Parlors Conference*, 8 pages (Jan. 30, 2001).

Riedewald, F., "Biofilms in Pharmaceutical Waters," *Pharmaceutical Engineering*, 8 pages (Nov./Dec. 1997).

Tragardh, C., "Cleaning in air-water-flow," *Division of Food Engineering, Lund Engineering, Alnarp* (Sweden), pp. 424-429 (Date Unknown).

Triplett, K. et al., "Gas liquid two-phase flow in microchannels. Part 1: two-phase flow patterns," *International Journal of Multiphase Flow*, vol. 25, pp. 377-380, 387-393 (1999).
Woodmansee, D. et al., "Mechanism for the removal of droplets from a liquid surface by a parallel air flow," *Chemical Engineering Science*, vol. 24, pp. 299-307 (1969).
Web page print-out "510(k) Premarket Notification Database", 8 pages (Jan. 5, 2006).
Agreement between HDC Medical, Inc. and Guillermo J. Cohen Freue, 1 page.
Cameron, A., Basic Lubrication Theory, 3rd Edition, pp. 37-51, 93-125, John Wiley & Sons, New York, NY, (1981).
Fuller, D.D., Theory and Practice of Lubrication for Engineers, 2nd Edition, pp. 198-296, John Wiley & Sons, New York, NY, (1984).
Hays, "A Variational Approach to Lubrication Problems and the Solution of the Finite Journal Bearing," J. Basic Eng., 81:13-23 (1959.
Hubbe, "Detachment of Colloidal Hydrous Oxide Spheres From Flat Solids Exposed to Flow 1." Experimental System, Colloids and Surfaces, 16:227-248 (1985).
Hubbe, "Detachment of Colloidal Hydrous Oxide Spheres From Flat Solids Exposed to Flow 2." Mechanism of release, Colloids and Surfaces, 16:249-270 (1985).
Hubbe, "Detachment of Colloidal Hydrous Oxide Spheres From Flat Solids Exposed to Flow 3." Forces of adhesion, Colloids and Surfaces, 25:311-324 (1987).
Hubbe, "Theory of Detachment of Colloidal Particles From Flat Surfaces Exposed to Flow," Colloids and Surfaces, 12:151-178 (1984).
Kabin, et al., "Removal of Solid Organic Films From Rotating Disks Using Emulsion Cleaners," J. of Colloid and Interface Sci., 228:344-358 (2000).
Leal, L.G., Laminar Flow and Convective Transport Processes: Scaling Principles and Asymptotic Analysis, pp. 396-406, Butterworth-Heinemann, Newton, MA, (1992).
Lee, et al., "Motion of a Sphere in the Presence of a Plane Interface. Part 1. An Approximate Solution by Generalization of the Method of Lorentz," J. Fluid Mech., 93:705-726 (1979).
Lee, et al., "Motion of a Sphere in the Presence of a Plane Interface. Part 2. An Exact Solution in Bipolar Co-Ordinates," J. Fluid Mech., 98:193-224 (1980).
Reynolds, "On the Theory of Lubrication and its Application to Mr. Beauchamp Tower's Experiments, Including Experimental Determination of the Viscosity of Olive Oil," Philosophical Transactions of the Royal Society of London, England, 177:157-234 (1887).
Ryan, et al., "Colloid Mobilization and Transporting Ground Water," Colloids and Surfaces, 107:1-56 (1996).
Truskey, et al., "The Effect of Fluid Shear Stress Upon Cell Adhesion to Fibronectin-Treated Surfaces," J. Biomed. Mater. Res., 24:1333-1353 (1990).
Truskey, et al., "Relationship Between 3T3 Cell Spreading and the Strength of Adhesion on Glass and Silane Surfaces," Biomater, 14(4):243-254 (1993).
Yiantsios, et al., "Detachment of Spherical Microparticles Adhering on Flat Surfaces by Hydrodynamic Forces," J. of Colloid and Interface Sci., 176:74-85 (1995).
Alfa et al., "Worst-case soiling levels for patient-used flexible endoscopes before and after cleaning," AJIC (1999): 392-401.
Schrimm et al., "A new method for validating and verifying the cleaning of tubular instruments," Zentr Steril (1994) 2: 313-324.
Alfa et al., "Automated washing with the reliance endoscope processing system and its equivalence to optimal manual cleaning," AJIC (2006) 34 (9): 561-570.
Ross et al., "Standard test method for foaming properties of surface-active agents: Method D1173-53," Am Soc for Testing Materials, Philadelphia PA 1953: 1-2.
Landau et al., "Fluid Mechanics," Course of Theoretical Physics (1958): Pergamon Press.
Nakagawa et al., "Rivulet meanders on a smooth hydrophobic surface," Int. J. Multiphase Flow (1992) 18 (3):455-463.
Nakagawa et al., "Stream meanders on a smooth hydrophobic surface," J. Fluid. Mech. (1984) 149: 89-99.
Ghezzehei, T., "Constraints on flow regimes in wide-aperture fractures," Lawrence Berkeley National Laboratory Paper LBNL 54681, 2004.
Le Grand-Piteira et al., "Meandering rivulets on a plane: a simple balance between inertia and capillarity," Laboratoire de Physique et Mecaniqu des Milieux Heterrogenes (2008): 1-5.
Schmuki et al., "On the stability of rivulet flow," J. Fluid. Mech. (1990) 210: 125-143.
Taylor G.I., "Non-interacting colloidal particles in an external field," Colloidal Hydrodynamics (1934) 146: 189-186.
Gomez-Suarez et al., "Analysis of bacterial detachment from substratum surfaces by the passage of air-liquid interfaces," Applied and Enviro. Mircobiology (2001) 67 (6): 2531-2537.
Gilles de Gennes, P., Capillarity and wetting phenomena, Springer (2003).

* cited by examiner

METHOD AND COMPOSITION FOR CLEANING TUBULAR SYSTEMS EMPLOYING MOVING THREE-PHASE CONTACT LINES

CROSS REFERENCE TO RELATED APPLICATIONS

This application is related to U.S. patent application Ser. No. 12/286,747 that was filed with the United States Patent and Trademark Office on Sep. 30, 2008, the entire disclosure of which is incorporated herein by reference.

FIELD OF INVENTION

The invention relates to a method of cleaning an internal surface of a narrow diameter channel, such as the internal surface of channels of endoscopes or other medical devices, or cleaning an internal surface of narrow tubing or capillaries. The method includes a step of treating the internal surface with a liquid cleaning medium and a gas flowing through the channel in one or more flow regimes that creates surface flow entities which have three-phase contact lines and an associated menisci.

BACKGROUND OF INVENTION

The lumens or channels of medical devices have conventionally been difficult to clean, disinfect, and sterilize. Various methodologies of cleaning flexible endoscopes whether manual or automated rely on flowing a cleaning liquid through the flexible channel and then rinsing the channel. The manual process generally includes performing a step which includes brushing the working channels (suction and biopsy) and only flushing the narrow air and water channels of the endoscope, normally with an enzymatic cleaning solution. The manual cleaning process is variable and depends on the skill of the technician. After manual cleaning the endoscope is transferred to an automated endoscope preprocessor (AER) where it is further cleaned with liquid flow for a brief time and then rinsed with filtered water. A high level of disinfection must be performed before the endoscope is reused.

Several patents such as U.S. Patent no. 20040118437 to N. Nguyen, U.S. Patent no. 20040118413 to Williams et al. and U.S. Pat. No. 6,439,246 to P. Stanley disclose methods of automating cleaning by liquid flow so as to reduce or eliminate manual cleaning steps. Although these methods automate the conventional cleaning process, they still rely on bulk flow of a liquid cleaning composition to accomplish the cleaning step. However, there are inherent limitations in achieving high cleaning levels for strongly adherent contaminants because of the limited viscous shear forces that can be generated at the inner surface of the channel.

To improve the level of cleaning of tubular systems, several patents have disclosed the use of two-phase liquid-gas flow.

U.S. Pat. No. 6,027,572 to Labib et al disclosed a method for removing biofilms and debris from lines and tubing under turbulent flow.

US patent publication 2004/0007255 to Labib et al disclosed the use of two phase flow in which droplets, preformed and entrained in a flowing gas, impact the wall of the channel and fragment and erode contaminants.

U.S. Pat. No. 6,454,871 to Labib et al disclosed a method of cleaning passageways using a mixed phase flow of gas and liquid wherein the flow of gas was sufficient to produce droplets of the liquid which are entrained by the gas and erode or loosen the contaminants when they impact the wall.

U.S. Pat. No. 6,945,257 to Tabani et al. disclosed a method for cleaning hollow tubing and fibers in a hemodialyzer by in situ two-phase flow. The cleaning liquid is introduced into fiber lumens by backflushing to create liquid droplets which are entrained in the gas and erode or loosen contaminants by impact with the wall.

The two-phase cleaning methods discussed above rely on dislodging biofilms or soils by the impact of liquid droplets entrained in a flowing gas at high pressure. However, these methods have intrinsic limitations when applied to the cleaning of long narrow tubes in endoscopes and other medical devices because the pressures required to either generate entrained mist droplet or sufficient droplet impact forces can exceed the maximum pressures for which the devices are rated.

During microscopic examination of liquid-gas flow through narrow hydrophobic channels, we made an unexpected discovery of a new two-phase hydrodynamic cleaning mode that is capable of achieving high levels of cleaning at pressures at or below 35 psi which is suitable for sensitive tubular systems such as endoscopes and similar medical devices. Specifically, we found it possible under certain conditions to flow a liquid cleaning medium and a gas through the internal channel of an endoscope under one or more flow regimes that create surface flow entities in contact with and sliding along the surface of the channel. These surface flow entities have three-phase contact lines and associated menisci which are capable of detaching contaminants with which they come in contact from the internal surface of the channel.

It was unexpectedly found that high levels of cleaning could be produced by these surface flow entities in the absence of entrained liquid droplets provided that the formation of annular liquid films and foam were minimized. The objective of the current invention is the development of a practical cleaning method, apparatus, and cleaning compositions utilizing the above discovery that are especially suitable for the effective cleaning of tubular systems especially endoscopes which have long narrow channels and limited tolerance for high pressure.

SUMMARY OF THE INVENTION

The current invention is directed to a two-phase cleaning method based on creating one or more flow regimes that produces surface flow entities that remain attached to and slide along the surface of the channel. These sliding surface flow entities sweep the surface with three phase contact lines and can achieve high levels of cleaning of the internal surface of narrow diameter channels of endoscopes, narrow tubing and capillaries, especially long narrow channels. Specifically, the instant method includes the steps of:

i) flowing a liquid cleaning medium and a gas through the internal channel of an endoscope under one or more flow regimes that creates surface flow entities in contact with and sliding along the surface of the channel, said surface flow entities having three-phase contact lines and associated menisci, said surface flow entities detaching contaminants with which they come in contact from the internal surface of the channel;

ii) rinsing the surface of the channel to remove residual liquid cleaning medium and detached contaminants from the channel;

wherein during step i):

the detachment of contaminants from the surface of the channel is produced by the sweeping of the surface of the internal channel with the three-phase contact lines of the surface flow entities, the cleaning medium is not predispersed in the gas as droplets before entering the channel, and less than 10% of the surface of the channel is covered by a contiguous annular film.

In one embodiment of the invention the flow regime is Rivulet Droplet Flow (RDF) created by flowing the liquid cleaning medium in the channel under rivulet flow and simultaneously flowing gas through the internal channel at a liquid flow rate and a gas flow rate sufficient to form meandering rivulets and fragments formed from these rivulets or meandering rivulets that remain attached to and slide along the surface of the channel. The meandering rivulets and fragments detach contaminants from the surface of the channel with which they come into contact.

In another embodiment the flow regime is either Discontinuous Plug Flow (DPF) or Discontinuous Plug Droplet Flow (DPDF) created by pulsing aliquots of liquid cleaning medium into the channel with a pulse time $P_t$ and having a liquid flow rate sufficient to form a flowing plug of cleaning medium pushed through the channel by a flowing gas. This flowing plug either remains intact throughout the channel length or forms fragments which remain attached to and slide along the surface. The liquid plug and fragments detach contaminants from the internal surface of the channel by the sweeping of the surface of the channel with the three-phase contact lines of the liquid plug or the fragments formed there from.

In still another embodiment of the invention, the method includes in addition to steps i) and ii) recited above, one or more of the additional steps of iii) treating the surface of the channel with germicide, iv) rinsing residual germicide with bacteria-free water, and v) drying the surface of the channels by flowing first alcohol and then air through the channel.

In yet another embodiment, the method described above with or without optional steps iii)-v) is used to clean the separate channels of an endoscope and the flow rates of the liquid cleaning medium and gas are independently selected for each channel to optimize the amount of contaminants detached from the surface of each of the channels due to the sweeping of the surface with three-phase contact lines of the surface flow entities.

A further embodiment of the invention relates to a method for determining liquid flow rates and gas flow rates that produce optimal flow of meandering rivulets and fragment for cleaning internal surfaces of channels of endoscopes, narrow tubing and capillaries.

Still another embodiment is a liquid cleaning medium incorporating specific surfactants and optional ingredients that provides optimal cleaning performance utilizing the cleaning method disclosed herein. It has been found through extensive experimentation with various classes of surfactants and optional cleaning ingredients that the physical properties of the liquid cleaning medium has a critical effect in achieving the flow regimes that generate RDF, DPF and DPDF required for optimal cleaning by the instant method. Furthermore, it has been found that the classes of surfactants which are suitable for use with the current method are surprisingly much narrower than has been reported for other forms of two-phase flow cleaning methods.

Specifically, the liquid cleaning medium for optimal cleaning employing the two-phase flow method of the invention includes one or more surfactants at a concentration that provides an equilibrium surface tension between about 33 and 50 dynes/cm, preferably about 35 to about 45 dynes/cm; has a low potential to generate foam as measured by having a Ross Miles foam height measured at a surfactant concentration of 0.1% that is less than 50 mm, preferably less than 20 mm and more preferable below 5 mm and close to zero; and provides a liquid cleaning medium that does not form a wetting film on the channel surface (the interior wall of the channel) as measured by a receding contact angle greater than zero degrees.

A still further embodiment of the invention is a cleaning apparatus that permits the cleaning of an entire endoscope wherein the liquid and gas flow rates of each channel of the endoscope is individually controllable so as to produce optimal flow regimes for that channel.

These and other variations of the inventive methods and compositions disclosed herein will become clear from the following description of the invention which should be read in conjunction with the accompanying drawings.

DETAILED DESCRIPTION OF THE INVENTION

Figure 1A:
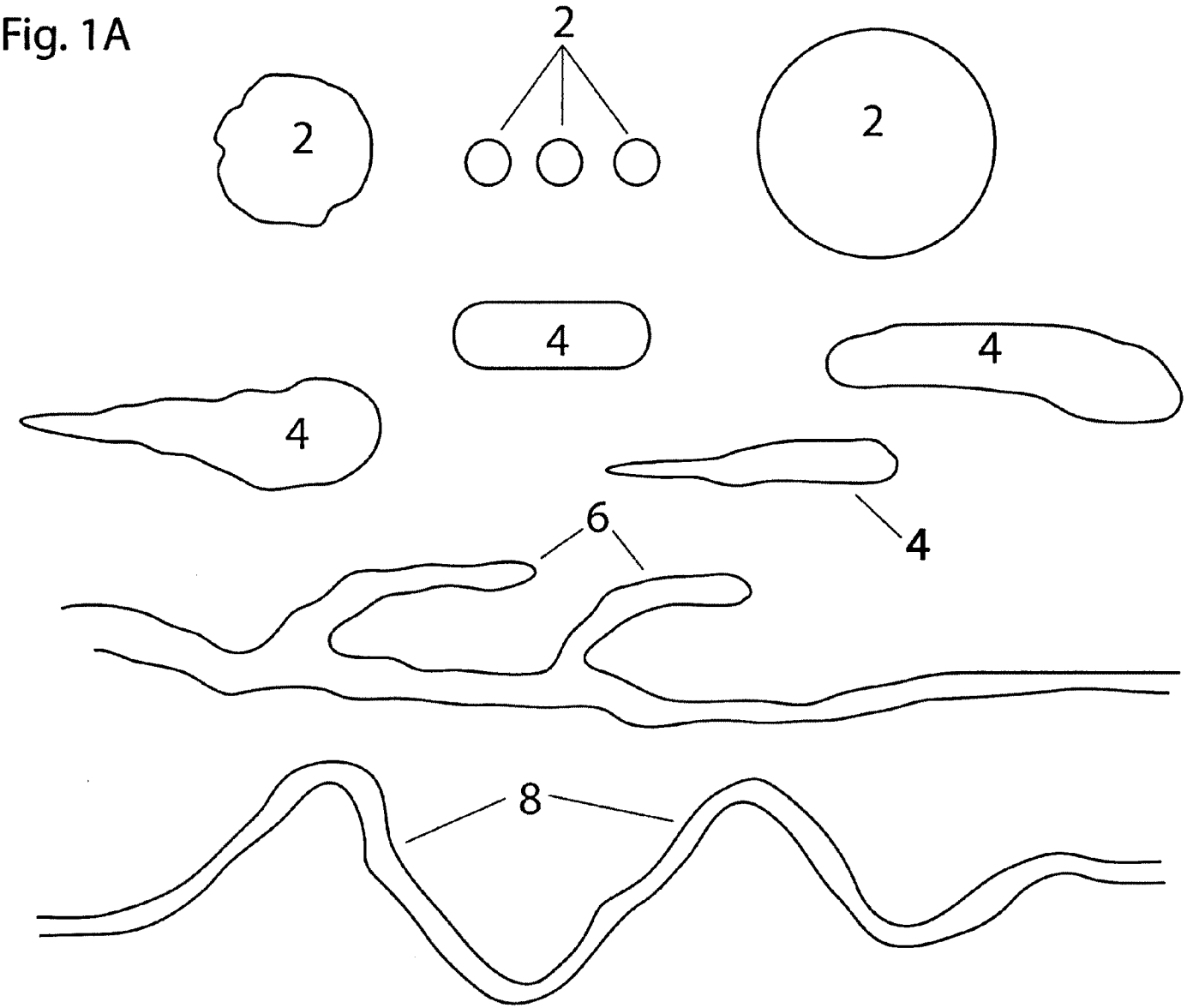
FIG. 1A is a schematic drawing of various types of surface flow entities utilized in the invention (orthogonal top view bounded by the three-phase contact line).

As used herein % or wt % refers to percent by weight of an ingredient as compared to the total weight of the composition or component that is being discussed.

Except in the operating and comparative examples, or where otherwise explicitly indicated, all numbers in this description indicating amounts of material or conditions of reaction, physical properties of materials and/or use are to be understood as modified by the word "about." All amounts are by weight of the final composition, unless otherwise specified.

For the avoidance of doubt the word "comprising" is intended to mean "including" and not "consisting of."" In other words, the listed steps or options need not be exhaustive.

Method of Cleaning

The first embodiment of the invention is directed to a method of cleaning tubular systems such as the narrow diameter internal channels of endoscopes and other medical devices, narrow tubing and capillaries.

Although many of the applications of the instant cleaning method involve channels which have a circular or elliptical cross section, the term "channel" is used in its broadest sense to designate an enclosed conduit in which liquid flows. Thus the cross section of the channel can be square or rectangular such as a slit or can in fact have an arbitrary shape.

The method involves first flowing a liquid cleaning medium (hereinafter designated simply as the "liquid") and a gas through the internal channel of an endoscope under one or more flow regimes that creates surface flow entities in contact with and sliding along the surface of the channel. The surface flow entities form three-phase contact lines where the liquid, solid and gas phases intersect and the liquid/gas interface forms a meniscus extending from this three phase contact line. These surface flow entities are capable of detaching contaminants with which they come in contact from the internal surface of the channel. This step will be referred to as the detachment step.

Following the detachment step, the channel is rinsed to remove residual liquid cleaning medium and detached contaminants from the channel that were not removed from the channel during the detachment step.

The details of the method and optional steps are discussed below.

Flow Regimes

The term "flow regime" refers to a classification of the particular type hydrodynanic flow which is occurring within the channel under a specific set of parameters that control the flow of liquid and gas within the channel. The flow regime is characterized by the type of flow elements or liquid entities that are present in the channel that can form within the channel (see below for a discussion of flow elements). The controlling parameters include the manner in which the liquid is introduced into the channel, the pressure of the gas, the flow rate of gas, and the flow rate of liquid, the wettability of the channel wall (contact angles), and the surface chemical properties of the liquid, e.g., its tendency to form foam and wetting films on the channel surface.

Unless otherwise specified the terms "flow rate of the gas" or "inlet flow rate of gas" or "volumetric flow rate of gas" are used interchangeably and mean the flow rate at which the gas enters the tube, i.e., at the inlet of the channel. Similarly, unless otherwise specified the terms "flow rate of liquid" or "inlet flow rate of liquid" or "volumetric flow rate of liquid" are used interchangeably and mean the flow rate at which the liquid enters the tube, i.e., at the inlet of the channel.

Since the pressure of the gas varies along the length of the tube from an entrance pressure (e.g., pressure of the gas source) to atmospheric pressure at the tube outlet, the linear velocity of the gas stream also varies along the length of the tube being maximum at the outlet. The flow rate of the gas at any distance also depends on the diameter and length of the tube.

The intrinsic variability of the flow rate of gas along the length of a tube can be appreciated from the illustration given in Table 1 below. Here the outlet flow rates (at the tube exit) and inlet flow rates (at the tube entrance) $U_{out}$ and $U_{in}$ respectively for different channels (different types of tubes) of a typical endoscope are given in Table 1 below. The gas pressure is expressed as pounds per square inch (psi). In SI units 1 psi=6,894.8 Pascals (Pa).

TABLE 1

Linear gas velocities in m/sec within a "suction channel" and an "air/water (A/W) channel" of an endoscope at two gas pressures. ($U_{out}$ and $U_{in}$ are velocities within inlet and outlet of tubes).

| | Gas Pressure, psi | | | |
|---|---|---|---|---|
| | 18 | | 30 | |
| Endoscope channel | $U_{out}$ | $U_{in}$ | $U_{out}$ | $U_{in}$ |
| Suction channel (diameter = 3.8 mm) | 67.7 | 32.3 | 118 | 45.4 |
| A/W channel (diameter = 1.5 mm) | 9.9 | 4.65 | 19.4 | 6.6 |

The intrinsic increase in gas velocity along the tube has important consequences for the type of flow regimes that may be encountered in the channel which as a consequence, may vary along its length.

The flow regime at any position in the channel is characterized by the type of liquid flow elements (liquid structures) that are present in the channel and there are many types of flow elements and combinations of flow elements which are possible depending upon the controlling parameters employed and the position along the channel observed. The most important flow elements are briefly described below. A more precise and detailed description of some of these flow elements is given in Example 1 which illustrates the mapping of flow regimes.

Annular film is a contiguous film attached to the surface of the channel. For hydrophilic channels that are wet by the liquid phase, annular films are easily formed even at relatively low liquid flow rates while for hydrophobic surfaces that are not wet by the liquid phase annular films are only formed above a critical liquid flow rate that creates forced wetting of the channel surface.

Entrained Droplets are discrete droplets of liquid suspended in and carried along the tube by the gas phase. Entrained droplet can arise by introducing the liquid phase into the channel as an aerosol where it is predispered in the flowing gas by, for example, the use of a nozzle. Entrained droplets also arise by the pulling out of droplets of liquid from other liquid structures in the channel such as for example, annular films by the rapidly flowing gas. The latter fragmented entrained droplets are called mist droplets.

Foam is a dispersion of gas in the liquid and generally arises at high gas flow rates and is often formed towards the outlet end of the channel where the flow rate of gas approaches its maximum value. Foam is promoted by the incorporation of foaming surfactants in the liquid cleaning medium. The foam can be in the form of a continuous structure occupying the entire volume of the channel or a section of the channel or the foam can be discontinuous only occupying a portion of the channel cross section, e.g., flowing along a portion of the bottom half of the channel.

Rivulet is a term which refers to a narrow stream or thread of liquid that flows only over a fraction of the total available channel area of the tube, generally at the bottom of the tube because of the influence of gravity. Rivulets are formed in hydrophobic channels above a critical liquid flow rate but below the liquid flow rate that either produces forced wetting of the channel surface to form an annular film (see above) or fills the channel volume with a flowing plug of liquid.

Depending upon how the liquid is introduced into the channel, the liquid and gas flow rates, the rivulet can be a substantially contiguous stream or be discontinuous. Discontinuous rivulets form, for example, when the liquid flow is interrupted, i.e., when the liquid flow is pulsed.

Rivulet flow has been studied extensively in the case of liquid flowing down an inclined plane under the action of gravity force. (See for example by P. Schmuki and M. Laso, *On the stability of rivulet flow*, J Fluid. Mech. (1990) vol 215, pp 125-143). In the absence of a flowing gas, the rivulet flowing down an inclined plane has been observed to spontaneously "meander" or move in a zig-zag fashion in a direction perpendicular to the direction of flow. These "meandering rivulets" arise from hydrodynamic instabilities which depend in a complex fashion on the liquid flow rate, local contact angles (advancing and receding), liquid viscosity and incline angle among other things.

The situation is much more complex when a gas is simultaneously flowing through the tube at a flow rate that is much higher than the flow rate of liquid in the rivulet because of the tremendous hydrodynamic drag force exerted on the liquid surface. The flowing gas can greatly increase the meandering of the rivulet to such an extent that the meandering rivulet covers the entire cross sectional area of the channel. Essentially, portions of the main bottom rivulet move in a radial direction to climb up the wall of the channel (typically cylinder). However, when the flow rate of gas is sufficiently high the rivulet can straighten out and its meandering can be suppressed. This straightening effect at higher gas flow rates can occur nearer to the outlet of the tube where the gas velocity is at its maximum.

Surface Flow Entities (designated SFE) is a term that is used herein to describe the multitude of entities or elements in which part of the liquid phase is in direct contact with the surface of the channel and are characterized by having a three-phase contact line where the liquid, solid (channel surface) and gas phases intersect. Unless otherwise specified the term "surface of the channel" will be used to mean the interior surface of the channel or channel wall. A variety of surface flow entities can be formed, the most important ones being: droplets of various sizes which are attached to the surface of the channel and have a more or less circular shaped three phase contact line (term "droplets" for purposes of the instant invention also encompasses asymmetric "blob" shaped liquid bodies); cylindrical bodies which include cigar shaped, oblate and prolate spheroidal shaped, asymmetric shaped and thread or rivulet shaped (called sub-rivulets) liquid structures attached to the surface of the channel which have a more or less elliptical shaped three-phase contact line (with potentially widely varying major and minor axis dimensions); meandering rivulets discussed above; and liquid plugs (also called slugs) which are discrete cylindrical indexes of liquid which fill a limited portion of the channel volume and have a more or less circular three phase contact line contact line extending around the channel at the plugs leading edge (end of plug closest to outlet) and trailing edge (end of plug closest to inlet).

The terms "rivulet fragments", "plug fragments" or simply "fragments" will be used to designate a collection of surface flow entities that are derived by the fragmentation or disproportionation of rivulets, plugs.

Figure 1B:
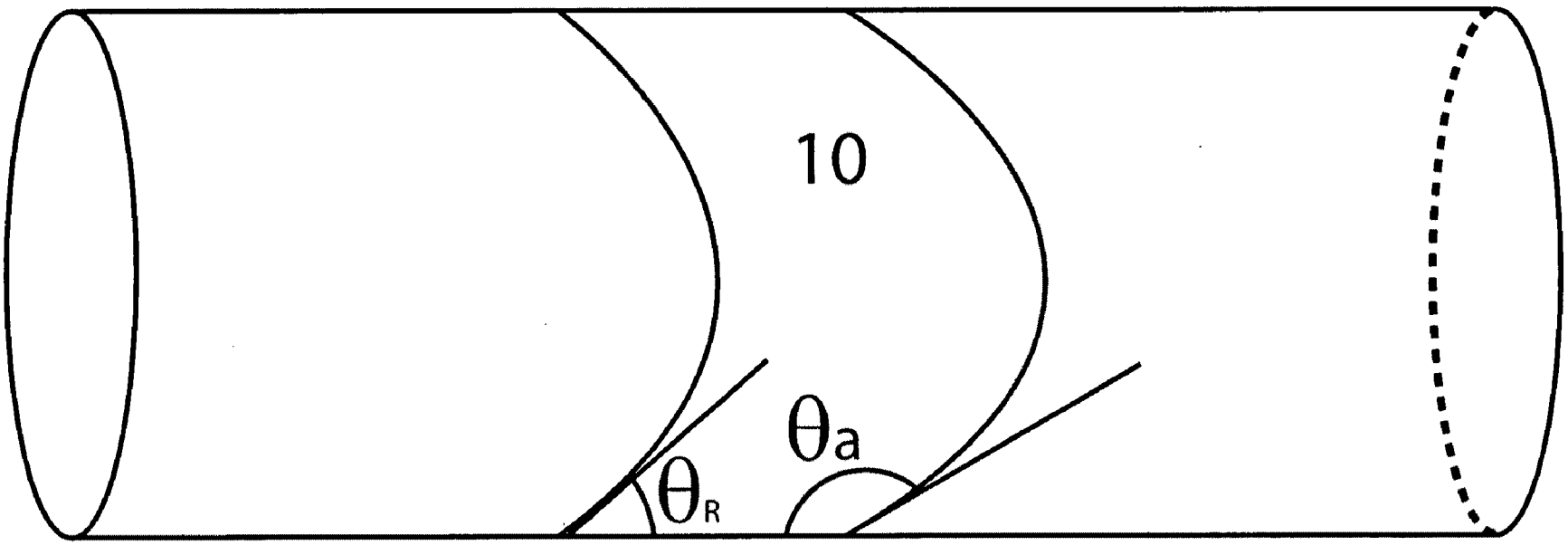
FIG. 1B is a schematic cross sectional view of a discontinuous liquid plug also showing advancing and receding contact angles

Various examples of droplets 2, cylindrical bodies 4, sub-rivulets 6 and meandering rivulets 8 are depicted schematically in FIG. 1A. For simplicity the channel surface is depicted as a flat surface and the surface flow entities are viewed perpendicular to the surface of the channel to show the outline of the three-phase contact line. Plugs 10 are depicted in FIG. 1B in cross sectional view.

Surface flow entities are also characterized by their advancing contact angle, $\theta_A$, and receding contact angle, $\theta_R$ which are well known terms in surface chemistry. The advancing contact angle is defined as the maximum contact angle which a line representing the intersection of the liquid/gas interface with a plane perpendicular to the solid surface (channel surface) makes at the intersection with the solid surface without movement of the three-phase contact line. The advancing contact angle (or simply "advancing angle") is measured through the liquid phase at the leading edge of the surface flow entity (edge closest to outlet).

The receding contact angle is defined as the minimum angle which a line representing the intersection of the liquid/gas interface with a plane perpendicular to the solid surface (channel surface) makes at the intersection with the solid surface without movement of the three-phase contact line. The receding contact angle (or simply "receding angle") is measured through the liquid phase at the trailing edge of the surface flow entity (edge closest to inlet).

Figure 2:
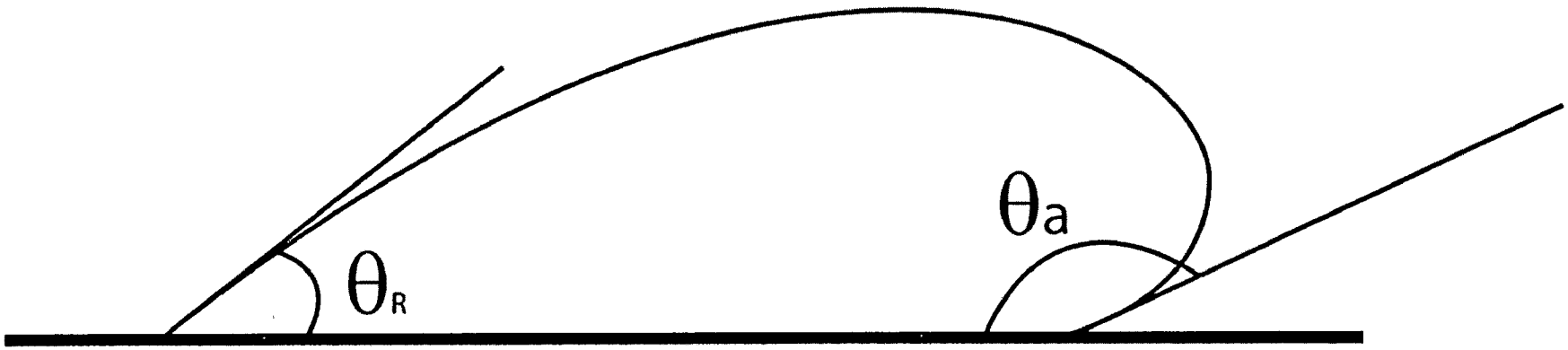
FIG. 2 is a schematic cross sectional view of a liquid droplet showing the advancing and receding contact angles.

The advancing contact angle and receding contact angle are illustrated in FIG. 2. It is noted that the advancing and receding angles vary somewhat because of heterogeneity along the surface of the channel and the direction of the perpendicular plane dissecting the flow entity.

Regardless of their exact shape, surface flow elements share the common property of being in contact with the channel wall and forming a three-phase contact line, characterized by $\theta_A$ and $\theta_R$, where the liquid gas interface intersects the channel wall. A liquid/gas interface extends from the three-phase contact line to form a meniscus close to the contact line.

When the surface flow entities are of a sufficient size (have sufficient surface area) they are swept by the drag force exerted by the flowing gas and thus "slide" or "move" on the surface of the channel. However, small droplets and small liquid threads which have less than a critical surface area stick on the channel wall and do not move over the surface. These droplets or small threads only become mobile when they coalesce with larger surface flow elements which may collide with them.

Depending upon the values of the controlling parameters, e.g., flow rates, various combinations of flow elements can coexist in the channel. Furthermore, the flowing gas transforms one type of flow element into one or more other types of flow elements in a highly dynamic and chaotic manner. Although the flow patterns are complex, at any instant of time, the predominant flow elements can nevertheless be identified by direct observation of a portion of the channel and thus the flow regime can be defined.

The transformations of flow elements of particular interest in the current invention are those transformations which produce various types of surface flow entities as discussed qualitatively below.

Two-phase flow involving annular films, entrained droplets and foam are known to be capable in varying degrees of removing contaminants from the internal surface of tubing. However, we have observed experimentally that for the cleaning of long, narrow channels, moving contact lines and menisci associated with surface flow entities can surprisingly be more effective in removing contaminants with which they come into contact from the internal surface of channels than these other forms of two phase flow provided the controlling parameters are chosen properly.

The relative effectiveness of cleaning by surface flow entities is especially significant for long narrow channels when the device including such channels because of their construction and materials, can only tolerate a limited gas pressure.

The method is highly suitable for gas pressures less than 50 psi, especially less about 30 to 35 psi although the method also works well for higher gas pressures. The exact pressure limit will depend on the channel diameter and length: very narrow channels may require higher pressure compared to wider channels. One example is the elevator-wire channels which endoscope manufacturers allow the use of 60 to 80 psig due to its very high hydrodynamic resistance.

The mode of cleaning produced by sweeping the channel with surface flow entities is especially effective for channels that have a diameter between about 0.2 mm and about 16 mm, especially about 0.5 mm to about 6 mm and a length between about 0.75 meters and 5 meters, especially about 1 meter to about 4 meters in length.

In the context of the present invention, the contaminants of particularly relevance include a broad range of foreign materials especially those of biological origin such as protein films or flakes, blood serum and platelets, bacteria, viruses, various model and real soils (e.g., natural soils such as fecal material), tissue fragments, solid particles and the like.

Without wishing to be bound by theory, we believe that moving three-phase contact lines and menisci can detach contaminants from the internal surface of the channel by one or both of two mechanism: i) hydrodynamic forces (viscous shear forces) generated in the vicinity of the three-phase contact line, and ii) capillary floatation forces.

i) Hydrodynamic Viscous Forces on Contaminant Particles

In regard to viscous shear for removing a contaminant particle, it is instructive to compare viscous shear forces that might be generated by a conventional bulk flow of liquid filling an entire channel, as compared to viscous shear that might be generated by a sliding liquid entity having three phase contact line and satisfying the criteria for high advancing contact angle and non-zero receding contact angle when encountering a particle.

For a conventional bulk laminar flow of liquid flow through a narrow channel, the velocity profile is parabolic. The velocity of the liquid is zero at the channel wall and is maximum near the center of the channel ($2U_0$). The velocity as a function of radial position is given by the following equation.

$$V(z)=2U_o[1-(R_t-z)^2/R_t^2] \quad (1)$$

where V(z) is the velocity of the flow with a distance z from the channel wall. $U_o$ is one half of the maximum velocity at the center of the flow, and $R_t$ is the radius of the channel. In the immediate vicinity of the wall, where $z/R_t<<1$, Equation 1 can further be simplified to give the velocity profile near the wall as $$V(z)=(4z/R_t)U_o \quad (2)$$

For determining hydrodynamic force that can be experienced by a contaminant particle attached to the wall, one may consider that a represents the radius of the contaminant particle. The most representative quantity to consider is the liquid velocity at the outermost point of the contaminant particle whose dimension is 2a. Thus, the liquid velocity at the outer edge of the contaminant particle is $(8a/R_t)U_o$. Thus, for a particle which is small compared to the radius of the capillary, the liquid velocity seen by the point on the particle farthest from the wall is only a small fraction of the maximum central velocity of the flow.

A different situation presents itself for flow of a sliding liquid entity attached to the channel wall and having a three phase contact line at its leading edge. It may be considered that the liquid entity advances with a sliding velocity of $U_{sf}$. It may further be considered that the leading edge of the sliding liquid entity appears as a wedge, and the wedge moves with a velocity profile V(z) which is zero at the channel wall and approaching 1.5 $U_{sf}$ at the top of the wedge at the air/water interface. This situation is described by Pierre-Gilles de Gennes, Francoise Brochard-Wyart, David Quere, "Capillarity and Wetting Phenomena", Springer, 2003. This situation occurs at any point on the sliding wedge, whether the point is near the tip of the wedge where the wedge is quite thin or further back from the tip of the wedge where the wedge is thicker.

For purposes of removal of a contaminant particle, the situation of interest is when the contaminant particle attached to the wall is located within the approaching wedge at the distance x from contact line when it touches the water/air interface. The smaller the particle is, the smaller the distance x. The mean velocity of liquid stream affecting particle is about 0.75 $U_{sf}$ because the velocity on the top of the wedge is 1.5 $U_{sf}$, and the velocity at the capillary wall is zero. The liquid velocity which affects attached particles is at least 0.75 $U_{sf}$, no matter how small a particle is because for any small particle there is a distance x to contact line where it touches both surfaces.

For any given particle, it is possible to compare the cleaning effectiveness of a sliding liquid entity against the cleaning effectiveness of bulk liquid flow, by comparing the liquid velocity at the edge of the particle for a sliding liquid entity, against the liquid velocity at the edge of the particle for conventional bulk flow. This ratio is $$V\text{edge (sliding liquid entity)}/V\text{edge(bulk flow)}=(1.5)(U_{sf}/U_o)(R_t/\alpha) \quad (3)$$

It can be seen that as the particle size represented by "a" becomes small, the advantage of a sliding liquid entity increases compared to bulk liquid flow. For example, when comparing with a bulk liquid flow with a maximum velocity of 200 cm/sec ($U_o$=100 cm/sec) in a tube which has a radius of 0.05 cm ($R_t$), the three phase contact line of a sliding liquid entity moving with $U_{sf}$=1 cm/sec can produce a 2 fold increase in detachment force compared to the detachment force of bulk liquid flow of 1 micron in radius, a 20 fold increase for the particles of 0.1 micron in radius, and a 200 fold increase for the particles of 0.01 micron in radius.

Thus, it is believed that for whatever are practical values of bulk flow maximum velocity and practical values of liquid entity sliding velocity, a sliding liquid entity can bring its velocity very close to the wall at the leading edge of an advancing wedge of the sliding liquid entity, whereas bulk flow cannot bring its maximum velocity near the wall. Thus, a sliding liquid entity has an advantage over bulk flow as far as exerting viscous force on small contaminant particles attached to the wall. However, it is not wished to be limited to this explanation.

ii) Capillary Flotation Forces on Contaminant Particles

The second possible mechanism to achieve cleaning uses a mechanism that involves a moving three-phase interface on the interior surface of the channel, i.e., an interface between liquid and gas at a solid surface. This cleaning mechanism may involve a portion of the surface being wetted by a liquid entity, and an adjacent portion of the surface being dry or nearly dry. As such an interface moves, it can generate forces that may act to dislodge contaminants.

It is believed that as a contact interface moves along a solid surface, the three-phase contact line can exert a force on elements of the surfaces such as contaminants which may be adhered to the surface. This force may contribute to breaking the adhesion such contaminants have with the underlying solid surface such as by lifting such contaminants away from the underlying solid surface. This may be termed "capillary flotation." This can involve moving three-phase contact interfaces and menisci. (The term "three phase contact interface" may also be expressed in the literature as "three phase contact line.") However, it is not wished to be limited to this explanation or to situations where this is the only cleaning mechanism taking place. For purposes of this discussion, it is intended that the terms "wet" and "dry" are such as to allow formation of a three-phase contact interface at the interface between the "wet" region and the "dry" region. In addition to including a situation of a classical perfectly dry surface, the situation is also intended to include possible situations where there might be an extremely thin or intermittent liquid film present, but where the overall behavior displays characteristics similar to those of a liquid entity moving on a perfectly dry surface. The dry and wet conditions according to this description may also be expressed in terms of the advancing contact angle, receding contact angle and residual thin liquid film remaining after passage of three phase contact line. The term dry or nearly dry indicates that the thickness of the residual thin liquid film may be smaller than the dimension of the contaminant present on the surface.

A mechanism of detachment can be caused by capillary tension forces at the liquid/air interface when a meniscus forms around a particle. According to this mechanism, touching the particle surface by a moving liquid initiates the onset of the capillary force, no matter whether a particle is hydrophilic ($\theta_p$<90°) or hydrophobic ($\theta_p$>90°). However, the contact angle of the cleaning liquid with the particle plays a significant role in the detachment by this mechanism. Selection of surfactant mixture of the cleaning composition may be tailored to enhance detachment of contaminants by this mechanism.

To describe nature of capillary force, the well-known equation for the attachment of a spherical particle to a rising bubble in flotation can be used. The capillary force equation for particle attachment to liquid/air interface is provided by Cristina Gomez-Suarez, et al., Applied and Environmental Microbiology, 67, 2531-2537 (2001), as follows:

$$F_{ca}=2\pi a\sigma \sin\psi \sin(\theta-\psi) \quad (4)$$

where a is the radius of the particle and σ is the liquid surface tension. The capillary force is proportional to the length of contact line 2πa sin ψ and to the surface tension. Sin(θ−ψ) arises at the transition from vector $F_\sigma$ to its projection $F_{\sigma ax}$. Angle ψ varies during interaction and, in particular, takes value corresponding to the maximum of capillary force:

$$F_{ca}^{max}=2\pi a\sigma \sin^2(\theta/2)(\pi/2<\theta<\pi) \quad (5)$$

$$F_{ca}^{max}=2\pi a\sigma \sin^2[(\pi-\theta)/2](0<\theta<\pi/2) \quad (6)$$

Capillary detachment force compared with hydrodynamic detachment force induced by a three phase contact line: The hydrodynamic detachment force $F_h$ near sliding three-phase contact line is represented as:

$$F_h=4.5\pi\eta a U_{sl} \quad (7)$$

where η is the liquid viscosity, a is the radius of the particle and $U_{sl}$ is the sliding velocity of the droplet or surface flow entity. The ratio of hydrodynamic force to the capillary force can be expressed as follows:

$$F_h/F_{ca}^{max}=(2.25/\sin^2\theta/2)Ca_{sl} \quad (8)$$

where $Ca_{sl}=\eta U_{sl}/\sigma$ is the capillary number which is very small. For example, assuming the sliding velocity $U_{sl}$ is 5 cm/sec, the liquid viscosity η is $1\times10^{-2}$ g/cm·sec and the surface tension of the liquid σ is 50 g/s$^2$ (dynes/cm), the capillary number is about $10^{-3}$. Considering the contact angle, the ratio between hydrodynamic and capillary forces for different θ and $U_{sl}$ is included in the following Table.

| $F_{ca}^{max}/F_h$ in Equation (8) | | |
|---|---|---|
| | $U_{sl}$, cm/sec | |
| θ | 0.5 | 5 |
| π | 4444 | 444 |
| π/2 | 2222 | 222 |
| 0 | 4444 | 444 |

Although in some cases capillary detachment force is clearly higher, there are situations when the hydrodynamic detachment force becomes important. If the particle contact with liquid/air interface cannot be provided, capillary detachment force will not be realized. In the meantime, hydrodynamic detachment force will still be present. Since the sliding velocities of surface flow entities span a wide range of values, it is believed that both mechanisms may operate together sometimes or one may dominate over the other depending on the channel diameters and operating conditions.

Capillary detachment force compared with bulk liquid flow: The hydrodynamic detachment force $F_{lf}$ created by a bulk liquid flow is expressed by the following equation:

$$F_{lf}=24\pi\eta U_o(a^2/R_t) \quad (9)$$

where $R_t$ is the radius of the capillary or small tubing and $U_o$ is one half of the maximum velocity of the liquid flow which occurs at the center of the flow. Comparison of the detachment forces caused by both bulk liquid flow and capillary interaction on a particle can be simplified as follows:

$$F_{lf}/F_{ca}\sim 12Ca_o(a/R_t) \quad (10)$$

where $$Ca_o=\eta(U_o/\sigma) \quad (11)$$

Applying the same parameters as used above, viscosity η is 1×10−2 cm/s, the surface tension of water σ is 50 g/sec$^2$ (dynes/cm), and assuming the maximum bulk liquid velocity is 200 cm/sec ($U_o$=100 cm/sec), $Ca_o$ is about 0.02. The hydrodynamic detachment force of liquid flow is order of magnitude weaker than the capillary detachment force.

Not wishing to be bound by this explanation, it is believed that both detachment mechanisms may operate depending on the nature of contaminants and the operating conditions, including the composition of the cleaning liquid used according to this invention.

In this mechanism of detachment, the meniscus formed at the leading edge of the fragment or drop makes contact with the contaminant and exerts a capillary force on the contaminant directed at least to some extent away from the surface of the channel (proportional to the normal component of surface tension force acting on the effective contact area). This detachment force may be expected to be a function of the surface tension of the liquid, the size of the contaminant (contact perimeter) and its wettability (contact angle). This force may be sufficient to detach the contaminant from the surface depending on the strength of the adhesive force holding the contaminant to the channel surface. It is believed that capillary flotation becomes increasingly effective when the advancing contact angle approaches 90 degrees or greater and the contaminant particles are below about 10 μm, especially below 5 μm. It is further possible that a receding contact angle of a sliding liquid entity or fragments can also generate such detachment forces.

The solid-liquid-gas interface may occur at either an advancing edge of a liquid entity, i.e., when a dry local region of the surface is becoming wet, or a retreating edge of a liquid entity i.e., when a wet local region of the surface is becoming dry. It is further noted that advancing and receding may generally coincide with the general direction of flow along a passageway or along the flow of a rivulet, but also the advancing and receding could also be associated with a component of motion transverse to an overall direction of flow along the length of a passageway. A representative form of transverse motion is meandering as described elsewhere herein. The motion of the liquid which causes the advancing or receding contact angle may be either along the general flow direction of the passageway, or may be perpendicular to the general flow direction of the passageway, or may be some combination of the two directions.

When the moving liquid entity provides, through either of these mechanisms or any combination thereof or any other mechanism, a sufficient force to detach a contaminant from the wall, the contaminant can then be swept along by the sliding liquid entity or drop or rivulet. The detached contaminant may be either moved along by the trailing edge of the liquid entity or may be captured at the liquid/gas interface of the liquid entity and thereby moved along. For either of these transport process it may be helpful that the receding contact angle is non-zero, i.e., the trailing edge of the surface flow entity can not be dragged out to form a trailing liquid film. The non-zero receding contact angle is believed to be more important in preventing film formation on the trailing surface than is the transport mechanism. The role of surfactants in the cleaning liquid is essential to controlling the advancing and receding contact angles of surface flow entities on the wall of the passageway. The surface hydrophobicity of the passageway also plays a role along with surfactant composition in determining the contact angle and on deciding the wet-dry condition during rivulet droplet flow.

The instant method of cleaning, requires the generation of surface flow entities which have moving three-phase contact lines and associated menisci. A necessary condition for this to be achieved is that the surface of the channel is not wetted by the liquid cleaning medium otherwise the liquid would form a film over the channel surface. Thus, the surface of the channel must either be intrinsically hydrophobic, or made hydrophobic by surface treatment.

By the term "intrinsically hydrophobic" is meant that the material from which the tube is fabricated has a low energy, hydrophobic surface. The method is thus especially suitable for the cleaning of tubes made of a hydrophobic polymer.

The method is particularly suitable for cleaning hydrophobic surfaces made of hydrophobic polymers such as for example, polytetrafluoroethylene, fluorinated ethylene-propylene, polystyrene, polyvinylchloride, polyethylene, polypropylene, silicone, polyester such as MYLAR®, polyethylene tetraphthalate, polyurethane, carbon tubules and the like.

Alternatively, the method can be also be applied to the cleaning of channels made of intrinsically hydrophilic materials (higher energy, water-wettable surfaces) such as glass, ceramic or metal provided that the internal surfaces are treated with a surface modifying agent either prior to cleaning or alternatively in-situ by incorporating the surface modifying agent in the liquid cleaning medium. That is, the hydrophobic surface is provided by surface modification.

Surface modifying agents include surface modifying surfactants, coupling agents and surface modifying polymers.

Non-limiting examples of surface modifying surfactants include cationic surfactants comprising one or two long alkyl, flouroalkyl or silicone chains; various types of fluorosurfactants including cationic and phosphate functional groups; silicone surfactants or coupling agents especially those having reactive functional groups, fatty acids and alkyl phosphates and phosphonates in combination with divalent or trivalent cations, certain ethylene oxide based surfactants and various mixtures thereof.

Non-limiting examples of surface modifying polymers include fluorinated polymers with cationic and phosphate or surface reactive functional groups, silicone polymers incorporating reactive functional groups that are activated by heat or pH to bind to the hydrophilic surface and hydrocarbon based polyelectrolytes especially those with comb structure.

The degree of hydrophobicity of a surface can be quantified by the value of the advancing and receding contact angle. The method of cleaning of the instant invention is particularly suitable for channels having an advancing contact angle of the liquid cleaning medium with the internal channel surface of about 50 degrees and greater, especially 70 degrees and greater, particularly 80 degrees and greater.

To avoid the formation of liquid films drawn out at the trailing edge of moving surface flow entities that suppresses the formation of three-phase contact lines, the receding contact angle should be greater than zero, preferably greater than 10 degrees and more preferably greater than 20 degrees.

The instant two-phase cleaning method requires the generation of one or more surface flow entities that include drops, cylindrical bodies (including sub-rivulets, rivulet fragments, and plug fragments), meandering rivulets, and plugs as described above and ensuring these surface flow entities sweep the entire surface with sufficient velocity and frequency to effect efficient contaminant detachment.

To maximize the fraction of liquid that is present in the channel as moving surface flow entities which by definition have a moving three-phase contact line requires that the volume of liquid present in flow elements that are relatively less effective in contaminant detachment are minimized. Thus, the amount of liquid present as annular films, entrained droplets (droplets entrained in the gas phase) and foam should be minimized.

To minimize annular films, less than 30% of the surface of the channel, preferably less than 20%, preferable less than 10% should be covered by a contiguous annular film (by contiguous we mean an annular film present without breaks or gaps). Still more preferable is the absence of contiguous annular films. As will be shown below the proper selection of the liquid composition is critical to prevent formation of annular film formation.

To minimize entrained drops, the liquid cleaning medium should not be substantially predispersed in the gas phase. By the term "not substantially predispersed" is meant that less than about 10%, preferably less than about 5% and preferably less than 1% of the volume of the liquid cleaning medium should be predispersed. Still more preferably, none of the cleaning medium should enter the channel as predispersed drops. The minimization of entrained droplets is also important because small drops can stick to the surface of the channel and not move due to the small drug force because of their small surface area.

To further ensure minimization of entrained drops, the flow rate of gas and liquid should be such that mist droplets (entrained droplets that are pulled into the gas phase by the hydrodynamic drag of the flowing gas stream) are substantially absent. By the term "substantially absent" is meant that the volume of liquid contained in mist droplets should be less than about 20%, preferably less than about 10% and more preferably less than about 5% of the total volume of liquid flowing through the channel.

To ensure that foam is minimized, the flow rates of liquid and gas and the composition of the liquid cleaning medium should be chosen such that foam is absent from at least about 75% of the channel on the basis of its total length, preferably at least 80% and more preferably at least 90% of the channel by length.

Following the detachment step involving the flow of liquid cleaning medium and gas through the internal channel as surface flow entities, the channel is rinsed to remove residual liquid cleaning medium and detached contaminants from the channel.

The rinsing step can involve any suitable liquid and can be accomplished with any suitable delivery system and flow regime including the flow regimes used in the detachment step as well as various other flow regimes that do not necessarily involve surface flow elements. Even single phase liquid flow can be employed. A suitable rinsing liquid is water, especially bacteria-free water to remove residual cleaning medium and detached contaminants that have not been removed during the detachment step.

The cleaning method of the instant invention as described herein is very different in several key respects from other types of cleaning methods disclosed in the art based on two-phase flow.

Firstly, the instant process does not rely on the erosion of soils or contaminants by the impact of entrained droplet. Thus, in the current method liquid should not enter the channel as preformed droplets but rather be present in the channel predominantly as surface flow element, i.e., the liquid should not be predispersed in the flowing gas stream by, for example, passage through a nozzle before entering the channel. Secondly, annular films and mist droplets must be minimized as discussed above. Thirdly, foam which has been found to detract from cleaning by the instant process of sweeping the channel with three-phase contact lines associated with surface flow elements, should be minimized.

An additional important difference from prior art methods concerns the much tighter control of the liquid cleaning medium (composition) and the flow rates that can be employed with the instant method. In contrast to prior art methods any surfactant or flow rate can not be used. The strict control of surface tension limits, contact angles of the cleaning solution with the surface and prevention of annular film and foam are required.

Although in principle various flow regimes can be utilized to create surface flow entities with three-phase contact lines that sweep the surface of the channel, two flow regimes have been found to be particularly suitable: Rivulet Droplet Flow (designated RDF), Discontinuous Plug Droplet Flow (designated PDF) and Discontinuous Plug Droplet Flow (designated PDPF). These flow regimes can be used separately or in combination during the contaminant detachment step.

Rivulet Droplet Flow

We have studied this type of two-phase flow regime by carrying out systematic microscopic observations through straight transparent Teflon tubes of various diameters at various liquid and gas flow rates at different distances from the inlet of the tube. By varying the focal plane, the flow along the top and bottom hemispheres of the tube could be observed. A high speed camera as well as stroboscopic illumination with multiple-exposure photography was employed to capture images over time so that the flow and flow entities could be analyzed over time and their movements tracked. The method is illustrated in Example 1. The following qualitative picture emerges.

When a liquid is allowed to enter a hydrophobic channel or a tube as a stream, the liquid forms a rivulet at the bottom of the channel, a bottom rivulet, provided the flow rate of liquid is insufficient to fill the volume of the channel. When gas is also allowed to flow through the channel, the gas exerts a drag force on the liquid and the flow elements formed in the channel depend upon the flow rate of both the gas and the the nature of the liquid composition employed.

At a low liquid flow rate, the bottom rivulet can disproportionate into droplets or sub-rivulets exposing dry area of the channel wall. As the liquid flow rate increases, the bottom rivulet is observed to become substantially continuous throughout the channel and at a critical liquid flow rate and gas flow rate is observed to meander around the surface of the channel, reaching even its top surface. For example, the critical flow rates to achieve meandering rivulets is observed to be between 5 and 15 m/s for a channel having a diameter of about 1.8 mm and length of 200 cm. Simultaneously, sub-rivulets or liquid threads are drawn out ahead of the bottom or meandering rivulet either along a direction parallel to the liquid flow in the bottom rivulet or at some angle to the bottom rivulet flow.

Although a portion of sub-rivulets remain attached to the bottom or meandering rivulet, they become unstable and, depending upon the local gas flow rate further fragment or break off as isolated cylindrical bodies or drops. These fragments are not contiguous with the main bottom rivulet or meandering segments but nevertheless move along the internal surface of the tube under the drag force of the flowing gas although very small droplets can stick to the wall and become immobile as discussed above.

The cylindrical bodies can contract to form droplets by a capillary (surface tension) driven process since they are not surfaces of minimum surface area, i.e., minimum surface energy or disproportionate to individual droplets. The process by which the cylindrical bodies disproportionate is similar to the Rayleigh instability observed for liquid jets. This disproportionation produces two types of additional fragments which remain attached to the internal surface of the channel. Linear droplet arrays arise when a series of droplets are formed at roughly the same time from the rivulet fragment: the droplets being more or less lined up in a row. Alternatively, individual drop can break off the tip of the rivulet fragment at regions of high local shear in much the same way as was described by G. I. Taylor for oil droplets under extensional or shear flow. Again, the linear droplet arrays and individual droplets remain attached to the internal surface of the channel and move along and down the tube in various directions depending upon the local gas flow in their vicinity.

The net effect is a collection of "surface flow entities" (meandering rivulets, sub-rivulets, rivulet fragments, cylindrical bodies, linear droplet arrays and droplets) moving along the internal surface of the tube simultaneously with the bottom rivulet. It should be understood that the surface flow is rather chaotic with various rivulet fragments and droplets colliding with each other and with the main bottom rivulet, meandering rivulets and sub-rivulets. Furthermore, the processes described above are repeated many times at different locations along the internal channel. This complex flow regime is defined as Rivulet Droplet Flow (RDF). The surface flow entities observed in this flow regime include meandering rivulets, cylindrical bodies including sub-rivulets, sub-rivulet fragments and various types of droplets and droplet arrays.

One of the remarkable features of RDF is that the collection of surface flow entities can be present all around the internal surface of the channel, i.e., radiate from the bottom of the channel and are present at top sides and bottom surfaces of the channel. Each or these surface flow entities has an associated three-phase contact line (equivalently designated as simply "contact line") and a liquid meniscus or simply "meniscus" which is the curved surface of the liquid radiating from the contact line.

The net effect of RDF flow is a collection of surface flow entities that are transported or swept along the internal surface of the channel. This Rivulet Droplet Flow regime is highly effective in detaching contaminants and is a preferred flow regimes used in the instant cleaning method.

As the liquid flow rate is further increased, annular liquid films and/or foam begins to form. Foam generally first forms at the end of the channel nearest the outlet where the velocity of the gas is at its maximum. As discussed above the presence of annular films and foam should be minimized for effective cleaning by surface flow elements. Consequently, for any given gas flow rate (flow rate at which the gas enters the channel, i.e., inlet gas flow rate), the liquid flow rate is selected so as to produce the RDF flow regime over as much of the channel length as possible, preferably over substantially the entire length of the channel. The liquid flow rate giving RDF has been found to depend on the length and diameter of the channel, the gas pressure and gas flow rate utilized as well as the liquid composition, e.g., type of surfactant or surfactants and is not universal.

At any instant of time only a fraction of the surface, generally less than 50%, of the total internal channel is covered by the surface flow entities in the RDF flow regime. Thus, a significant fraction of the internal surface at any instant of time is bare. In order to achieve a high level of cleaning, the RDF must be arranged such that the entire internal surface of the channel is swept at least once, preferably swept multiple times, by moving three-phase contact lines and menisci, i.e., surface flow entities should ideally move over the entire surface contacting all contaminants residing at all positions on the internal surface of the channel over its entire length.

On a statistical basis, the key variables that control the extent to which the internal surface is swept in a given time interval include: the number of surface flow entities that are generated, the area of contact of each entity with the solid surface and the velocity at which the flow entities slide along the surface. For a given channel geometry and dimensions, these variables in turn are controlled by the flow rate of the liquid entering the channel, the flow rate of the gas entering the channel, the interfacial properties of the cleaning medium especially as this governs the formation of the liquid flow entities, e.g., how easily meandering rivulets, cylindrical bodies and droplets are formed.

A method to determine the optimal flow rates as a function of channel diameter and length at a fixed gas pressure and flow rate to achieve the optimal RDF flow regime is described below and illustrated in Examples 1-7. The method can for example, be used to calibrate a cleaning apparatus utilizing the instant method is based on direct microscopic examination utilizing high speed photomicrography. In this procedure, representative sections at various distances along the tube length are observed microscopically and photomicrographs are taken using a high speed camera. After setting the gas pressure and gas flow rate, the liquid flow rate is systematically varied and photographs taken at preset distances along the tube. The microscope is arranged such that the focal plane can vary sufficiently so that substantially the entire internal surface of the channel at each segment or test volume element can be observed.

From these observations a "map" (diagrams such as are described in Example 2-7 of accessible flow regimes as function of the position along the internal channel length and the liquid flow rates can be constructed at a fixed pressure.

Regions of the flow map in which various types of surface flow entities are observed both over the entire internal surface of each observed volume element at all set intervals along the length of the channel are then selected, thus, providing optimal conditions for cleaning of the selected tube at the selected gas pressure.

A summary of controlling parameters useful for cleaning representative endoscopes are given in Example 20.

The gas pressure employed in the instant process can in principle be any pressure that is suitable to generate optimal RDF as discussed above up to the maximum allowable pressure for the channel being cleaned.

A gas pressure which is suitable to produce RDF flow regime for use with the various channels present in typical endoscopes currently used is in the range of about 5 to 28 psi, 10 to 28, or 30 to about 50 psi depending on diameter, length, overall hydrodynamic resistance of the channel and pressure limitation of the endoscope. However, some very small channels can tolerate higher gas pressures of for example 80 psi (see Example 7) which is suitable for these cases. Typically a suitable gas pressure is about 30 to about 35 psi. However, higher gas pressures may be suitable for channels of other types of tubular systems or for newly developed endoscopes depending upon their pressure tolerance. It should be understood that the reference to psi is a reference to guage pressure unless the circumstances indicate otherwise.

The inlet gas flow rate suitable to produce RDF flow for a range of channel diameters and lengths is in the range from about 0.01 to about 6.0 SCFM (standard cubic feet per minute) at a gas pressure between about 18 and about 30 psi or greater.

It has been found that suitable liquid flow rates are in the range from about 1 to about 100 ml/minute when the gas has a pressure of up to about 50 psi, and a gas flow rate from about 0.01 to about 10.0 SCFM. The ultimate flow rates and pressure used will depend upon the length and diameter of the channel.

For channels of about 0.6 mm in diameter and 2 meters or more in length, a suitable liquid flow rate is in the range from about 1 to about 10 ml/minute at a gas pressure that is at or below about 30 psi.

For channels of about 1.2 mm in diameter and 2 meters or more in length, a suitable liquid flow rate is in the range from about 4.0 to about 10.0 ml/minute at a gas pressure at or below about 30 psi.

For channels of about 2.8 mm in diameter and up to about 2 meters or more in length, a suitable liquid flow rate is in the range from about 10.0 to 25.0 ml/minute at a gas pressure at or below about 30 psi for a channel.

For channels of about 4.2 mm in diameter and up to about 5 meters in length, a suitable liquid flow rate is in the range from about 15.0 to 40.0 ml/minute at a gas pressure at or below about 30 psi for a channel.

For channels of about 6 mm in diameter and up to about 5 meters in length, a suitable liquid flow rate is in the range from about 30.0 to 65.0 ml/minute at a gas pressure is at or below about 30 psi for a channel.

A quantitative measure of the extent to which the surface of the channel is swept by surface flow entities is provided by a parameter designated as a Treatment Number, NT, defined as the total area that is swept by all the surface flow entities divided by the total internal surface area of the channel.

Treatment number equals one means that the entire channel is swept one time by surface flow entity. The Treatment Number can be computed from high speed photography of sample areas of specific dimensions (e.g., 400 μm by 300 μm) taken at various positions on the internal surface of the channel at different locations along its length by the following procedure. The determination of Treatment Number can be combined with the hydrodynamic flow mapping outlined above and described in detail below.

The total area swept in a fixed time $t_{cl}$ (e.g., 300 sec) by a particular surface flow entity (SFE), e.g., a drop or cylindrical body, of diameter $d_{SFE,i}$ is:

$$A_{SFE,i}=d_{SFE,i}U_{SFE,i}t_{cl} \quad (12)$$

where $U_{SFE,i}$ is the sliding velocity of the $i_{th}$ SFE, i.e., the rate at which the three-phase contact line at the leading edge of the rivulet fragment moves over the surface.

The total area swept during $t_{cl}$ for all the types of SFE that appear within a sample volume element (e.g., the field of view), including those SFE that enter and leave during the total observation time is:

$$\text{Total Area Swept by Rivulet Fragments}=\Sigma_i d_{SFE,i} U_{SFE,i}t_{cl} \quad (13)$$

where the sum is taken over all rivulet fragments.

Eq. 13 can be generalized for all types of surface flow entities (meandering rivulets, cylindrical bodies, linear droplet arrays, large drops, small drops, etc.) as $$\text{Total Area Swept by All Surface Flow Entities}= A_{cl,Tot}=t_{cl}\Sigma_k\Sigma_i d_{k,i}U_{k,i} \quad (14)$$

where $d_{k,i}$ is the diameter of the $i_{th}$ SFE of the "$k_{th}$" type, e.g., discrete droplet, having an average sliding velocity $U_{k,i}$.

The average sliding velocity of each surface flow entity can be measured by observing the movement of the flow entity in the axial direction or for meandering rivulets both axial and radial direction over time. Because of their rapid movement under the influence of gas flow, we have utilized multi-exposure time-lapse photography in which the camera shutter is allowed to remain open and exposure is controlled by a strobe light. By measuring the change in position of the moving three-phase contact line over time, the velocity of each SFE, can be determined and a distribution function of sliding velocity computed for each type of flow entity.

The Treatment number, $N^j_T$, is defined as the total area swept by all SFE divided by the total area of the channel, $A_C$ at the particular position being viewed, i.e., the "$j_{th}$" section or volume element of the channel along its length. For channels that are circular cylinders, $A^j_C$ is equal to πDl where πD is the channel perimeter, and l is the length of the visual area being viewed in axial direction. The treatment number at the "$j_{th}$" section (volume lement) is then given by:

$$N^j_T=A^j_{cl,Tot}/A^j_C=(t_{cl}/\pi D^2 l^j)\Sigma_k\Sigma_i d^j_{k,i}U^j_{k,I} \quad (15)$$

where the superscript "J" refers to the "$j_{th}$" viewing area.

The terms in Eq. 15 can be separated into different flow entities and further subdivided into discrete size ranges. The average sliding velocity of each type of flow entity falling into each size range can then be computed from the measured average velocities or a velocity distribution function.

The inspection of a large number images revealed that the distribution of SFE within any image is non uniform and only a relatively small strip of available area is cleaned at any instant of time. However, the time of residence of a particular SFE within the visual area is much less than a second and the number and type of SFE observed within the viewing area will change more than 300 times, if the cleaning time is for example 300 sec. Since the location of specific entities are different for different moments of time, a rather uniform treatment is achieved provided a sufficient time is allowed for cleaning and the treatment number is sufficiently large. On the other hand, the shorter the cleaning time, the larger will be the manifestation of large non-uniformities in the momentary distribution of SFE.

When the Treatment Number is ~1, the treatment uniformity is low. Although the area of the channel swept by SFE is equal to the geometric area of the channel, large regions of the channel remain untreated. However, when $N^j_T$ exceeds 30, preferably exceeds 50, the treatment of the particular section being viewed is sufficiently uniform such that all areas of the section are cleaned. When the treatment number reaches about 100 or more, a very high degree of uniformity in terms of fraction of total area swept by three-phase contact lines is observed.

Based on the above analysis, the Treatment number $N^j_T$ at substantially all position along the length of the tube (from inlet to outlet) should be greater than 10, preferably at least about 30, more preferably between and most preferably greater than about 50. Be the term substantially all positions along the length of the tube is meant at least about 75% of length of the tube, preferably greater than 80% of the tube length and most preferably greater than 95% of the tube length.

The instant method is in fact capable of routinely achieving very high treatment numbers of 100 or more and under some conditions 300 to 1000. These high treatment numbers achieve very high log reduction, e.g. pLog 6 in contaminant microorganisms.

Inspection of Eq. 15, indicates that treatment number depends upon the total number of surface flow entities formed over the course of the cleaning operation and their sliding velocities. Operationally, these variables are controlled by the liquid and gas flow rates and by interfacial properties and other properties such as viscosity of the liquid cleaning medium.

As the liquid flow rate increases the amount and type of SFE increases. This leads to an increase in Treatment Number with increasing liquid flow rate which is well documented experimentally by the analysis of photomicrographic images taken under various conditions.

Similarly, an increase in gas flow rate increases the number of surface flow entities and their sliding velocity since it is the drag force provided by the flowing gas which induces fragmentation and rapid sliding in the first place.

In a further embodiment of the instant cleaning method utilizing the RDF flow regime either or both the rivulet flows of liquid cleaning medium or the flow of gas are pulsed during the cleaning cycle which has been found to aid detachment of contaminants in some cases.

By the term "pulsed" is meant that the flow of either or both the liquid and gas is interrupted or paused for a period of time. The process can be characterized by a pulse time, $t_p$, defined as the time over which either or both the liquid cleaning medium and gas flows through the internal channel, and a delay time $t_d$, defined a the time interval between successive pulses, i.e., the time over which the flow is paused. One or more different pulse and delay times can be employed and sequenced as desired.

Pulsing either or both the rivulet flow and the flow of gas provides different distributions of surface flow entities inside the channel compared to continuous rivulet flow. This further ensures uniform cleaning of entire channel surface, specially the inlet and outlet sections. In particular, pulsing the rivulet flow allows cleaning the bottom surface of channel which is normally masked by the bottom rivulet. The latter RDF mode intermittently creates dry regions at the bottom of the channel which receives cleaning by surface flow entities created during subsequent rivulet pulse.

One of the main advantages of interrupting the liquid flow is to allow films that may have formed from stranded liquid to be removed from the channel from a combination of evaporation from the flowing gas or gas entrained flow of surface entities. Preferably, the delay time $t_d$ of the liquid is sufficient to remove liquid films from the channel surface. This removal of stranded liquid has also been observed to be facilitated by the pulsing of the gas stream.

Preferably, the pulse time, $t_p$, is in the range from about 0.1 to about 15.0 seconds and the delay time $t_d$ is in the range from about 1.0 seconds to about 20.0 seconds. The number of pulse (interruption of flow) during the detachment step can be 0 to about 3000 pulses, preferably 0 to about 1000 pulses and more preferably 0 to 200 pulses.

Enhancement of Hydrodynamic Detachment by Decrease of Liquid Plug Length in DPF Mode When the liquid plug is shorter than channel length, after it is separated from the liquid pump, it is driven by air pressure $P_a$. The resistance to flow will consist of two terms: i) resistance along the liquid plug and ii) resistance along the air portion in the channel. Since the viscosity and density of air are significantly smaller than those of liquid, it may be possible to disregard the small pressure drop along air portion of tube. This simplification becomes crude when the length of water plug, $L_{pl}$, is extremely smaller than compared to the length of the channel. This simplification can be illustrated by introduction the nominations for pressures on plug front $P_f$, plug rear $P_{re}$ and channel inlet $P_a$, while the pressure at tube outlet is zero. Hence, $$P_a=P_f+(P_{re}-P_f)+P_a-P_{re} \tag{16}$$

$P_f-0$ and $P_a-P_{re}$ are pressure drops within air and they may be disregarded as being proportional to small air viscosity (or inertia). Hence, we have on r.h.s. $P_{re}-P_f$, i.e. the pressure drop over plug $$P_f-0<<P_a;P_a-P_{re}<<P_a \tag{17}$$

Hence $$P_{re}-P_f=P_a \tag{18}$$

There is a balance between pressure drop applied to the liquid plug and shear stress, $\tau$, between plug and adjacent channel wall, area $2\pi R_t L_{pl}$ where $L_{pl}$ is the plug length. The total shear stress applied to the plug is $2\pi R_t L_{pl}\tau_{pl}$ is overcome due to applied pressure $P_{re}-P_{fr}=P_a$, i.e.

$$2\pi R_t L_{pl}\tau_{pl}=P_a(\pi R_t^2) \tag{19a}$$

or $$\tau_{pl}=P_a(R_t/2)(1/L_{pl}) \tag{19b}$$

This equation is valid, in particular, when the plug fills the entire tube, i.e. when $L_{pl}=L_t$ $$\tau_t=P_a(R_t/2)(1/L_t) \tag{20a}$$

However, at this initial moment the plug is yet not disconnected from the liquid pump, i.e. in this moment the plug is driven by pump pressure $P_{pu}$ $$\tau_t=P_{pu}(R_t/2)(1/L_t) \tag{20b}$$

For the sake of simplicity we assume that $$P_a=P_{pu} \tag{21}$$

which reduces two equations (19a) and (19b) to one. The joint consideration of Eqs(18) and (19a) shows that they have identical multiplier in the bracket. The ratio of l.h.s. of these equations equals to ratio of r.h.s., while the mentioned multiplier cancels $$\tau_{pl}/\tau_t=L_t/L_{pl} \tag{22a}$$

or $$\tau_{pl}=\tau_t(L_t/L_{pl}) \tag{22b}$$

Since the cleaning is caused by shear stress, the specification $\tau$ for either laminar or for turbulent regime is excessive. The Eq(22b) is valid for both regimes as well as for the laminar-turbulent transition mode. The equation shows that as the plug length decrease approximately 50 times, $\tau_{pl}$ increases 50 times. The further decrease $L_{pl}$ will lead to slower increase in $\tau_{pl}$ because the requirements expressed by Eq(17) fail. However, this requirement may be omitted and more general equation can be derived. It is noteworthy to note that $\tau_{pl}$ in Eq(22b) is shear stress of liquid flow for the condition of plug flow.

In order to clarify the effect of plug length influence on cleaning by hydrodynamic detachment near the three phase contact line, we need to consider the dependence of front meniscus velocity on plug length for turbulent or transition flow, especially for the case of suction channel because at 30 psi Reynolds number Re is rather high even for continuous liquid flow. For Pentax endoscope Model FG-36UX suction channel, using liquid velocity $U_o$=146 cm/sec yields $Re_o$=(0.38×146)/0.01=5548, at 35 psi. For the water channel $Re_o$=(0.18×108)/0.01=1950. With decreasing plug length, its velocity increases that causes Re increase and transition to turbulent flow even for water channel. Accordingly, we need to apply the main equation for turbulent flow in tubes, namely the equation for resistance coefficient for tube (L. D. Landau, E. M. Lifshits, "Mechanics of Continuous Media-Hydrodynamics", Adison-Wesley Publishing Company, 1958):

$$\lambda=P_a(2R_t/L_{pl})/(1/2)\rho U_{pl}^2 \tag{23}$$

Where $\rho$ is the density of liquid. The pressure, velocity and length are specified for the case of a short plug. $\lambda$ is a sophisticated function of Re. As we are interested in plug velocity dependence on its length, the Eq(23) is rewritten $$U_{pl}=(4P_aR_t/\rho\lambda_{pl})^{0.5}(1/L_{pl})^{0.5} \tag{24}$$

This equation is valid for extreme case when the plug length equals to tube length $$U_o=(4P_aR_t/\rho\lambda_t)^{0.5}1/(1/L_t)^{0.5} \tag{25}$$

The ratio of r.h.s. equals to the ratio of l.h.s. that yields $$U_{pl}/U_o=(L_t/L_{pl})^{0.5}(\lambda_t/\lambda pl)^{0.5}\sim(L_t/L_{pl})^{0.5} \tag{26a}$$

FIG. 22 in (1. L. D. Landau, E. M. Lifshits, "Mechanics of Continuous Media-Hydrodynamics", Adison-Wesley Publishing Company, 1958) shows that the friction coefficient $\lambda$(Re) decreases less than twice in the Reynolds range 5000 to 30000. The Eq(11b) shows that the plug velocity increases as its length decrease $$U_{pl}=U_o(L_t/L_{pu})^{0.5} \tag{26b}$$

Not wishing to be bound by this explanation, the following table shows the relationship between liquid plug length expressed as percentage of total channel length in the suction channel of a typical endoscope and plug sliding velocities that can be achieved during the DPF mode at two air pressures, 15 and 25 psig. These velocities may represent the sliding velocity of the moving three phase contact line of the plug front as it moves through the tube under these pressures. The very high sliding velocities of this flow regime may result in significantly increasing the detachment force by the moving three phase contact line. The results of this analysis support the inherent advantages of using the discontinuous modes to enhance the cleaning according to the instant invention. This is further supported by the results in Example 19.

Plug Velocity as a Function of Plug Length/Total Channel Length at Two Pressures

| | Plug Velocity ($U_{pl}$), m/s | |
|---|---|---|
| ($L_{pl}/L_t \times 100$) | @15 psig | @25 psig |
| 1% | 11.0 | 17.0 |
| 5% | 4.9 | 7.6 |
| 10% | 3.5 | 5.4 |
| 20% | 2.5 | 3.8 |
| 30% | 2.0 | 3.1 |
| 40% | 1.7 | 2.7 |
| 50% | 1.6 | 2.4 |
| 100% | 1.1 ($U_0$) | 1.7 ($U_0$) |

Discontinuous Plug Flow and Discontinuous Plug Droplet Flow

When liquid is allowed to enter a hydrophobic channel of a tube at a sufficiently high flow rate of liquid, the liquid will begin to fill the channel provided that liquid flow rate is equal to or greater than the maximum flow rate possible for the particular tube diameter under the prevailing pressure drop across the liquid. If the liquid flow is interrupted while gas continues to flow into the channel, a plug of liquid pushed along by the gas is produced. The fraction of the channel occupied by this plug depends upon the volume of the liquid aliquot "pulsed" (injected as a discrete volume element) into the channel over a given pulse time $T_p$ (the time over which the flowing liquid is injected into the channel before interrupting the flow). Since this liquid plug is a surface flow entity having a three-phase contact line and associated meniscus, it is capable of detaching contaminant with which it contacts.

When the gas flow rates is low, the liquid plug can pass through the entire channel as a plug such as depicted in FIG. 1B and detach some of the debris with which it comes into contact. If additional liquid aliquots are pulsed into the channel, the sweeping process is repeated and the channel can be swept repeatedly by the flowing liquid plugs. If each of the pulsed liquid aliquots has a volume less than about 5%, preferably less than 1% of the channel volume, the process can be repeated many time during a reasonably short cleaning time, e.g. 5 minutes. This type of flow regime is designated Discontinuous Plug Flow (DPF).

However, when the gas flow rate is increased and the plug length (length of the channel occupied by the plug) is relatively short, the gas phase is observed to break through the plug and its drag force induces fragmentation of the liquid plug to form cylindrical bodies and liquid drops by a similar mechanism as described above for RDF flow. These plug fragments are also swept along the channel surface and are effective in detaching contaminants. This type of flow regime also allows the channel to undergo dewetting to remove any liquid films that may have formed so that cleaning by three phase contact line is optimal.

The cylindrical bodies can further disproportionate to form drops by the processes discussed above for rivulet fragmentation.

The net effect is a collection of surface flow entities (in this case mainly plugs, cylindrical bodies and drops) moving along the internal surface of the tube. Like RDF flow, it should be understood that the surface flow is rather chaotic with other plugs and various plug fragments colliding with each other. Furthermore, the processes described above are repeated many times at different locations along the internal channel. This complex flow regime is designated Discontinuous Plug Droplet Flow (DPDF).

The procedure described above for mapping of flow regimes and determining suitable flow rates and Treatment Numbers for Rivulet Droplet Flow can also be applied to optimize DPD and DPDF flow regimes which are both suitable flow regimes for the cleaning method described herein. In addition to flow rates, DPD and DPDF flow regimes are characterized by a pulse time, which is defined as the time in seconds over which the liquid aliquot(s) is (are) pulsed or injected into the channel.

It should be noted that when multiple plugs are employed as is usually the case, the volume of each plug need not be the same, i.e. a different pulse time or aliquot volume can be employed.

The range of gas pressures employed in generating DPD and DPDF are generally the same as was described above for RDF, e.g., 10 to 30 or 30 to about 50 psi with some higher gas pressures of for example 60 to 80 psi for some small channels, e.g., elevator-wire channel. Typically a suitable gas pressure is about 10 to about 35 psi, or 18 to 28 psi as in current commercial endoscopes.

The inlet gas flow rate suitable to produce DPD and DPDF flow for a range of channel diameters and lengths is in the range from about 0.1 SCFM to about 8.0 SCFM (standard cubic feet per minute) at a gas pressure from about 18 to about 30 psi or greater.

It has been found that suitable liquid flow rates are in the range from about 4.0 to about 100.0 ml/minute when the gas has a pressure of up to about 30 psi, and a gas flow rate from about 0.1 to about 8.0 SCFM, while a suitable pulse time is in the range from about 0.1 sec to about 15.0 sec. The ultimate flow rates, pressures and pulse times used will depend upon the length and diameter of the channel.

For channels of about 0.6 mm in diameter and typically up to 2 meters or more in length, a suitable liquid flow rate and pulse time is in the range from about 5.0 to about 10.0 ml/minute, and about 0.1 to about 15.0 sec respectively at a gas pressure that is at or below about 35 psi.

For channels of about 1.2 mm in diameter and typically up to 2 meters or more in length, a suitable liquid flow rate and pulse time is in the range from about 5.0 to about 15.0 ml/minute, and about 0.1 to about 15.0 sec respectively at a gas pressure that is at or below about 35 psi.

For channels of about 2.8 mm in diameter and typically up to about 2 meters or more in length, a suitable liquid flow rate and pulse time is in the range from about 10.0 to about 30.0 ml/minute, and about 0.1 to about 15.0 sec respectively at a gas pressure that is at or below about 35 psi.

For channels of about 4.2 mm in diameter and typically up to about 5 meters in length, a suitable liquid flow rate and pulse time is in the range from about 15.0 to about 45.0 ml/minute, and about 0.1 to about 15.0 sec respectively at a gas pressure that is at or below about 35 psi.

For channels of about 6 mm in diameter and typically up to about 5 meters in length, a suitable liquid flow rate and pulse time is in the range from about 25.0 to about 65.0 ml/minute, and about 0.1 to about 15.0 sec respectively at a gas pressure that is at or below about 35 psi.

The number of aliquots (or pulses) for a typical cleaning cycle is in the range from about 10 to about 1000 pulses per cleaning cycle.

Flow Regime Mapping Procedure

The procedure described above for mapping of flow regimes and determining Treatment Numbers also provides a generalized method for determining liquid and gas flow rates, pulse times, etc, that produce optimal RDF, DPF and DPDF flow regimes for cleaning internal surfaces of channels of endoscopes, narrow tubing and capillaries. The method involves analysis of images of flow regime taken through transparent tubes and includes the following required and optional steps:

i) arranging Rivulet or Plug flow of liquid at different liquid and gas flow rates at one or more gas pressures in the internal channel, I need to introduce pulse rivulet flow some where!

ii) acquiring multiple high-speed photomicrographic images of flow taking place within a volume segment of the internal channel at set intervals along the length of the channel for a fixed time, $t_{cl}$, iii) analyzing the images to define the flow regime within the volume segment at each set interval, iv) constructing a map of flow regimes as a function of the length of the internal channel and the liquid flow rates at different gas pressures, vi) optionally measuring linear dimensions and average sliding velocities of surface flow entities observed in multiple images acquired in step ii), vii) from data collected in step vi) optionally computing at each volume element a Treatment Number, $N^j_T$ where the superscript "j" refers to the particular volume element being examined, viii) optionally superimposing Treatment Numbers obtained in step vii) on the map of flow regimes constructed in step iv), ix) from the map of flow regimes and optional treatment numbers selecting liquid and gas flow rates that produce Flow Regimes corresponding to RDF, DPF, DPDF or combinations thereof over the entire surface in one or more volume elements, preferably in the majority of volume elements and most preferably in all the volume elements.

In step i) in the above method the liquid flow rate is generally in the range from about 1.0 to about 120.0 ml/min, the gas flow rate is in the range from about 0.01 to about 10.0 SCFM, the gas pressure is in the range from about 5.0 to about 55.0 psi, and the internal channel has a diameter in the range from about 0.6 to about 6.0 mm and a length in the range from about 0.75 m to about 5 meters.

As has been discussed above, foam formation and annular films should be minimized and preferably avoided. Consequently, it is preferable to select a liquid and gas flow rates in step ix) that produce flow regimes in which annular films and foam are absent over at least 75% of the length of the channel, preferably over 80% of the length of the channel length.

To ensure that the flow regime regions selected in step ix) achieve high levels of cleaning, it is also preferable to select liquid and gas flow rates in step ix) such that the Treatment Number is at least about 10 in the one or more volume elements, preferably in the majority of volume elements (over half, preferably 75% or more of the length of the channel).

For some channels, especially very narrow channels (e.g., channels having diameter less than 1 mm), it may not be possible to achieve the RDF flow over the entire length of the channel at the gas pressure selected. In such cases, it has been found that the fraction of the channel length accessible to RDF flow can generally be expanded by increasing the gas pressure. However, if this is not practical because of limitation imposed by the maximum pressure tolerance of the tube to be cleaned, then either DPF or DPDF flow regimes can to be used to effectively clean those regions not accessible to RDF flow.

Optional Cleaning and Reprocessing Steps

The instant cleaning method can include several optional reprocessing steps which are generally required for medical applications such as the cleaning of endoscopes, where a high level of cleaning and disinfection is required.

The first additional step is treating the surface of the channel with germicide. The term germicide also encompasses biocides and disinfectants. Suitable germicides include aldehydes such as gluteraldehyde, peroxy acids such as peracetic acid which exists only in equilibrium with some concentration of hydrogen peroxide, oxidizing agent such as oxygen- or chlorine-based agents such as sodium hypochlorite or sources of the same, and hydrogen peroxide or sources thereof, as well as other oxidizing agents. It is possible to form hydrogen peroxide from hydrogen peroxide precursors, such as percarbonate or perborate. A catalyst can also be included to help the oxidizing action, as is known in the art.

The germicide can be pumped through continuously or allowed to sit in the channel for a period of time. Any suitable liquid delivery system can be employed including the two-phase flow methods described above.

A preferred germicide is a liquid germicide including an aldehyde, hydrogen peroxide or a peroxyacid.

When a germicide treatment is employed the channel should preferably be rinsed with clean water, e.g., bacterial-free water, to remove residual germicide. This second optional step is carried out in a similar manner as described above for the rinsing of the channel following the detachment step and again can be carried out by any suitable method.

A third optional step in the cleaning method is drying of the channel. This drying step can be carried out by flowing dry air through the channel (warm or ambient temperature air). However, it is preferable to first flow alcohol (ethanol) through the channel followed by air. An alcohol flood provides a final germicidal treatment, before the channel is dried and forms an eutectic mixture with any residual water present in the channel.

Liquid Cleaning Medium

So far we have discussed the physical parameters (gas and liquid flow rates, gas pressure, hydrophobicity of channel surface, etc.) that affect the performance of the present cleaning method and how these can be optimized for any channel width and length. However, the actual composition of the liquid cleaning medium also has an important role on the effectiveness of the instant cleaning process.

Surfactants

It is desirable to include one or more surfactants in the cleaning medium. Surfactant mixtures have been found particularly useful. However, only limited classes of surfactants are useful. Based on numerous experimentation surfactants could be divided into three classes when tested in endoscope channels by the flow mapping procedures outlined in Example 1-7.

Class I surfactants were observed to produce a wetting liquid film without foaming which prevented the RDF or DPDF flow regime from fully developing even at a surfactant concentration of 0.05% by weight. These surfactants generally have both a low HLB and are water insoluble. Some nonionic alkyl ethoxylates where the alkyl group is linear or branched, some members of the PLURONIC® REVERSE PLURONIC®, TETRONIC® and the REVERSE TETRONIC® series belong to this class. However, surprisingly the HLB quoted by the manufacturer alone was not sufficient to predict the formation of a wetting film on the hydrophobic channel, e.g., TEFLON®. However, when water solubility was also very low, a wetting film usually developed. Both HLB and water solubility appear to determine a surfactant potential to form wetting films in two-phase flow. HLB<9.2 and water insolubility normally lead to formation of a wetting film that covers the entire surface of the hydrophobic channel of endoscope at a surfactant concentration greater than about 0.05% by weight of liquid composition at 30 psi air pressure and low liquid flow rates. These surfactants are not desirable by themselves for cleaning by the instant invention since they do not produce surface flow entities having three phase contact line on channel wall during flow.

Class II surfactant produce foam throughout the channel which also inhibits RDF (and DPDF) even at a low surfactant concentration of 0.05% by weight. These surfactants have a foaming potential as measured by an initial Ross-Miles foam height of greater than 50 mm at 0.1% concentration and were found to produce foam that fills the entire tube (cross-section and length). The Ross Miles foam test is a well known measure of the foaming potential of surfactants and is described in J. Ross and G. D. Miles, Am Soc for Testing Materials, Method D1173-53, Philadelphia Pa. 1953. Most anionic surfactants tend to fall in this class, except for hydrotropes which do not normally foam but also do not lower surface tension much below 50 to 55 dynes/cm. Most cationic and quaternary ammonium surfactants were also found to be fall into class II when introduced into narrow channels in the presence of gas flow. Alkyl (alcohol) ethoxylates, castor-oil ethoxylates, sodium dodecyl sulfate (SDS/SLS), alkyl phenyl sulfonates, octyl and nonyl phenol ethoxylates that have high Ross-Miles foam index, HLB>9 and lower surface tension to 25 to 35 dynes/cm are examples of this class.

Class III surfactants are those that when used individually produce the RDF and DPDF flow regimes and are desirable surfactants for cleaning and detachment by the instant method. These surfactants normally give liquid fragments at concentrations at or above 0.05% by weight. Class III surfactants normally have very low Ross-Miles Index foam height of less than 50 mm, preferable less 20 mm and more preferable below 5 mm or close to zero. Many surfactants even optimal ones tend to lose their ability to produce RDF flow above 0.1% either because of the formation of some foam or wetting films.

Several general conclusions can be drawn from our experimental observations with respect to surfactants and RDF/DPDF flow regimes.

Suitable surfactants for DRF/DPF tend to be mostly nonionic and various alkoxylated surfactants although some low foaming anionic surfactants are also suitable.

Surfactants that produce a surface tension greater than 50 dynes/cm tends to produce poor liquid fragmentation on channel wall. Although the level of fragmentation is better than that with water, such surfactants only achieve low treatment number. They normally lack detergency to solubilize and desorb the organic soils encountered in dirty endoscopes. These types of weakly surface active surfactants include hydrotropes such as xylene sulfonate, hexyl sulfate, octyl sulfate and ethyl hexyl sulfates, or short alkyl ethoxylates and other similar nonionic or cationic agents. The liquid fragments are usually oval-shaped and do not produce linear droplet array at their trailing ends. The advancing and receding contact angles are high (e.g., 90 degrees or greater).

Surfactants that have surface tension less than 30 dyne/cm, especially surfactants that have low HLB and are water insoluble tend to produce a wetting film covering the entire surface of hydrophobic channels, as measured by a receding contact angle of zero degrees at a surfactant concentration in the range from about 0.05% to about 0.1% concentration at 30 psi and typical liquid flow rate required for RDF/DPDF flow (see examples). Forced wetting prevails and the flow map generated can be described as entirely in the "film mode" at most liquid flow rates. The wetting film normally covers the entire surface of channel. These may or not be associated with foam depending on other properties of the surfactant.

Surfactants that have a low Ross-Miles foam height less than about 50 mm, preferable 0 to about 5 mm and have equilibrium surface tension between 33 to 50 dynes/cm can achieve RDF flow modes as shown in the flow regime maps of Examples 2-7. However, some surfactants in this class tend to produce some foam in the channels, especially when used at high concentration and when used at high gas or liquid flow rates. Surfactants with surface tension of 33 to 47 dynes/cm, especially 35 to 45 dynes/cm give suitable RDF regimes and provide better cleaning performance. Mono-disperse surfactants with HLB 10-17 tend to encompass this group of surfactants. Foam can form near the outlet of the channel when surface tension is about 30-34 dynes/cm.

Based on above discussion of our experimental result, the liquid cleaning medium providing optimal flow regimes for the cleaning method of the invention preferably should includes one or more surfactants at a concentration that provides an equilibrium surface tension between about 33 and 50 dynes/cm, preferably about 35 to about 45 dynes/cm. The surfactant(s) should have a low potential to generate foam as measured by having a Ross Miles foam height measured at a surfactant concentration of 0.1% that is less than 50 mm, preferably less than 20 mm, more preferable below 5 mm, and most preferable close to zero, e.g., less than 1 mm. The cleaning medium should not form a wetting film on the channel surface (the interior wall of the channel) as measured by a receding contact angle greater than zero degrees. Preferably the surfactants are water soluble and have an HLB greater than about 9.2, preferably about 10 to about 14.

Suitable surfactants for use in the cleaning mediums according to the invention include polyethylene oxide-polypropylene oxide copolymers such as PLURONIC® L43 and PLURONIC® L62LF, and reverse PLURONIC® 17R2, 17R4, 25R2, 25R4, 31R1 sold by BASF; glycidyl ether-capped acetylenic diol ethoxylates (designated "acetylinic surfactants" such as SURFYNOL® 465 and 485 as described in U.S. Pat. No. 6,717,019 sold by Air Products; alcohol ethoxylates such as TERGITOL® MINFOAM 1X® AND MINFOAM 2X® sold by Dow Chemical Company and tallow alcohol ethoxylates such as Surfonic T-15; alkoxylated ether alkoxylated ether amine oxides such as AO-455 and AO-405 described in U.S. Pat. No. 5,972,875 available from Air Products and alkyldiphenyloxide disulfonates such as DOWFAX® 8390 from Dow Chemicals. Still other potentially suitable nonionic surfactants include ethoxylated amides, and ethoxylated carboxylic acids, alkyl or fatty alcohol PEO-PPO surfactants and the like provided they meet the surface tension, low foaming and non-wetting requirements Surfactant mixtures are also suitable in the cleaning medium and have been found in some cases to perform better than individual surfactants in providing RDF and DPDF regimes. Although surfactants belonging to Class III are preferred, Class I and II surfactants may be suitable as one of the components in a surfactant mixture especially when used in minor proportions. For example, the mixture may be chosen so that the mixture is soluble and has an average HLB in the preferred range. However, the mixture must satisfy the non-wetting film criteria properties, non-foaming criteria and provide a surface tension in the required range.

A particularly suitable surfactant mixture is a mixture of the acetylinic surfactant SURFYNOL® 485 and the alkoxylated ether amine oxide AO-455 at about 0.06% total surfactant concentration. The mixture unexpectedly provides highly effective RDF regimes in endoscope channels compared with the individual members of the mixture when used at the same concentration.

It is important to note that the concentration of the surfactants and other optional ingredients will generally affect the surface activity, wetting and foaming properties of the liquid cleaning medium. Thus, for example, a surfactant which is suitable at one concentration may not be suitable at either a lower concentration where its surface tension lowering is insufficient or at a higher concentration where foaming or wetting (annular film formation) properties may be unsuitable. The optimization of the surfactant concentration to achieve optimal flow regime for cleaning is considered well within the scope of a person of ordinary skill in the art with the understanding of the basic principles disclosed herein.

Optional Cleaning Ingredients

Various optional ingredients can be incorporated in the liquid cleaning medium of the invention. The various optional ingredients can, if desired, be excluded from the composition. When they are included, they can individually be included in amounts sufficient to provide a desired effect. By way of example, each of the optional ingredients can be incorporated in an amount of at least 0.01%. Preferred optional ingredients include:

pH adjusting agents: The pH of the cleaning medium should generally be above 8.0, preferably between about 9.5 and 11.5 and more preferable 10.0 to 11.0. Suitable pH adjusting agents include alkali hydroxides such as NaOH, KOH and sodium metasilicate, sodium carbonate and the like. By way of example, the pH adjusting agent can be included in an amount up to about 2%.

Builders or sequestering agents: These materials complex Calcium and other di and polyvalent metal ions in the water or soil. Examples of suitable builders/sequestering agents include complex phosphates such as sodium tripolyphosphosphate (STP) or tetrasodium pyrophosphate (TTPP) or their mixtures; EDTA or other organic chelating agents; polycarboxylates including citrates, and low molecular weight polyacrylates and acrylate-maleate copolymers. It has been found that some organic chelating agents may interfere with achieving the RDF mode and each candidate should therefore be evaluated by the methods disclosed in Example 1. By way of example, the liquid cleaning medium can include up to about 10% of a builder.

Cloud point antifoams: The cleaning solution may include additional surfactants that can reduce the foaming of the primary surfactants used in the composition. For example low cloud point surfactants such as PLURONIC® L61 or L81 can be added in small concentration (e.g., 0.01 to 0.025%) to decrease foaming. The concentration of the latter should be selected such that the RFD mode is maintained and that no liquid film formation occurs in the spaces between the surface flow entities. By way of example, the liquid cleaning medium can include up to about 0.4% of a cloud point antifoam.

Dispersants: These materials promote electrostatic repulsion and prevent deposition or re-attachment of detached contaminants or bacteria to channel surface. Suitable dispersants include polycarboxylic acid such as for example ACCUSOL® 455N, 460N and 505N from Rohm and Haas Company, SOKALAN CP5 or CP7 from BASF and related copolymers of methacrylic acid or maleic anhydride/acid and polysulfates or sulfonates. By way of example, the liquid cleaning medium can include up to about 1.2% of a dispersant.

Solvents and hydrotropes: These materials can be used to compatibilized the surfactant system or help soften or solubilize soil components as long as they do not interfere with the efficient production of optimal flow regimes for the instant cleaning method as evaluated by the method of Example 1. Suitable hydrotropes include for example xylene sulfonates and lower alkyl sulfate. Suitable solvents include for example glycol ethers. By way of example, the liquid cleaning medium can include up to about 2% of a solvent, hydrotrope, or mixture thereof.

Oxidizing agents: As discussed above oxidizing agent suitable oxidizing agents include peroxy acids such as peracetic acid, sodium hypochlorite or sources of the same, and hydrogen peroxide or sources thereof such as percarbonate or perborate.

It has been found that the addition of about 300 to 1000 ppm sodium hypochlorite to the cleaning liquid is effective in the removal of fibrinogen form hydrophobic endoscope channels, e.g., TEFLON® and may be optionally added in the cleaning composition to avoid complications arising from blood contamination of endoscopes. By way of example, the liquid cleaning medium can include up to about 0.2% of a oxidizing agents.

Preservatives: Preservatives known in the art can be employed to prevent growth of organisms during storage of the cleaning composition. By way of example, the liquid cleaning medium can include up to about 0.5% of a preservative.

In practical applications of the method, it is convenient to formulate the liquid cleaning medium as a concentrate (2× to 20×) which is diluted with water before use. In order to compatibilize the various ingredients in the concentrate, a solvent or hydrotrope may be required.

Applications to Endoscopes

The instant cleaning method including the optional germicidal treatment, rinsing and drying steps is especially suitable for the cleaning of the various internal channels of an endoscope.

Figure 3:
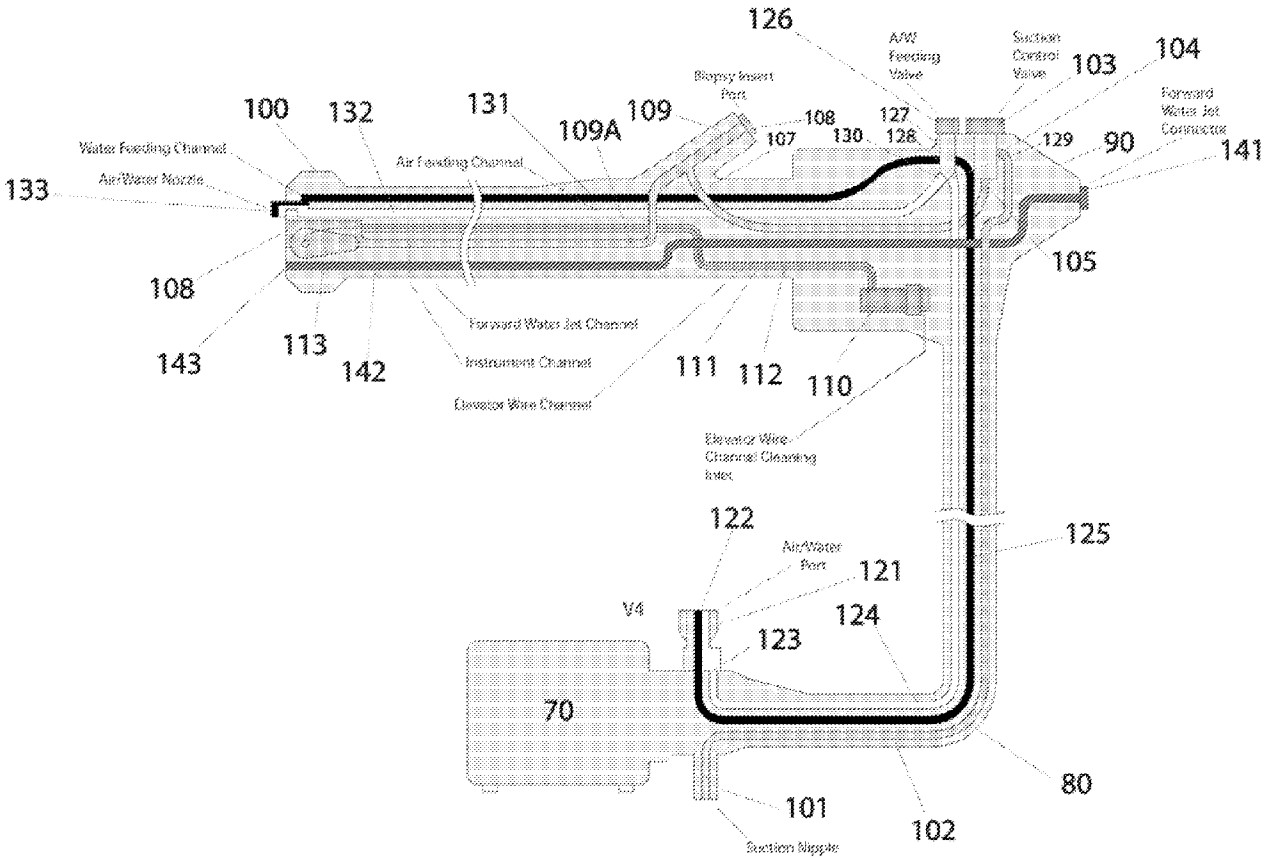
Fig.3 (PRIOR ART)
FIG. 3 is a schematic diagram describing the components of a typical endoscope.

A flexible endoscope, shown schematically in FIG. 3, is designed with a light guide plug (umbilical end) 70, connecting with an umbilical cable 80, a control handle 90, and an insertion tube (distal end) 100. The internal channels connecting from the light guide plug 70 to the distal end 100 or from the control head 90 to the distal end 100, are designed for specific functions necessary to perform medical procedures.

A suction/biopsy channel is a length of plastic tubing 102, running from the suction nipple 101 located at the umbilical end 70, to the suction control cylinder 103 located at the control handle 90, and a length of plastic tubing 107, running from the suction control cylinder 103, to meet with a plastic tubing 109 which is connected with the biopsy insert port 108. The suction/biopsy channel is then continued with a plastic tubing 109A to meet with the discharge port 108, located at the distal end. A suction control cylinder 103, is a metal housing used to accommodate a suction control valve during a medical procedure where an inlet port 105, and an outlet port 104, are included to connect with the plastic tubing 107 and the plastic tubing 102. The internal diameter of the suction/biopsy channel could vary from 2.5 mm to 6.0 mm with a maximal length up to 13 feet.

The air channel is a length of plastic tubing 124, running from the air/water port 121, located at the umbilical plug 70, to the air/water cylinder 126, located at the control handle 90, and a length of plastic tubing 131 running from the air/water cylinder 126, to the air/water nozzle 133, located at the distal end. The water channel is a length of plastic tubing 123, running from the air/water port 121, located at the umbilical end 70, to the air/water cylinder 126, located at the control handle 90, and a length of plastic tubing 132 running from the air/water cylinder 126, to the air/water nozzle 133, located at the distal end 100. The air/water nozzle 133, located at the distal end 100 is the point where the air and water channels meet in most endoscope models. The nozzle is small and can become obstructed with debris or crushed from an impact. The internal diameter of the Air/Water channel could vary from 1.0 mm to 2.2 mm with a maximal length up to 13 feet. Due to the nature of the tubing size and connection arrangement, the cleaning of the air and water channels is very difficult.

The forward water jet (or irrigation) channel is a length of plastic tubing 142 running from the forward water jet port 141 located at the control handle 90 or the umbilical plug 70 to the discharge port 143 located at the distal end 100.

The elevator channel is a length of plastic tubing 111, running from the elevator wire channel cleaning port 110 located at the control handle 90 to the distal end 100. A wire 112 is installed inside the elevator wire channel 111. One end of the wire 112 is attached to an elevator raiser 113 which is hinged near the suction discharge port 108 at the distal end. The other end of the wire 112 is attached to a control knob mechanism at the control handle 90 which starts from the elevator wire channel cleaning port 110. The space between the elevator wire channel 111 and the wire 112 is so small that makes this channel particularly susceptible to cleaning and disinfection problems.

In a preferred embodiment for endoscope cleaning the flow rates of the liquid cleaning medium and the gas are independently selected to optimize the amount of contaminants detached from the surface of each of the internal channels described above and illustrated in FIG. 3.

Among various endoscopes, typical lengths and inside diameters of certain channels can be tabulated, or at least ranges of these dimensions can be tabulated. These are summarized in Table 2.

The conditions producing optimal RDF, DPF and/or DPDF flow regimes can be determined for each type of endoscope channel by the mapping procedure described above and illustrated for RDF flow in Examples 1-7.

The cleaning method described herein is intended to be highly flexible and versatile. Consequently, during any cleaning cycle one or a combination of flow regimes selected from RDF, DPF and/or DPDF can be utilized and the flow regimes used in each tube do not need to be identical with respect to the type of flow regime used or the sequencing of flow regimes in the case of multiple regimes.

Since the different channels of endoscopes have different diameters and possibly different maximum permitted pressures, the flow rate of liquid for each channel can be optimized at a fixed gas pressure, generally near the maximum pressure. Optionally Treatment Number can also be determined.

Once the optimal flow conditions are determined, the endoscope channels can be repeatedly cleaned on a routine basis.

In the cleaning of endoscopes it is desirable that the flowing liquid cleaning medium and gas enter channels of the endoscope at one or both orifices of a suction channel 102 and the air 124 and water channel 123 which are typically located at a handle section 90 of the endoscope. It is also preferred that the flowing liquid cleaning medium and gas enter one or more, preferably all the additional channels as discussed above.

It is preferable that flowing liquid cleaning medium and gas entering channels from ports located in the umbilical end 70 are separate from flowing liquid cleaning medium and gas entering suction channels 102 and air 124 and water 123 channels at the handle section 90 of the endoscope. It is preferable that the flowing liquid cleaning medium and gas are introduced into the multiple channels of the endoscope (various component tubes of the endoscope) described above from a single sources, i.e., a single reservoir of liquid cleaning medium and a single pressurized gas source.

A preferred pressurized gas sources is compressed air either from a tank or from an in-line compressor although other compressed gasses such as nitrogen could be used.

A preferred source of liquid cleaning medium is a mixture formed by diluting a concentrated cleaning mixture, for example a concentrated solution including surfactants and various optional ingredients, with water via metered flow.

Preferably the liquid cleaning medium and gas are introduced together into each channel or type of tube.

Either one or all of the optional cleaning steps of germicide treatment, rinsing and drying can take place under any suitable flow regime generally in the presence or absence of a flowing gas stream.

Another embodiment of the present method employs channel extension tubes. As discussed above, the velocity of the gas at constant inlet pressure and flow rate increases as it moves through the channel and is maximum at the outlet. In order to achieve proper cleaning near the inlet and the outlet of the channel may require some manipulation of liquid and gas flow rates. One solution to this problem is to "extend" the

TABLE 2

| Air & Water Channels | | Suction Channel | | | |
|---|---|---|---|---|---|
| Internal Diameter | Length | Internal Diameter | Length | Internal Diameter | Length |
| Channels - Umbilical to Control Handle: | | | | | |
| | | | | Water Channel** | |
| 1.4 to 1.6 mm | 1.4 m | 1.2 to 5.0 mm | 1.4 m | 1.2 to 1.4 mm | 1.4 m |
| Channels - Control Handle to Distal End: | | | | | |
| | | | | Forward Water Jet/ Elevator Wire/ Irrigation Channels | |
| 1.0 mm (smallest) | 2.0 to 2.6 m | 1.2 to 5.0 mm | 2.0 to 2.6 m | ≧1.0 mm (FWJ) <0.8 mm (EW) ≧1.0 mm (Irrigation) | 2.5 m |

channel by fastening an additional tubes (designated an "extension tube") to the inlet of the channel so as to achieve the optimum RDF regime over the entire length of the channel. The use of extension tubes of any suitable length and material is within the scope of the invention.

EXAMPLES

The following examples are shown as illustrations of the invention and are not intended in any way to limit its scope.

Examples 1-7 illustrate the method of determining hydrodynamic modes of flow, mapping these modes as a function of flow rates for tubes of different diameters and identifying conditions that produce Rivulet Droplet Flow. The tubes employed are of diameters that cover the channels encountered with typical endoscopes.

Example 1

Method to Construct Flow Regime Maps

This method was developed to identify and define the flow regime (surface flow entities and their distribution) on the channel wall at several positions along channel length from inlet to outlet as a function of the operating parameters. Operating parameters include: channel diameter and length, liquid flow rate, air pressure, air flow rate and velocity, and surfactant type and concentration. The method enables identification and optimization of Rivulet-Droplet-Flow for various endoscope channels ports. In addition, the flow regimes at different positions along channel length has been used to define the operating conditions of the cleaning cycles necessary to achieve high-level cleaning of the entire channel surface area. As will become apparent, the flow regime (collection of fluid flow elements) varies as function of distance from channel inlet to exit and this necessitates different treatment conditions to achieve optimal results for each type of channel. Although the method is illustrated with RDF flow, the method can clearly be used to map DPF and DPDF flow regimes by introducing the liquid plug instead of a rivulet.

Figure 4:
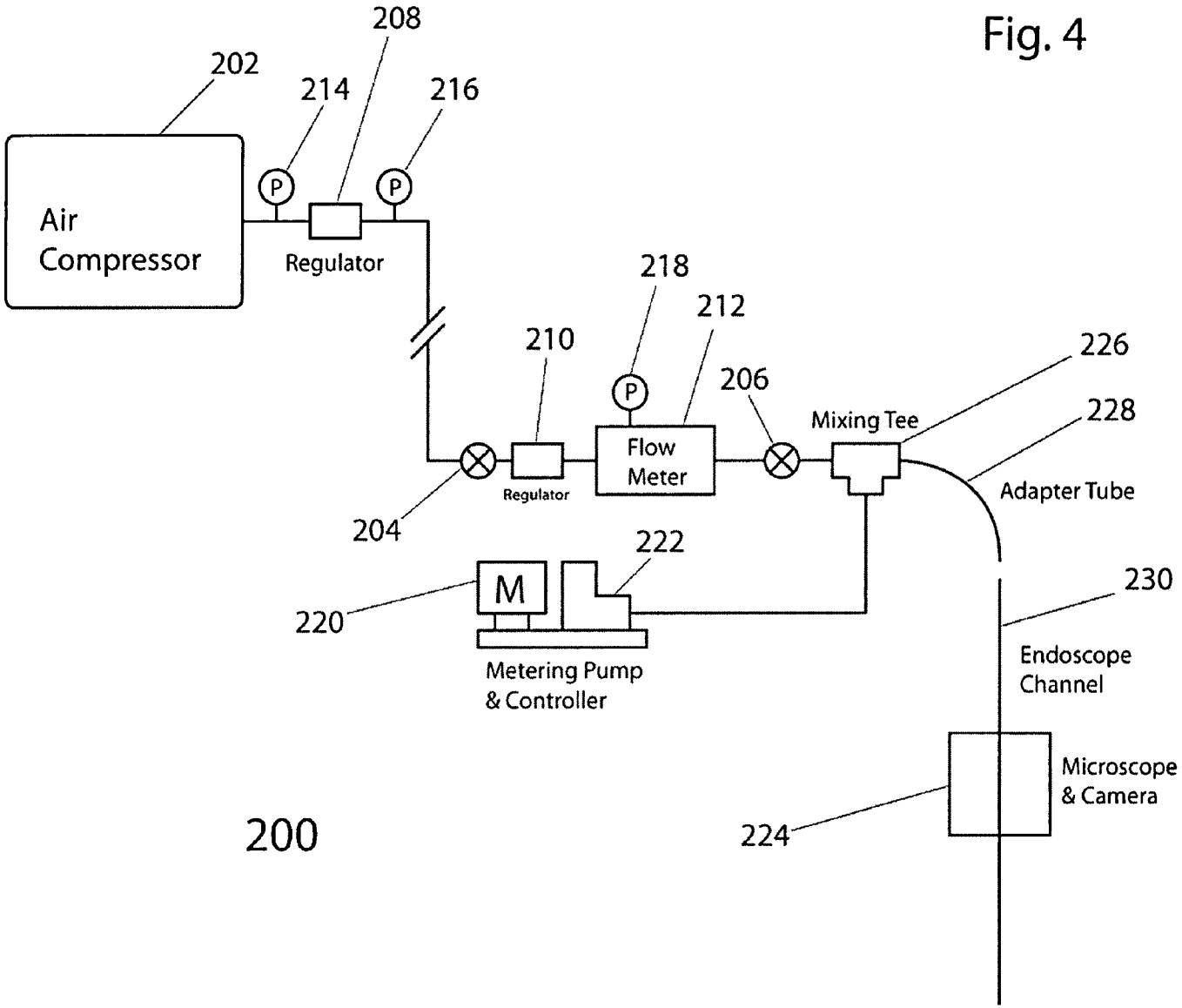
FIG. 4 is an apparatus used in the method of mapping flow regime discussed in Example 1.

Apparatus: The apparatus 200 illustrated schematically in FIG. 4 allows optical examination of transparent endoscope channels, to control the flow conditions used in the test and to measure all operating parameters both under static and dynamic conditions. The apparatus 200 consists of a source of compressed air 202 (Craftsman 6 HP, 150 psi, 8.6 SCFM @ 40 psi, 6.4 SCFM @ 90 psi, 120V/15 amp), various connectors and valves 204, 106, pressure regulators 208, 210 a flow meter 212, pressure gauges 214, 216, 218, a metering pump 220 (Fluid Metering Inc., Model QV-0, 0-144 ml/min), metering pump controller 222 (Fluid Metering Inc., Stroke Rate Controller, Model V200), various stands and clamps (not shown), various tube adapters (not shown), an imaging system 224 which includes a microscope, digital camera, flash, and various illumination sources (not individually shown in FIG. 3 but identified below).

The compressed air source is a 6-HP (30-gallon tank) Craftsman air compressor 202. The compressor 202 has two pressure gauges, one for tank pressure 214 and one for regulated line pressure 216. The maximum tank pressure is 150 psi. The compressor 202 actuates when the tank pressure reaches 110 psi. The line pressure is regulated to 60 psi for the majority of the tests, with the only exceptions being the high pressure test (80 psi) used to define the hydrodynamic mode for the 0.6-mm (ID) "elevator-wire channel". The regulated compressed air is supplied to a second regulator via 15' of ⅜" reinforced PVC tubing. The second regulator is used to regulate the pressure for each test. The air then feeds into a 0-10 SCFM Hedland flowmeter 212 with an attached pressure gauge 218. This gauge 218 is used to set the test pressure via the second regulator 210 that precedes it, as well as to read the dynamic pressure during the experiment. The flow meter 212 feeds into a "mixing" tee 226, where liquid is metered into the air stream via a FMI "Q" metering pump 220. The metering pump 220 is controlled by a FMI pump controller 222. The outlet of the mixing tee 226 is where adapters 228 for varying model endoscope tube diameters 230 are connected.

To acquire an image of the flow mode inside the channel, we used a Bausch and Lomb Stereozoom-7 microscope (1×-7×), a camera to microscope T-mount adapter, a Canon 40D digital SLR camera, and a Canon 580EX speedlite. The camera to microscope adapter's T-mount end is bayoneted to the camera and the opposite end is inserted in place of one of the eyepieces on the binocular microscope. The flash is attached to the camera via a hot shoe off camera flash cable and directed into a mirror/light diffuser mounted below the microscope stage. The mirror/diffuser is a two sided disc with a mirror on one side and a soft white diffuser on the opposing side. This can be rotated to change the angle of the light that is directed towards the stage as well as to switch between the two sides. The microscope also has an open porthole on the rear-bottom that allows for light to be directed onto the mirror/diffuser. A Bausch and Lomb light (Catalog # 31-35-30) is inserted into this porthole and used in conjunction with the Canon 40D's live view feature for live viewing as well as for focusing. The live view feature shows a real time image on the 3" LCD screen on the back of the camera. The channel to be photographed is placed on the microscope stage and taped into place. Photographs were taken with an exposure time of $1/250^{th}$ of second with the flash on full power using an optional remote to reduce vibration. Certain tests required single shots while other tests required photographs to be taken in "burst mode." In burst mode the camera shoots 5 frames per second at equal intervals. The images are stored on a 2 GB compact flash card and transferred to a PC via a multi-slot card reader. Images are processed (for clarity) in Adobe CS3 and analyzed one by one with the naked eye either on a 22" LCD monitor or via color prints from a color laser printer. The latter was used to analyze and compute treatment number under different conditions.

Model Test: Teflon tubing (McMaster-Carr Company) with different internal diameters and lengths was used to create the flow regime maps. The gas pressure for these experiments was set at desired value from 0 to 80 psi at the second regulator. The liquid flow rate was varied from a low flow rate of about 3 mL·min to a high flow of about 120 mL/min, or higher if necessary. Images were taken at generally 5 positions measured from the inlet along the length of the each tube (generally around two meters in length): 1) 35-45 cm; 2) 65-75 cm; 3) 110-120 cm; 4) 143-165 cm; and 5) 190-210 cm near end of the tube. At each position, microphotographs were taken at a range of flow rates, from the low flow rates to the high flow rates with a total of 5 and 9 flow rate steps in each test. 20-30 photographs were taken for each position for analysis.

Image Analysis and Map Construction: The image analysis consisted of examination of all microphotographs from each combination of flow rates and channel positions to determine the prevailing surface flow entities and hydrodynamic mode. The surface flow entities of interest included rivulets (straight and meandering), droplets (random), linear droplet arrays (LDA), sub-rivulets, sub-rivulets "fingering" off of the main rivulet, sub-rivulet fragments, turbulent/foamy rivulets, liquid films, foam, and all transition points between these features. These liquid features were used to describe various modes of flow (flow regimes) and these modes were then put into a "map" which shows the prevailing modes of flow as a function of distance from tube inlet at different liquid flow rates, at the selected air pressure. Qualitative features were used to define the flow regimes observed and quantitative analyses of images were used to compute the Treatment Number.

Descriptions of liquid features and hydrodynamic modes used in mapping flow regimes: The following descriptive definitions are used to classify individual surface flow entities which are observed when a liquid is introduced into channel as a rivulet stream and gas is simultaneously allowed to flow under pressure in the tube. These terms provide a consistent definition of flow elements for the classification of flow regimes defined below.

1. Rivulet: A continuous stream of liquid normally covering the entire length of tube and usually more prevalent near the inlet sections of the tube. Rivulets, depending on their velocity, liquid composition, and tube surface micro-roughness can either be perfectly straight or "kinked." In both cases the rivulet could be "stuck" (no meandering) or could meander ("meandering rivulets") about the tube surface reaching sides or ceiling of the tube due to transversal movement.

2. Droplets: Single beads of liquid that can either be static or moving along the surface of tubing and are not connected to any other feature. These droplets can range from 5 microns to 50 microns. Droplets can be distributed at random, or exist as linear array split from trailing end of rivulet fragments.

3. Sub-rivulets: Cylindrical bodies in the form of long continuous liquid threads that break off of or finger from the main rivulet. They are generally much thinner in comparison to the main rivulet. Dimensions of subrivulets depend on the flow conditions and liquid composition and can range from 100 microns to 300 microns.

4. Sub-rivulet fragments: When sub-rivulets break apart they produce rivulet fragments. A sub-rivulet normally becomes unstable and splits into several equal rivulet fragments that form a linear rivulet fragment array (LRFA). Each fragment becomes tear shaped or pill shaped with an advancing and receding contact angle. The advancing contact angle is normally high (e.g., greater than 60 degrees) while the receding contact angle at the trailing edge of the liquid feature is much lower (e.g., less than 50 degrees). Droplets normally split from the trailing end of a rivulet fragment. These droplets frequently form linear droplet arrays (LDA).

5. Liner droplet arrays (LDA): Long arrays of small (20 microns to 200 microns) droplets deposited on the tube surface, normally formed from the trailing end of a sub-rivulet fragment.

6. Turbulent/foamy rivulet: The main rivulet often reforms near the end of tube in a more chaotic and less structured fashion, and often includes discrete dispersed air bubbles and foam (multiple dispersed air bubbles in close proximity). This rivulet does not tend to meander as much as the main rivulet in the early sections of the tube near the inlet. This foamy mode normally leads to formation of a thick liquid film that covers the entire cross-section of tube depending of the surfactant or surfactant mixture used.

7. Film: A complete annular liquid film covering the entire tube or tube section, normally without traces of air bubbles or foam.

8. Foam: A prevalence of air bubbles dispersed in the liquid phase normally present in the entire tube cross section.

The term "fragments" is used to encompass all surface flow entities that are derived from the initial rivulet and include: droplets, sub-rivulets and sub-rivulet fragments (collectively cylindrical bodies) and linear droplet arrays (LDA)

Figure 5:
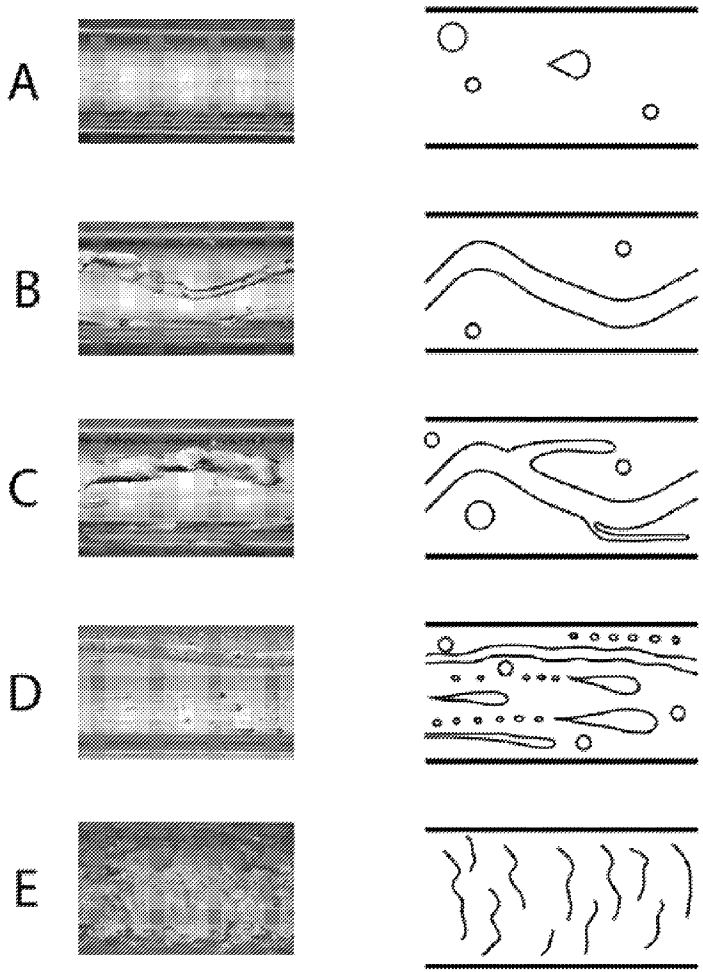
FIG. 5 are representative photographs and stylized drawings of different flow regimes discussed in Example 1.

Generalized Flow Regimes: The following qualitative descriptions are used to qualitatively classify the predominant flow regimes or "modes of flow" that are observed during the experiment. Their typical appearance is given in the photographs and corresponding schematic drawings in FIG. 5A.

Sparse/Dry (FIG. 5A): A mode of flow generally observed when the liquid flow rate is very low. The main rivulet is skinny and tends to be broken (not continuous). There are some stray sub-rivulet fragments and random droplets, but these features are few and far between.

Single Rivulet (FIG. 5B): When the liquid flow rate reaches a critical level the main rivulet forms and is continuous. The main rivulet can be straight or kinked, can be stationary or meandering depending on the gas velocity. The rivulet thickens with flow rate and does not break apart. Other features are absent in this flow mode because all of the liquid is contained in the rivulet.

Ejection Zone (FIG. 5C): When a high enough gas velocity (further distance from the tube inlet or higher pressure) and/or liquid flow rate is achieved, the sub-rivulets begin becomes instable and eject or split from the main rivulet. This mode also contains a few sub-rivulet fragments and random droplets.

Rivulet-Droplet-Flow (FIG. 5D): Main rivulet may or may not be present. Sub-rivulets, sub-rivulet fragments and droplets prevails. Sub-rivulet fragments leave linear droplet arrays. Random droplets are also present.

Film/Foam (FIG. 5E): Complete coverage of the tube with either a film and/or foam.

Example 2

Flow Regime Map for 2.8 mmm Channel

In this example the methods and apparatus of Example 1 were used to construct the flow regime map for a tube with 2.8 mm ID and 2 meter length. The following operating condition were employed: air pressure (30 psi), air flow rate (about 5.0 SCFM), air temperature (21 C—ambient), liquid temperature (21 C—ambient). The cleaning liquid included SURFYNOL® 485 and AO-455 (Composition 10A in Table 5). The liquid flow rates ranges from 0 ml/min to 29 m/min with 7 flow rate steps in between for a total of nine flow rates. In this example the positions for photographs were 45 cm, 73 cm, 112 cm, 146 cm, and 196 cm. Microphotographs were collected at each position and each liquid flow rate, and then analyzed to construct the flow regime map given in FIG. 6 according to Example 1. The following flow modes were observed at each position along the tube (distance from inlet) as a function of liquid flow rate and position along the tube.

At the 45-cm point, the flow mode is sparse/dry up to about 6.5 mL/min at which point it transitions to the single rivulet flow mode which continues with increasing liquid flow rate up to 29 mL/min. At this position, the gas velocity is low near the entrance of the tube and insufficient to produce rivulet instability or fragmentation. The rivulet that forms at this position which appears above 6.5 mL/min liquid flow rate exhibits some meandering due to hydrodynamic instability.

At the 73-cm point, the flow mode is sparse/dry up to 5 mL/min flow rate. As the liquid flow rate increases, the flow mode transitions into the single rivulet mode. The single rivulet flow mode continues up to about 18 mL/min at which point it transitions into an ejection zone mode where sub-rivulets split from the main liquid rivulets. The ejection zone continues up until 29 mL/min. The ejection zone mode appears to arise due to further instability of the liquid on the tube wall which leads to splitting of sub-rivulets from the main rivulet. The main rivulet tends to meander due to transversal movements.

At the 112-cm point, the flow mode is sparse/dry up to about 4.0 mL/min flow rate at which point the flow mode transitions to the single rivulet flow. The single rivulet flow continues up to about 17 mL/min at which point it transitions into an ejection zone. The ejection zone continues up to 23 mL/min at which point it transitions to a film/foam mode. The film/foam mode continues up to 29 mL/min.

At the 146-cm point, the flow mode is sparse/dry up to about 3 mL/min at which point the flow mode transitions to single rivulet flow. The single rivulet flow mode continues up to 12 mL/min at which point it transitions into rivulet-droplet flow (RDF) with various fragments and surface flow entities observed. The RDF mode continues up to 22 mL/min at which point it transitions to the film/foam mode. The film/foam mode continues up to 29 ml/min.

At the 196-cm point, the flow mode is sparse/dry up to 2 mL/min at which point the flow mode transitions to the single rivulet flow mode. The single rivulet flow mode continues up to 12.5 mL/min at which point it transitions into the RDF mode. The RDF mode continues up to 21 mL/min at which point it transitions to the film/foam mode. The film/foam mode continues up to 29 mL/min.

Figure 6:
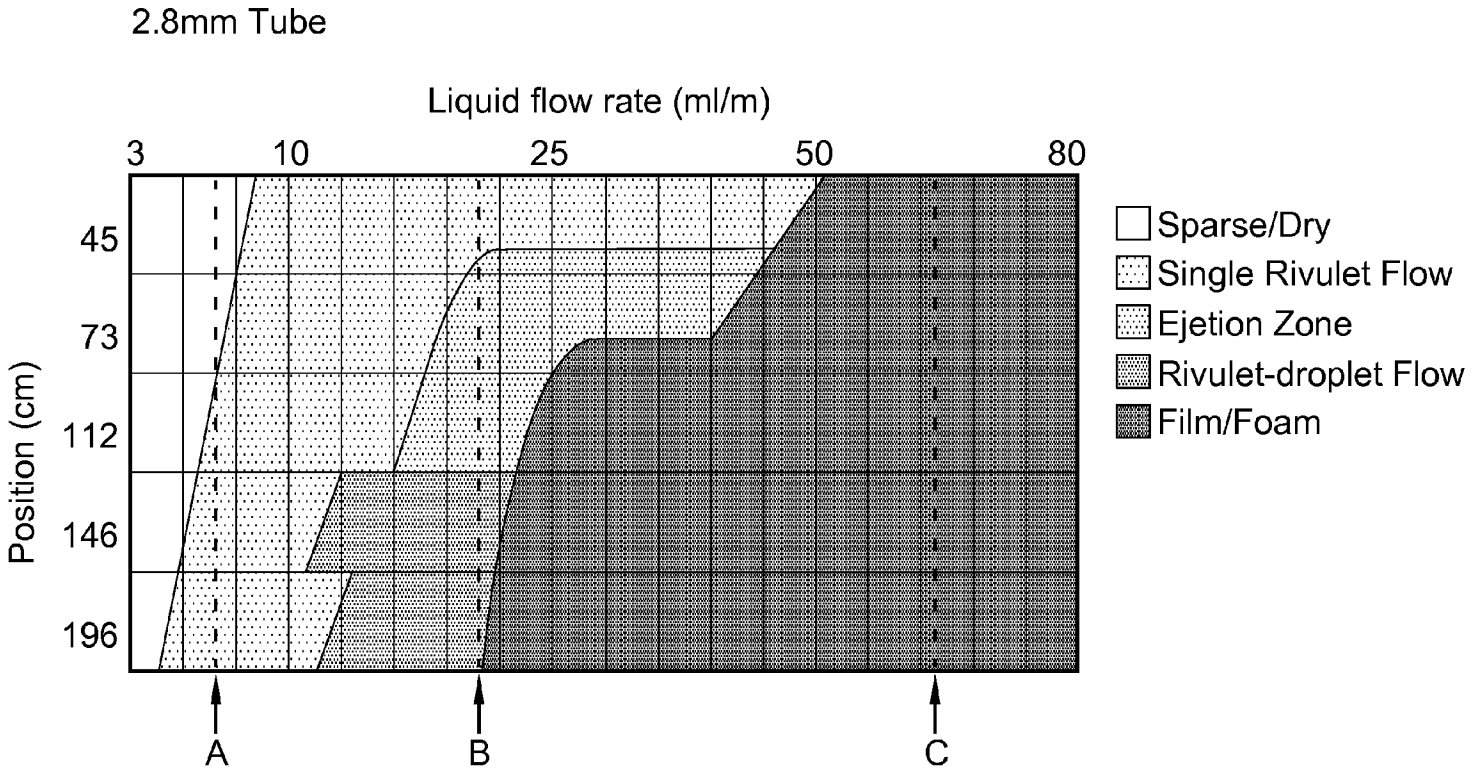
FIG. 6 is a flow regime map for a 2.8 mm inside diameter (ID) tube discussed in Example 2.

The above data is plotted as a flow regime map as a function of the position along tube length from inlet (0 cm) to outlet (200 cm) and the liquid flow rate at a constant air pressure in FIG. 6. The map provides a convenient representation of defines the different flow modes observed at each position along the tube length at the different liquid flow rates. The region within the map that provides optimal RDF flow can thus be identified and the controlling parameters selected (e.g., liquid flow rate at a particular gas pressure.

In the case of the 2.8 mm ID tube, liquid flow rates between about 16 to about 22 mL/min appear to provide liquid flow features that would effect high level cleaning over most of tube length. For illustration, the 19 mL/min liquid flow rate the spars/dry mode is minimized (limited to only short section near entrance) while both the ejection and RDF mode cover most of the tube length without formation of film or foam near the exit of the tube. At very low liquid flow rates (0 to 10 mL/min), flow modes are characterized by spars/dry mode and single rivulet mode; under such conditions the entire surface of the tube cannot be adequately cleaning due to the small amount of surface flow entities and to the low Treatment Number in this case. Treatment time needs to be extended in this case and this becomes impractical in cleaning endoscopes and other medical devices. On the other hand, at very high liquid flow rates, most of the tube length will be dominated by film and foam which result in covering the contaminants with a liquid film, a condition that does not produce high-level cleaning. It should thus be appreciated that cleaning according this method with a single liquid flow rate might not cover the entire length of the tube if cleaning time is short, and that using more than one liquid flow rate or utilizing alternative flow regimes, e.g., DPF or DPDF regimes, to create surface flow entities with moving three phase contact lines may be required. This can be achieved by utilizing alternating liquid plug and gas flow for a part or all of the cleaning cycle. Using other surfactant mixtures may also produce other flow maps under the same conditions depending of the nature of surfactants.

The methods of Example 1 and analysis procedure Example 2 were employed in Examples 3-7 to construct flow regime maps for tubes of different diameters

Example 3

Flow Regime Map for 1.8-mm Tube

Figure 7:
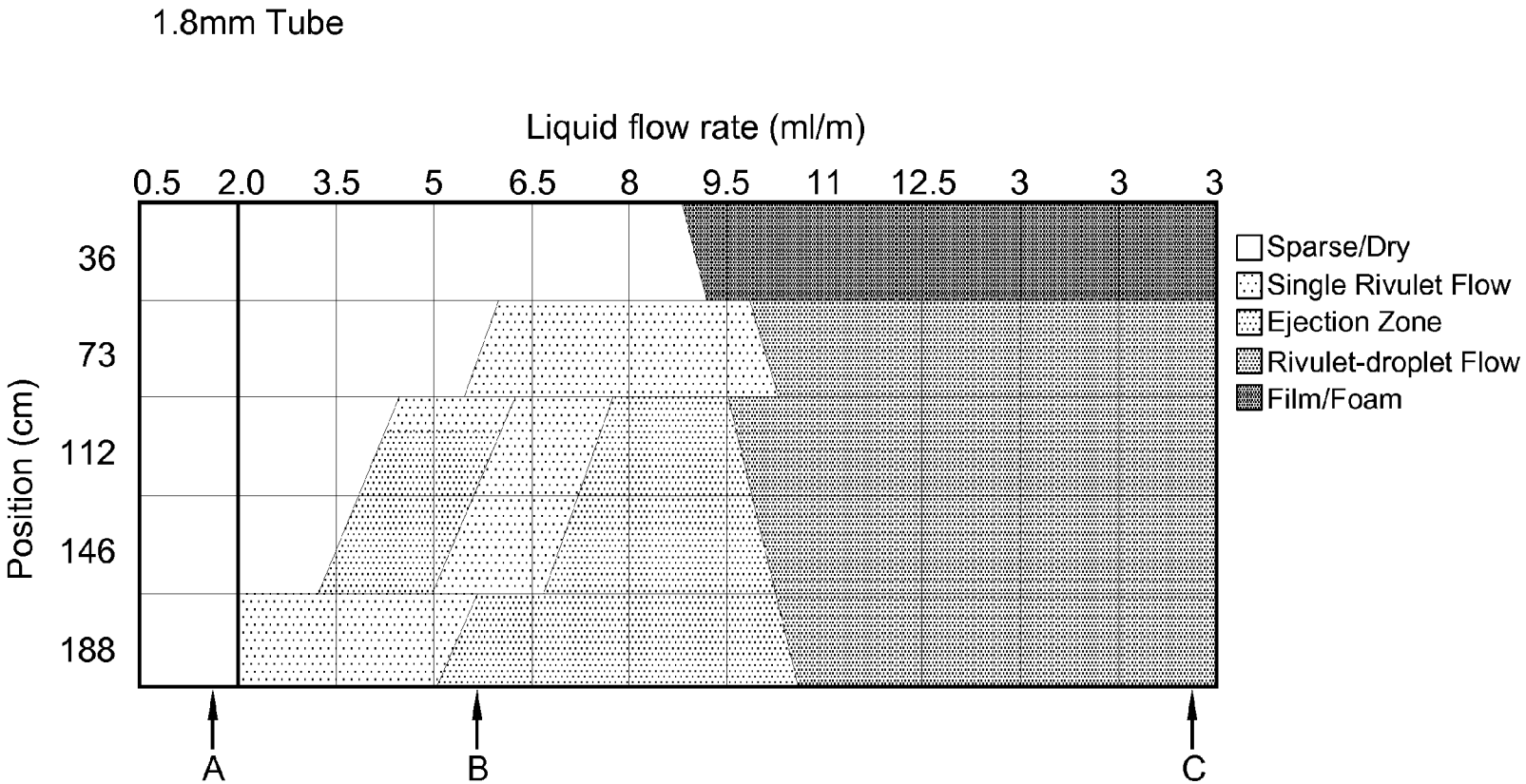
FIG. 7 is a flow regime map for a 1.8 mm ID tube discussed in Example 3 and used in Example 13.

The conditions used were: air pressure (30 psi); air flow rate (about 3.0 SCFM); air temperature (ambient @21C); liquid temperature (ambient @ 21 C). The test cleaning liquid included Surfynol 485 (0.036%) and AO-455 (0.024%). In this example the liquid flow rates range was from 3.5 mL/min to 12.5 mL/min with 5 flow rate steps in between for a total of seven flow rates. The positions examined with photographs were: 36-cm, 73-cm, 112-cm, 146-cm, and 188-cm, all measured from tube inlet (0-cm). The map for the 1.8-mm tube found for the above conditions is shown in FIG. 7.

The flow maps for the 1.8-mm (FIG. 6) and the 2.8-mm channels (FIG. 7) are clearly different. The RDF and ejection zones are shifted observed in the 1.8 mm tube are shifted to lower liquid flow rates relative to the 2.8 mm tube and cover a greater fraction of the tube length.

The 1.8 mm tube is important since it represents the dimension of the air, water and auxiliary channels in many flexible endoscopes. The flow mode map (FIG. 7) indicates that liquid flow rates between 6.0 to 9.0 mL/min appears to provide an acceptable range to achieve high-level cleaning at 30 psi air pressure according to the methods of this invention). In this liquid range, rivulets, subrivulets and fragmentation can be created on most of the tube surface. High liquid flow rates with this surfactant mixture (Composition 10A in Table 5) lead to film/foam flow mode which prevents the formation of surface flow entities that produce high detachment force.

Example 4

Flow Regime Map for 4.5 mm Tube

Figure 8:
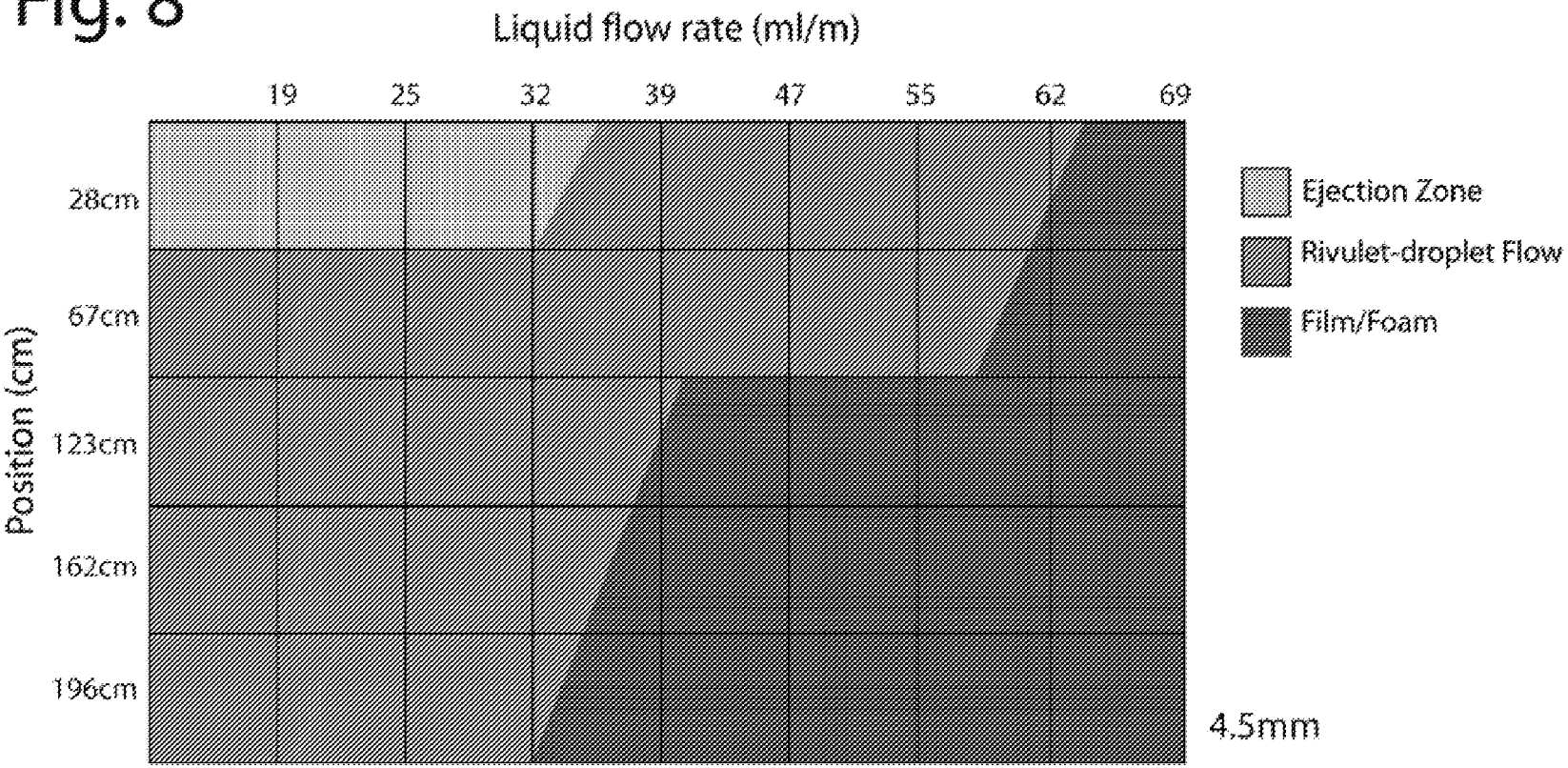
FIG. 8 is a flow regime map for a 4.5 mm ID tube discussed in Example 4 and used in Example 13.

The test conditions were: air pressure (30 psi); air flow rate (about 6.0 SCFM); air temperature (ambient @ 21 C); liquid temperature (ambient @21 C). The cleaning liquid was the same as in Examples 2 and 3. The liquid flow rates ranged from 13 mL/min to 69 mL/min with 7 flow rate steps in between for a total of nine flow rates. The positions along the tube used for microphotographs were: 28-cm, 67-cm, 123-cm, 162-cm, and 196-cm. The map for the 4.5 mm tube found for the above conditions is shown in FIG. 8 and significantly differs from the narrower diameter tubes described in Example 2-3.

At the 28-cm point the 4.5 mm tube is in the ejection mode from the start and transitions into RDF at 33mL/m. The RDF mode continues until 62 mL/m at which point it transitions into the film/foam mode. At the 67-cm point the 4.5 mm tube is in RDF until 60 mL/m at which point it transitions into the film/foam mode. At the 123-cm point the 4.5 mm tube is in RDF until 39 ml/m at which point it transitions into the film/foam mode. At the 162-cm point the 4.5 mm tube is in the RDF mode until 35 mL/min at which point it transitions into the film/foam flow. At the 196-cm point the 4.5 mm tube is in RDF until 33 ml/m at which point it transitions into the film/foam mode. Due to the larger diameter tube the gas velocities in the 4.5 mm tube are much higher and ejection occurs earlier in the tube (closer to the entrance) and the RDF mode surface flow entities is sustained over a larger portion of the tube and over a larger range of flow rates. In the 4.5 mm tube still lower flow rates are lead to the sparse/dry flow mode.

Example 5

Flow Regime Map for 6.0 mm Tube

The test conditions were: air pressure (30 psi); air flow rate (about 8.0 SCFM); air temperature ambient @ 21° C.; cleaning solution temperature ambient temperature @21° C. The test cleaning liquid in this example was the same as in Example 1. The flow rates ranges from 25 ml/min to 85 ml/min with 7 flow rate steps in between for a total of nine flow rates. The positions for photographs were: 23-cm, 56-cm, 118-cm, 163-cm, and 196-cm. The map for the 6 mm tube found for the above conditions is shown in FIG. 9 is qualitatively similar to the map for the 4.5 mm ID tube but differs significantly from those of the narrower diameter tubes described in Example 2-3).

At the 23-cm point, the single-rivulet flow mode is observed until about 32 mL/min at which point it transitions to the ejection flow mode. This mode continues up until about 62 mL/min at which point the flow transitions into the RDF mode. At the 56-cm point, the single-rivulet flow is observed up until 32 mL/min at which point it transitions into the RDF flow mode. The RDF mode is observed until about 80 ml/min at which point it shifts to the film/foam mode. At the 118-cm point, the single-rivulet flow is observed up until about 32 mL/min at which point it transitions into the RDF flow. The RDF mode is observed until about 65 ml/min at which point it shifts to the film/foam mode. At the 163-cm, single-rivulet flow mode is observed up until about 32 mL/min at which point it transitions into mixed the RDF mode. The RDF mode is observed until 62 mL/min at which point it shifts to the film/foam mode. At the 196-cm point, the RDF mode is observed until 65 mL/m at which point it shifts to the film/foam mode. This map closely resembles the 4.5-mm tube map (FIG. 8). However, due to the high air flow rate obtained under these above conditions, the RDF mode can be achieved at most of the tube length, except at a short segment near the entrance of the tube.

Figure 9:
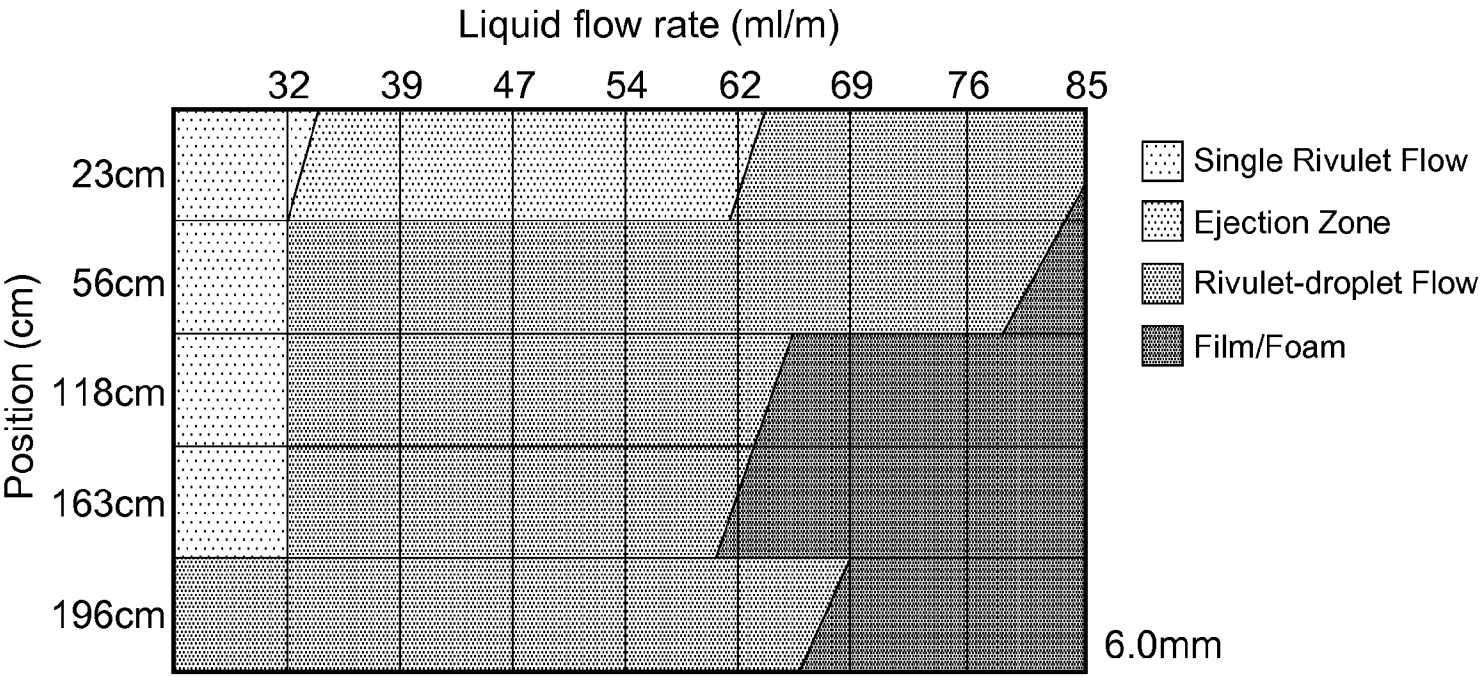
FIG. 9 is a flow regime map for a 6.0 mm ID tube discussed in Example 5.

Comparison of FIGS. 6-7 with FIGS. 8-9 indicates that it is easier to achieve optimal zones of RDF flow over most of tube length with larger diameter 4.5 mm and 6 mm tubes.

Example 6

Flow Regime Map for the 0.6 mm Tube @ 30 psi Air Pressure

Figure 10:
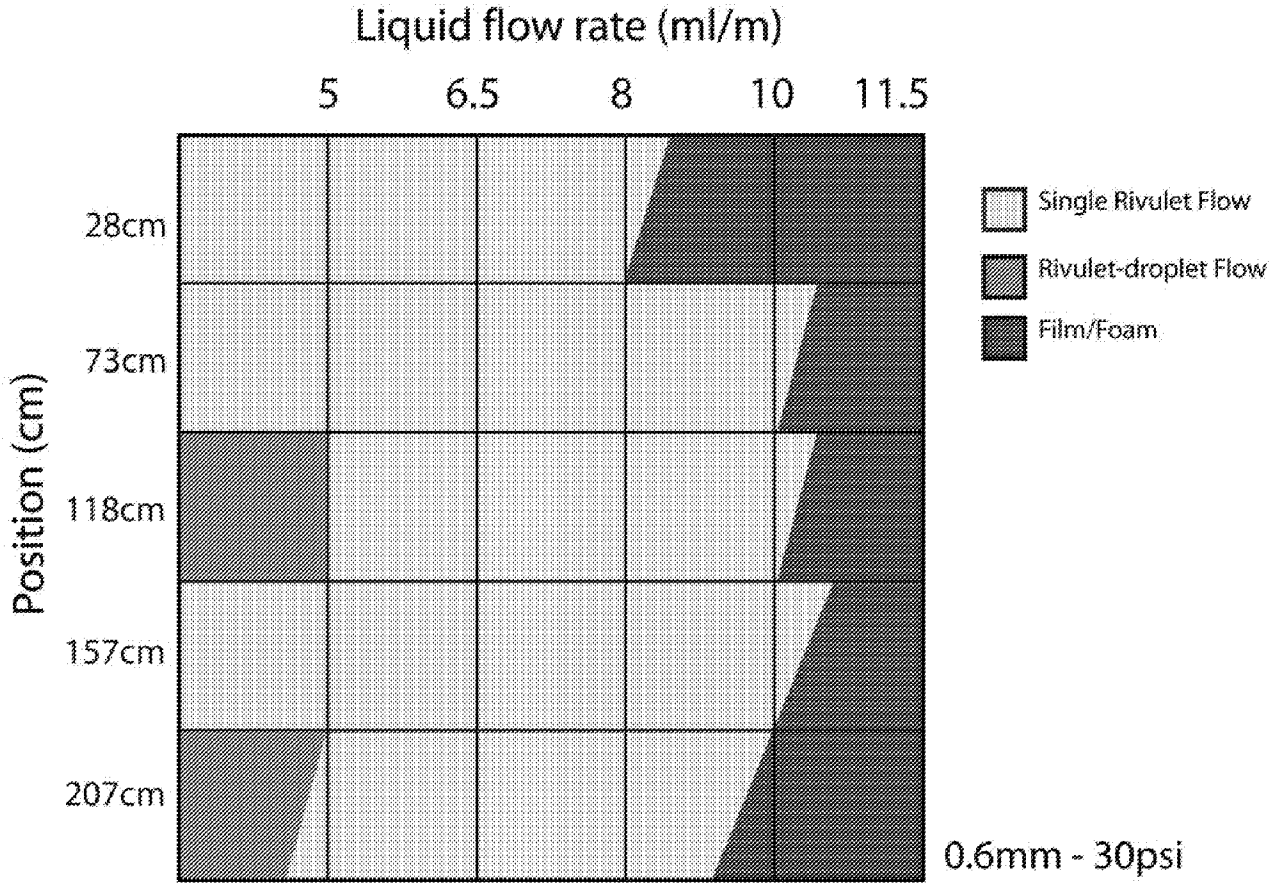
FIG. 10 is a flow regime map for a 0.6 mm ID tube determined at a gas pressure of 30 psi discussed in Example 6.

The test conditions were: air pressure (30 psi); air flow rate (about 0.1 SCFM); air and cleaning solution temperature (ambient @ 21° C.). The cleaning liquid was the same as in Example 1. The liquid flow rates ranged from 3 mL/min to 11.5 mL/min with 4 flow rate steps in between for a total of six flow rates. The positions for photographs were: 28-cm, 73-cm, 118-cm, 157-cm, and 207-cm. The flow map is shown in FIG. 10.

At the 28-cm point, the single-rivulet mode is observed which continues up to 8.5 mL/min liquid flow rate at which point it transitions to the film/foam mode. At the 73-cm point, the flow mode is single rivulet which continues up to 10.5 mL/min. At higher flow rates it transitions to the film/foam mode. At the 118-cm point, the flow mode is RDF up to 5 mL/min at which point the flow mode transitions to the single rivulet mode. This continues up to 10.5 mL/min at which point it transitions to the film/foam mode. At the 157-cm point, the flow mode is a single-rivulet flow. This continues up to 10.5 mL/min at which point it transitions to the film/foam mode. At the 207-cm point, the flow mode is RDF up to 5 mL/min at which point the flow mode transitions to a single rivulet mode. This continues up to 9.5 mL/min at which point it transitions to the film/foam flow mode.

According to this flow mode map, the RDF mode is only occasionally encountered and is not generally accessible under the above conditions. This is due the high hydrodynamic resistance of this narrow diameter tubing. The air velocity is insufficient to induce instabilities leading to formation of liquid fragments. Cleaning with rivulet flow under these conditions is due solely to the meandering of the single-rivulet flow due to transversal movement. To achieve optimal RDF flow a higher pressures and liquid and gas flow velocities are required as is shown in Example 7 below which was carried out at a gas pressure of 80 psi.

Example 7

Flow Regime Map for the 0.6 mm Tube @ 80 psi Air Pressure

Figure 11:
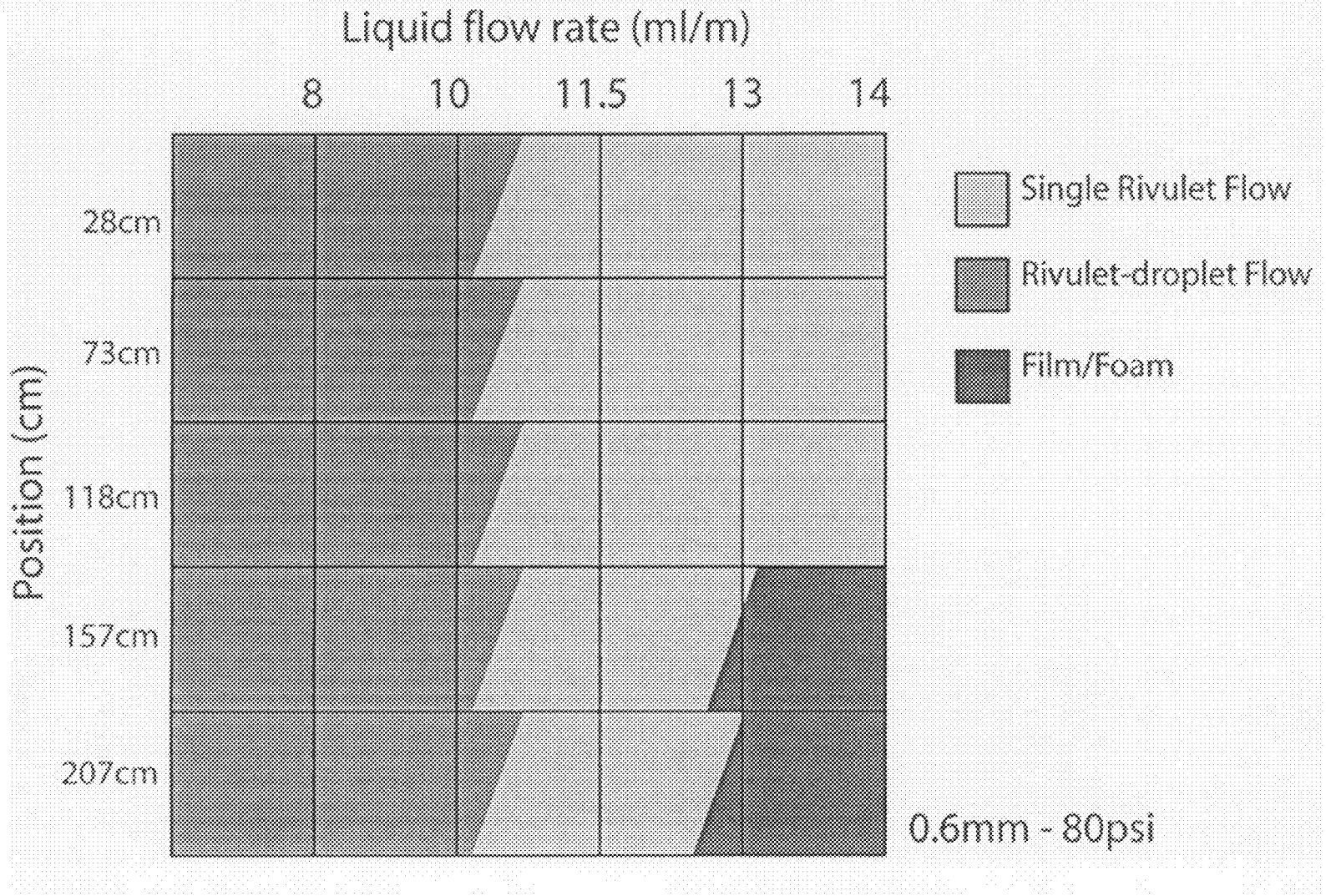
FIG. 11 is a flow regime map for a 0.6 mm ID tube determined at a gas pressure of 80 psi discussed in Example 7.

The operating conditions were the same as in Example 6 but the air pressure was controlled at 80 psi which is the maximum rated pressure for this very small diameter endoscope channel (elevator-wire channel). The results are given in FIG. 11.

At the 28-cm to 207 cm (i.e., over the entire length of the tube) the flow mode was RDF which continues up to about 10.5 mL/min at which point it transitions to the single rivulet mode. The results of this example demonstrate that using higher air pressure and air velocity results in the formation of the RDF even in the 0.6 mm channel which is favorable for cleaning. This example is important since these dimensions are similar to the elevator-wire channels of flexible endoscopes.

Example 2-7 demonstrates that the operating conditions in terms of flow rates and gas pressure required to generate optimal RDF flow regimes for cleaning by rivulet flow depend strongly on the diameter of the tubing employed and is different for different diameters. Since there is not a single universal set of parameters for all channel diameters, optimal cleaning of multi-channel devices such as endoscopes requires that the conditions employed for each channel be optimized to produce the optimal flow mode, e.g., RDF in the case of rivulet flow.

Example 8

Examples of Liquid Cleaning Media Containing Single Surfactant

Liquid compositions containing single surfactants were prepared and tested by the flow mapping technique of Example 1 and flow regime maps constructed for endoscope tubes of different diameters (ID 0.6 mm to 6.0 mm) as described in Examples 2-7. The compositions are summarized in Table 3. The air pressure range used in the evaluations was between 10 to 30 psi and in other cases above 30 psi. The liquid flow rates used in the evaluations were in the range defined by flow regime/mode maps similar to those given in Examples 2-7.

The surfactants belong to Class III as described above. The results from all the experiments are summarized by an overall RDF rating and an overall organic soil cleaning rating. All the surfactants provided cleaning media that formed the RDF flow regime in all the different channels and provided soil removal. However, the effectiveness in soil removal varied somewhat. Organic soil removal was evaluated by the procedure described in Example 15.

TABLE 3

| Ingredient | Composition B | C | E | G | H | M |
|---|---|---|---|---|---|---|
| Water | 97.82 | 97.81 | 99.621 | 99.67 | 99.67 | 99.37 |
| SMS | 0.13 | 0.13 | 0.13 | 0.13 | 0.13 | 0.13 |
| STP | 2.000 | 2.000 | | | | |
| EDTA (39%) | | | 0.15 | 0.15 | 0.15 | 0.15 |
| AO-405 | | | 0.024 | | | |
| TERGITOL ® 1X | 0.050 | | | | | |
| PLURONIC ® L43 | | 0.060 | 0.050 | | | 0.050 |
| 31R1 | | | | 0.050 | | |
| L62D | | | | | 0.050 | 0.000 |
| L81 | | | 0.025 | | | |
| Accusol 505N | | | | | | 0.30 |
| RDF Rating | 3 | 3 | n/a | 3 | 3 | n/a |
| Organic Soil Cleaning | 4 | 2 | n/a | n/a | n/a | n/a |

Notes:
RDF Rating: 1 to 5 scale where 1 = worst, 5 = Best
Organic Soil Cleaning: 1 to 5 scale where 1 = worst, 5 = Best;
Rating was based on SEM acquired at 200X to 5000X magnification as in Example 18

Example 9

Comparative Examples of Liquid Cleaning Media Containing Unsuitable Surfactant

The comparative examples listed in Table 4 were prepared and tested by the identical procedure described in Example 8. However, the individual surfactants belonged to either Class I (formed wetting films) or class II (formed excessive foam).

Comparative C-P employs a hydrotrope (xylene sulfonate) SX-40 which does not provides surface tension less than 55 dynes/cm which appears to be insufficient to produce extensive fragmentation.

Comparatives C-Q and C-R were made with a castor-oil ethoxylate (15 EO), CO-15 and an acetylinic surfactant, SURFYNOL® 420 respectively both produced wetting films on the surface of endoscope channels. No rivulets or liquid fragmentation were observed with Compositions Q and R nor was the RDF regime observed.

Comparative C-S and C-T were made with an alcohol ethoxylated, TERGITOL® TMN-10 and sodium lauryl sulfate (SLS) respectively. These surfactants have a Ross-Miles foam height greater than 50 mm and produced the foam/film regime which covered most of the channel cross-section and length with wither foam (generally) of film at low flow rates. The RDF regime was not observed under the conditions employed. Foaming surfactants such as TMN-10 are not suitable for use in RDF cleaning of endoscope channels or other luminal devices.

TABLE 4

| Ingredients | Comparative Examples C-P | C-Q | C-R | C-S | C-T |
|---|---|---|---|---|---|
| Water | 97.77 | 97.82 | 97.82 | 97.82 | 97.77 |
| SMS | 0.13 | 0.13 | 0.13 | 0.13 | 0.13 |
| STP | 2.00 | 2.00 | 2.00 | 2.00 | 2.00 |
| SX-40 | 0.10 | | | | |
| CO-15 | | 0.050 | | | |
| Surfynol 420 | | | 0.050 | | |
| TMN-10 | | | | 0.050 | |
| SDS/SLS | | | | | 0.10 |
| RDF Rating | 2 | 1 | 1 | 2 | 1 |
| Organic Soil Cleaning | 1 | 2 | 2 | 3 | 3 |

Notes:
RDF Rating: 1 to 5 scale where 1 = worst, 5 = Best
Organic Soil Cleaning: 1 to 5 scale where 1 = worst, 5 = Best;
Rating was based on SEM acquired at 200X to 5000X magnification as in Example 18

Example 10

Examples of Liquid Cleaning Media Containing Surfactant Mixtures

The examples listed in Table 5 were prepared and tested by the identical procedure described in Examples 8 and 9. In contrast to the previous examples, the cleaning compositions contained a mixture of two surfactants: an acetylinic surfactant, SURFYNOL® 485 and an alkoxylated ether amine oxide, AO-455. All the compositions performed well and some provided very effective and robust RDF flow regimes.

TABLE 6

| Ingredients | Examples 10A | 10B | 10C | 10E | 10F | 10G | 10H | 10I | 10J |
|---|---|---|---|---|---|---|---|---|---|
| Water | 97.80 | 97.79 | 99.63 | 97.51 | 97.510 | 97.510 | 97.510 | 99.360 | 97.38 |
| SMS | 0.13 | 0.130 | 0.130 | 0.130 | 0.130 | 0.130 | 0.130 | 0.130 | 0.13 |
| STP | 2.00 | 2.00 | | 1.00 | 1.00 | 1.00 | 1.00 | | 2.00 |
| TSPP | | | | 1.00 | 1.00 | 1.00 | 1.00 | | |
| EDTA (39%) | | | 0.150 | | | | | 0.150 | |
| SURFYNOL ® 485 | 0.036 | 0.036 | 0.036 | 0.036 | 0.036 | 0.036 | 0.036 | 0.036 | 0.036 |
| AO-455 | 0.024 | 0.024 | 0.024 | 0.024 | 0.024 | 0.024 | 0.024 | 0.024 | 0.024 |
| L61 | | | 0.025 | | | | | | 0.025 |
| L81 | | 0.024 | | | | | | | |

TABLE 6-continued

| Ingredients | Examples | | | | | | | | |
|---|---|---|---|---|---|---|---|---|---|
| | 10A | 10B | 10C | 10E | 10F | 10G | 10H | 10I | 10J |
| CP5 | | | | 0.30 | | | | | |
| Accusol 455 N | | | | | 0.30 | | | | |
| Accusol 460N | | | | | | 0.30 | | | |
| Accusol 505N | | | | | | | 0.30 | 0.30 | |
| SX-40 | | | | | | | | | 0.40 |
| RDF Rating | 4 | n/a | 3 | n/a | n/a | n/a | n/a | 4 | n/a |
| Organic Soil Cleaning | 3 | n/a | n/a | n/a | n/a | n/a | n/a | n/a | n/a |

Notes:
RDF Rating: 1 to 5 scale where 1 = worst, 5 = Best
Organic Soil Cleaning: 1 to 5 scale where 1 = worst, 5 = Best;
Rating was based on SEM acquired at 200X to 5000X magnification as in Example 18

Example 11

Cleaning Performance Determined by Radionulcide Method (RNM)

This example compare the cleaning of endoscope channels with one phase liquid flow and with RDF mode with the cleaning effectiveness assessed by the Radionulcide Method (RNM). RNM provides direct quantification of contaminants in the channels by counting the Gamma quanta/second/endoscope using a special Gamma camera (Picker, U.S.A.). This method does not require recovery of residual contamination from the endoscope, and thus provides accurate determination of cleaning level. Tc(99) in macroalbumen is mixed with the organic soil which is then used to contaminate endoscope channels by injecting the mixture from one of the endoscope ports. Different channels can be tested separately. Images showing the spatial distribution of contaminants before and after cleaning are also acquired for each test.

A PENTAX® endoscope (Models EG-2901) was tested to determine the effectiveness of liquid flow cleaning. 5 mL of Dry sheep blood was mixed with 5 mL saline solution followed by adding 100 uM protamine sulfate. The desired dose of Tc-99 in macroalbumen was thoroughly mixed with the above solution. 6.5 ml of the mixture was injected into the endoscope via the A/W port located at the umbilical end of the endoscope following the contamination method of Alfa et al., American Journal of Infection Control, 34 (9), 561-570 (2006). The endoscope was allowed to stand for at least one hour to allow blood clotting and adhesion to channel walls to take place. Gamma-camera images were acquired at the following points during the test: 1) right after contamination, 2) just before cleaning, 3) after each step of pre-cleaning, cleaning, rinsing and drying. At each point, the quanta/second/endoscope was measured to determine the effect of each segment of the cleaning cycle. Normal procedures were used to determine and subtract radioactivity level arising from accidental spillage on the external surface of endoscope or the holding tray.

Figure 12:
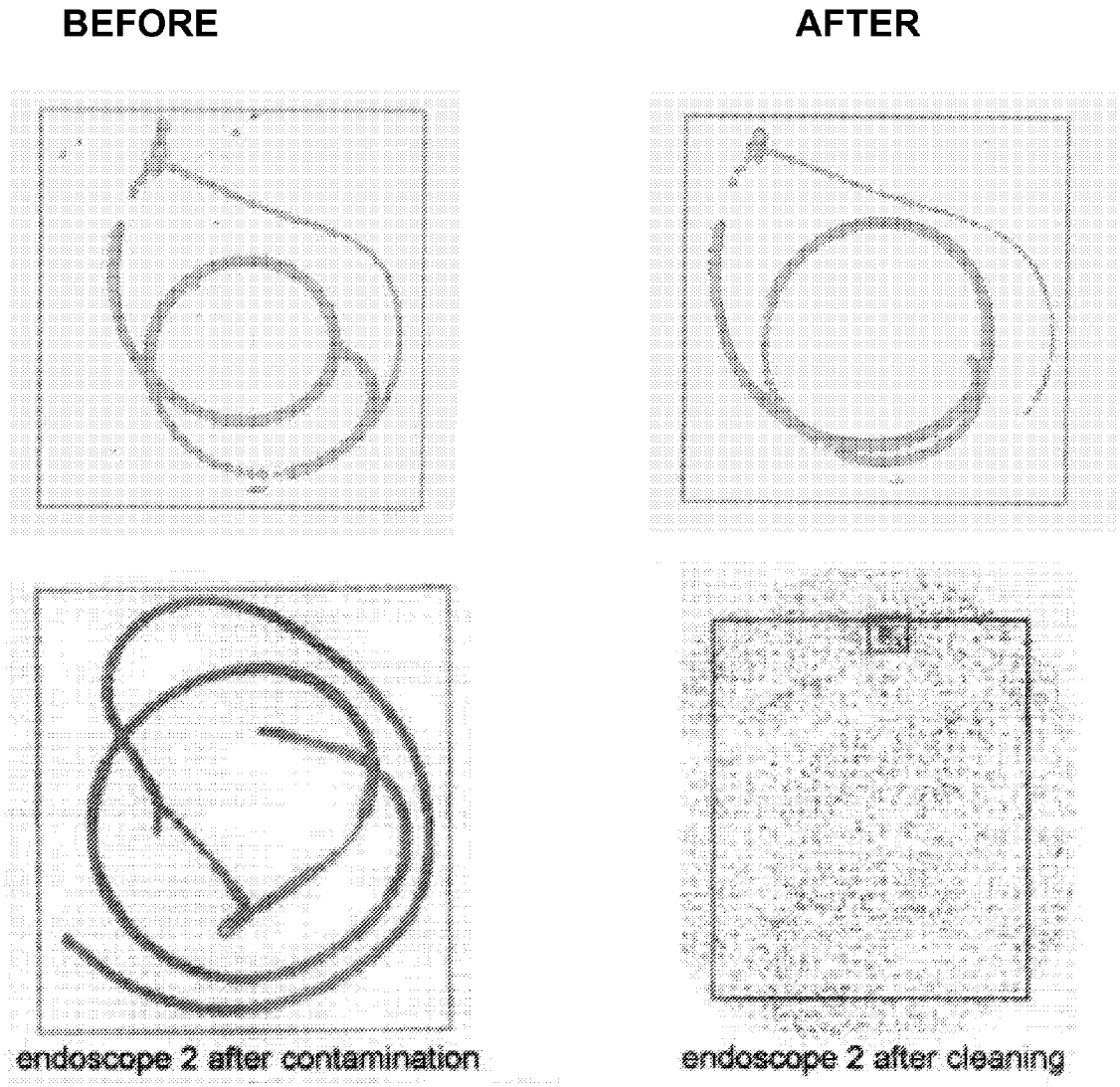
FIG. 12 are high-sensitivity radionuclide images comparing endoscopes cleaned by liquid flow (FIG. 11A) with cleaning using Rivulet Droplet Flow (FIG. 11B) as discussed in Example 8.

In this test, summarized in Table 6 under the column labeled "Comparative 11", the initial quanta/sec./endoscope (q/s/e) was 3407 after 5 minutes of liquid flow cleaning of the air/water channel (1.4 mm ID and about 350 cm in length) at a liquid flow rate of 7.5 mL/minute, the radioactivity decreased to 2603 q/s/e. After rinsing and drying, the radioactivity was further decreased to 1855 q/s/e. This example demonstrates that liquid flow cleaning does not effectively clean the A/W channel, as supported by the Gamma camera images given in FIG. 12.

The same PENTAX® endoscope as in the above comparative control was contaminated with dry sheep blood and soiled as described above. The initial count before cleaning was 1044 q/s/e. This was reduced to 321 q/s/e after an initial RDF pre-cleaning step. The residual soil level was further decreased to 59 q/s/e after RDF cleaning and rinsing. The flow was injected from the A/W cylinder at the control handle of endoscope. The experiment and results are described in Table 6 under the column headed "Example 11". The final residual radioactivity in the endoscope after cleaning with the RDF method was 59 q/s/e compared to 1855 q/s/e when cleaning was done by liquid flow (Comparative 11).

TABLE 6

| Steps | Comparative 11 | Example 11 |
|---|---|---|
| Initial | 3407 | 1044 |
| Pre-cleaning | 3440 | 321 |
| Liquid flow | 2603 | |
| Rivulet-droplet flow | | 327 |
| After rinsing and drying | 1855 | 59 |
| Rivulet-droplet flow advantage | | 262 |
| Pentax Endoscope Model | EG-2901 | EG-2901 |
| Soil (see footnote) | PB2 | PB2 |
| Air Pressure (psi) | 0 | 28 |
| Liquid flow rate (ml/min) | 75 | 15 |
| Pre-cleaning time (min) | 2.5 | 2.5 |
| Liquid flow time (min) | 2.5 | 0.0 |
| Rivulet-droplet flow cleaning time (min) | 0.0 | 2.5 |
| Two-phase rinsing time (min) | 3.0 | 3.0 |
| Drying time (min) | 2.0 | 2.0 |

Note:
PB2: 5.0 ml dry sheep blood, 5.0 ml saline, 100 μm potamine sulfate and radioactivity material that makes about 11.5 ml of soil.

Further studies have demonstrated that a significant portion of the residual radioactivity in Example 11 is due to one or more hot spots arising from contaminating port.

High-sensitivity images (FIG. 12) comparing endoscopes cleaned by liquid flow (FIG. 12A) and with cleaning using Rivulet Droplet Flow (FIG. 12B) demonstrate the highly effective cleaning of the surface of the channel by the method of the invention.

Example 12

RDF cleaning of Air/Water (A/W) Channel Soiled with Clotted Blood

In this series of tests, the soil was based on clotted fresh sheep blood whose formula is given under Table 7 below. Blood contamination of endoscopes is very common and is considered to be a tough soil to clean with liquid flow methods. 6.5 mL of the clotting mixture including Tc-99 isotope was injected into the A/W channel from the umbilical end of the endoscope. Six tests were made where cleaning was performed at 28 or 14 psi air and with liquid flow rate of 15 mL/min or 7.5 ml/min. These operating conditions were selected by the flow mapping method described above to give the RDF flow regime. The test cleaning composition included an alkaline surfactant solution based on 0.0.05% nonionic surface Tergitol (1x) at a pH of about 10.0. The cleaning solution and air were injected from the A/W cylinder located in the control handle of the endoscope (PENTAX® EG-3401).

The results of Test 1 to 6 summarized in Table 7 indicates that the RDF flow regime at air pressures 14-28 psi and liquid flow rates between 7 to 15 ml/min was able to decrease the radioactivity in the endoscope to levels that can be considered "clean" according to published reports (Schrimm et al., Zentr. Steril. 2 (5), 313-324 (1994). For a small hand-held medical device, if the residual radioactivity after cleaning is in the range of 6 quanta/second/device the device is considered "clean" and is presumed to be equivalent to about 10E6 ("6 log") reduction in the number of organisms. In the case of large endoscopes such as PENTAX® (EG-3401), the residual q/s/e were: 0, 6, 36, 41, 75 and 99 (Table 7). These levels indicate that the RDF method is effective in producing "clean" endoscopes since the endoscope is 10 times larger than the hand-held devices used in the published data. The RDF provided cleaning advantage estimated between 176 to 543 q/s/e compared to the level achieved after pre-cleaning step which is assumed to be equivalent to liquid flow only cleaning. The differences between the RDF cleaning advantage in the various tests is due to the different levels of initial contamination and other variable parameters used in the testing.

TABLE 7

| Steps | Test 1 | Test 2 | Test 3 | Test 4 | Test 5 | Test 6 |
|---|---|---|---|---|---|---|
| Initial | 2644 | 3957 | 2982 | 4524 | 5321 | 3115 |
| Pre-cleaning | 237 | 217 | 312 | 493 | 549 | 392 |
| After two-phase rinsing and drying | 0 | 41 | 36 | 99 | 6 | 75 |
| Rivulet-droplet flow advantage | 237 | 176 | 276 | 394 | 543 | 317 |
| Pentax Endoscope Model EG-3401 | | | | | | |
| Soil (see footnote) | PB1 | PB1 | PB1 | PB1 | PB1 | PB1 |
| Air Pressure (psi) | 28 | 28 | 14 | 28 | 14 | 28 |
| Liquid flow rate (ml/min) | 15 | 15 | 7.5 | 15 | 7.5 | 15 |
| Pre-cleaning time (min) | 2.5 | 2.5 | 2.5 | 2.5 | 2.5 | 2.5 |
| Liquid flow time (min) | 0.0 | 0.0 | 0.0 | 0.0 | 0.0 | 0.0 |
| Rivulet-droplet flow cleaning time (min) | 2.5 | 2.5 | 2.5 | 2.5 | 2.5 | 2.5 |
| Two-phase rinsing time (min) | 3.0 | 3.0 | 3.0 | 3.0 | 3.0 | 3.0 |
| Drying time (min) | 2.0 | 2.0 | 2.0 | 2.0 | 2.0 | 2.0 |

Note:
PB1: 2.5 mL pure fresh sheep blood, 2.5 mL saline, 100 μm protamine sulfate and radioactivity material that makes about 6.5 mL of soil.

Example 13

Bioburden Removal as Function of Flow Mode at Three Pressures

This example demonstrates how flow modes in endoscope channels affect the cleaning efficacy as determined by testing Recoverable Bioburden (microorganisms) following an accepted recovery protocol. Another objective was to define the effect of air pressure (velocity) and liquid flow rate on the flow regime and on the effectiveness of removing bioburden form actual endoscopes channels.

The Artificial Testing Soil (ATS) developed by Alfa is now accepted as a simulant for worst-case organic soil found in patient endoscopes after gastrointestinal procedures (U.S. Pat. No. 6,447,990). The detailed protocol for testing the effectiveness of cleaning endoscopes was published by Alfa et al., American Journal of Infection Control, 34 (9), 561-570 (2006), including the citations therein. The basis of the Alfa cleaning evaluation includes contaminating endoscope channels with a sufficient volume of a high-count inoculum (normally >8 log 10 cfu/ml) using a cocktail comprising three organisms covering a representative species from Gram positive, Gram negative and yeast/fungus mixed in the ATS soil. Depending on length and diameter, each channel normally receives 30 to 50 ml/channel of the ATS soil-bioburden mixture and then is allowed to stand for two hours to simulate the recommended practice used in reprocessing endoscopes. This contamination procedure is specific and requires special skill to ensure that each channel receives a complete coverage with ATS soil and organisms. After a waiting time, the endoscope channels is lightly purged with a know volume of air using a syringe to remove excess mixture form the channels. The endoscope is then transferred to the cleaning device for evaluation. At the conclusion of the cleaning and rinsing cycles (including exterior cleaning), residual bioburden in the channel is recovered according to a specific and precise protocol.

The accepted bioburden recovery method from the working channels (suction and biopsy) is to use the Flush/Brush/Flush (F/B/F) protocol for the working channels and the Flush/Flush (F/F) for the narrow A/W channels. The validated F/B/F protocol requires first flushing the entire channel with a sterile reverse osmosis (sRO) water and quantitatively collecting the recovered solution of this step in a sterile vial. The second step requires brushing the entire channel with a specially-designed endoscope brush multiple times using a specific sequence and manipulation to reach the entire surface of the channel and to dislodge the attached organism in a quantitative and reproducible manner. The brush tip is then cut off and placed in the same collecting sterile vial. A third bioburden recovery step involves another flushing of the channel with sRO water to remove the organisms detached by the brushing action as described above. The flushing liquid of this step is added to the same collection vial. The total volume of liquid recovered is maintained at about 40 mL. The contents of the vial are then sonicated to dislodge organisms from the brush or to suspend aggregated bacteria recovered. An aliquot of this recovered fluid is plate cultured as described by Alfa et al., referenced above. Serial dilution practice is used to produce reliable results following strict microbiology laboratory practices and routines. Three replicates are made in each test. The recovered bioburden from the suction/biopsy channel is termed L1. Intimate knowledge of the endoscope and its channel configuration is necessary to perform this protocol.

Recovery of bioburden from the Air/Water (A/W) narrow channels (ID 1.0 to 2.1 mm) is normally performed with the Flush/Flush (F/F) protocol which does not include the brushing step. These narrow endoscope channels cannot be bushed due to their small diameter and to the complex configuration of endsocopes, and there are no available brushes that can be perform this operation. However, the F/F protocol has been validated to produce excellent recovery for the A/W channel. At the conclusion of the cleaning and rinsing cycles, residual bioburden is recovered with a double flushing method using sRO water according to the Alfa protocol. The recovered liquid is collected from both air and water channels and pooled together in one sterile vial. Approximately 30 mLs are collected and subjected to the same preparation and culturing procedures described above. The recovered bioburden from the Air/Water channel is termed L2.

In each test the inoculum is cultured according the accepted protocols and the results expressed in colony forming units per mL, or simply cfu/mL. Generally, the recovered bioburden from the channel after cleaning is expressed as cfu/mL. The product of cfu/mL and volume of the recovered liquid from each channel in mLs yields total cfu/channel. When the latter value is divided by the surface area of the channel in cm2, bioburden surface density can be expressed in cfu/cm2. Since the volume of the liquid recovered from the channel is more or less the same as the volume of inoculum used to contaminate the channel, the log 10 removal (reduction) factor (RF) can be obtained by subtracting the log 10 of cfu/mL of recovered solution form the log 10 cfu/mL of the inoculum used. This calculation may be some what approximate since a positive control of a contaminated endoscope (not cleaned) need to be recovered at the same time to arrive at the actual RF. However, according to our experience with many tests the two methods for estimating RF are close to each other within +/−0.5-1.0 log. Negative controls are used in each test according to the Alfa protocol.

In this example, we assessed the cleaning of endoscope channels using *Enterococcus faecalis* ATCC 29212. *Enterococcus faecalis* is a gram-positive opportunistic pathogen known to form biofilms in vitro. This species is known to possess strong adhesion to endoscope channels and is considered an excellent surrogate worst case organism to reliably assess the cleaning effectiveness.

To demonstrate the effect of flow modes on the effectiveness of removing bioburden according to method of this invention, we selected three air pressures namely: namely 10, 28, and 55 psig. At each air pressure, we tested the cleaning effectiveness at three liquid flow rates. The liquid flow rates used to assess the cleaning of the suction/biopsy channel (ID=3.7 mm; length=400 cm max) are shown in Table 8. The liquid flow rates used to assess the cleaning effectiveness of the A/W (ID=about 1.6 mm; length=400 cm max) channels are shown in Table 8. The range of liquid flow rates was chosen by constructing a flow regime map according to the methods described in Example 1-7 for the particular endoscope channels employed and selecting the controlling parameters set forth above that provided RDF flow regime. The maps used in this case are those described in Example 2—FIG. 6 for the 2.8 mm tube and Example 3—FIG. 7 for the 1.8 mm tube. The low liquid flow rate was selected where the flow regime is described as dry/sparse over most of the channel length and when the amount of surface flow entities on the channel surface is small. The intermediate liquid flow rate was selected to represent nearly optimal RDF regime with intense rivulet meandering and fragmentation with large amount of moving liquid entities having three-phase contact line. The higher liquid flow rate was chosen such that the flow regime is in the film/foam regime where the surface of the channel is covered by a complete film with some foam and with little opportunity to form liquid entities.

Table 9 summarizes the results of nine tests to assess bioburden removal at three flow modes at three air pressures. At each pressure, the liquid flow rate determines the flow mode that can be obtained at the operating conditions. Examples of large (S/B) and narrow (A/W) channels were tested. The cleaning composition used was Composition 10A in Table 5, where the surfactant mixture was found to give excellent RDF mode when used at appropriate operating conditions. The injection of air and liquid into the endoscope was made according to the sequencing scheme A described in Example 16 where the flow is injected from the control handle following the cycle described here.

At 10 psig air pressure (Table 8), Test No. 2 represents near optimal liquid flow rate where the most of the channel is covered with elements of the RDF mode including rivulets, meandering rivulets and liquid fragments/entities covering the most of the channel length and surface. Test No. 2 results show the best bioburden removal from both S/B (L1) and A/W (L2) channels with RF values of 6.047 and 6.472, respectively. In this test, residual/recoverable organisms after RDF cleaning were only 48 cfu/cm2 and 17 cfu/cm2 form the S/B and A/W, respectively. At lower liquid flow rates where the treatment number is small due to the few number of surface flow entities formed under these conditions (Test No. 1), the results are worse. At higher liquid flow rate where most of the surface is in the film/foam regime and the cleaning with liquid entities is not possible (Test No. 3) the results were also worse compared to those of Test No. 2. Overall, the cleaning effectiveness demonstrates the significance of using the RDF mode (Table 8), especially in the S/B channel (L1). OLYMPUS® Colonoscopes (model CF Type Q160L) were used to simulate the worst case conditions especially for very long channels.

TABLE 8

| Test No. | Air Pressure (psig) | Liquid Flow Rate (ml/min) | Inoculum (Log 10 cfu/ml) | Recoverable Bioburden (cfu/ml) | (Log 10 cfu/ml) | (cfu/cm2) | Reduction Factor |
|---|---|---|---|---|---|---|---|
| | | L1 - Suction/Biopsy (Flush/Brush/Flush) | | | | | |
| 1 | 10 | 5.00 | 8.439 | 7830 | 3.893 | 787 | 4.546 |
| 2 | 10 | 22.5 | 8.710 | 460 | 2.663 | 48 | 6.047 |
| 3 | 10 | 67.50 | 8.393 | 1830 | 3.262 | 171 | 5.131 |
| 4 | 28 | 5.00 | 8.369 | 6400 | 3.806 | 605 | 4.563 |

TABLE 8-continued

| Test No. | Air Pressure (psig) | Liquid Flow Rate (ml/min) | Inoculum (Log 10 cfu/ml) | Recoverable Bioburden (cfu/ml) | (Log 10 cfu/ml) | (cfu/cm2) | Reduction Factor |
|---|---|---|---|---|---|---|---|
| 5 | 28 | 22.50 | 8.572 | 173 | 2.238 | 16 | 6.334 |
| 6 | 28 | 67.50 | 8.560 | 1700 | 3.230 | 151 | 5.330 |
| 7 | 55 | 5.00 | 8.423 | 1390 | 3.143 | 135 | 5.280 |
| 8 | 55 | 22.50 | 8.423 | 497 | 2.696 | 56 | 5.727 |
| 9 | 55 | 67.50 | 8.710 | 460 | 2.663 | 40 | 6.047 |
| | | L2 - Air/Water (Flush/Flush) | | | | | |
| 1 | 10 | 1.75 | 8.439 | 6830 | 3.834 | 607 | 4.605 |
| 2 | 10 | 5.75 | 8.710 | 173 | 2.238 | 17 | 6.472 |
| 3 | 10 | 16.80 | 8.393 | 190 | 2.279 | 14 | 6.114 |
| 4 | 28 | 1.75 | 8.369 | 293 | 2.467 | 17 | 5.902 |
| 5 | 28 | 5.75 | 8.572 | 150 | 2.176 | 8 | 6.396 |
| 6 | 28 | 16.80 | 8.560 | 1780 | 3.250 | 129 | 5.310 |
| 7 | 55 | 1.75 | 8.423 | 52300 | 4.718 | 3597 | 3.705 |
| 8 | 55 | 5.75 | 8.423 | 70 | 1.845 | 4 | 6.578 |
| 9 | 55 | 16.80 | 8.710 | 57 | 1.754 | 3 | 6.956 |

The same trend is found at 28 psig air pressure (Table 8) where the region corresponding to near optimal RDF mode gives the best result (Test No. 5). Low liquid flow rates (Test No. 4) corresponds to the sparse/dry flow mode with small treatment number and the high flow rate produced the foam/film regime (Test No. 6). Test No. 5 corresponds to the best results for both S/B and A/W channels as supported by the very low recoverable cfu/cm2 and high RF values. Again, cleaning in the RDF mode is demonstrated to give the best results at the 28 psig air pressure; RF values higher than 6.0 could be achieved under these conditions.

At even higher air pressures (55 psig), the main trend remains in that when the RDF and higher treatment number can be achieved within the 300 seconds cleaning yet better cleaning is possible. At this high pressure, the liquid flow rate optimal for the RDF mode appears to shift to higher values because of the high gas velocity obtained at this pressure.

The RF for optimal manual cleaning of endoscope channels has been established by Alfa et al. at 4.32+/−1.03 (Alfa et al., American Journal of Infection Control, 34 (9), 561-570 (2006)). Also, industry estimates RF of manual cleaning of endoscopes in the field about 1-4 or about 3.0 on the average. The manual cleaning results are based on following protocols for manual cleaning recommended which include brushing of the working S/B channels and flushing the A/W (protocol provided in Alfa et al., cited above). The optimal RF value obtained with the RDF cleaning at 10 and 28 psig air pressure is between 6.047 and 6.472 which is significantly better than the best manual cleaning results reported by Alfa et al by about 2 log 10. Based on these results, the RDF cleaning provides significantly better results than manual cleaning with brushing.

Example 14

Bioburden Removal with the RDF Mode Using Multiple Organisms

The three bacterial strains used for this example were *Enterococcus faecalis* ATCC 29212, *pseudomonas aeroginosa* ATCC 27853 and *candida albicans* ATCC 14053. This example follows the methods and protocols described in Alfa et al. and the references cited therein. Endoscope channels were contaminated with the ATS including cocktail of the three organisms as described in Example 13. OLYMPUS® Colonoscopes (model CF Type Q160L) were used to simulate the worst case conditions especially for very long channels. Both S/B and A/W channels were tested and the results are summarized in Table 10. The cleaning/rinsing cycles were same as in Example 13. Composition 10A in Table 5 was used as the cleaning liquid. The operating conditions including: air pressure, liquid flow rate and ports of injection were selected to provide optimal or near optimal RDF for the channel sizes present in endoscope used. Flow mode maps similar to those of Example 2-7 were used to define the RDF mode and to select the operating conditions. All tests were made at 28 psig air pressure.

RF values for Ten (10) independent tests regarding the cleaning S/B channel (L1) were as follows: 1) *Enterococcus faecalis* 5.60 (±0.82); 2) *pseudomonas aeroginosa* 7.02 (±1.38); 3) *candida albicans* 5.32 (±0.56). These results are significantly better than the best manual cleaning with brushing as per Alfa et al., and are far superior to published data by Zuhlsdorf (cited in Alfa's paper) where cleaning is performed according other AERs based of liquid flow cleaning methods. The main conclusion of the present example is that cleaning endoscope channels with the RDF mode achieves reliable and robust high-level cleaning better than manual brushing or other methods when the three representative organisms were used in the evaluation.

The RF values obtained in cleaning A/W channels (L2) of the same endoscope were as follows: 1) *Enterococcus faecalis* 5.76 (±1.01); 2) *pseudomonas aeroginosa* 6.92 (±1.02) and 3) *candida albicans* 5.82 (±0.94). These results are significantly better than the best manual cleaning values published by Alfa et al., or published data by zuhlsdorf et al. Comparing the results of this example with published data indicated that the RDF mode provides a clear advantage in cleaning very narrow channels compared to other methods as supported by the RF value obtained in the A/W (L2) case.

TABLE 9

| Test No. | Endoscope Model | *E. faecalis* Inoculum (Log 10 cfu/ml) | *E. faecalis* R.F. | *P. aeruginosa* Inoculum (Log 10 cfu/ml) | *P. aeruginosa* R.F. | *C. albicans* Inoculum (Log 10 cfu/ml) | *C. albicans* R.F. |
|---|---|---|---|---|---|---|---|
| | | L1 - Suction/Biopsy (Flush/Brush/Flush) | | | | | |
| 1 | PENTAX ® EG-2910 | 8.49 | 5.04 | 7.44 | 7.36 | 8.06 | 5.01 |
| 2[a] | PENTAX ® EG-2910 | 8.45 | 4.79 | 7.79 | 7.79 | 8.02 | 5.31 |
| 3[b] | PENTAX ® EG-2910 | 8.30 | 6.62 | 8.03 | 8.03 | 7.86 | 5.73 |
| 4[c] | PENTAX ® EG-2910 | 8.71 | 5.78 | 8.27 | 8.13 | 7.44 | 4.82 |
| 5[d] | PENTAX ® EG-2910 | 8.71 | 6.12 | 8.27 | 8.13 | 7.44 | 5.02 |
| 6[e] | PENTAX ® EG-2910 | 8.51 | 5.28 | 7.70 | 5.62 | 7.94 | 5.30 |
| 7[f] | PENTAX ® EG-2910 | 8.60 | 7.03 | 8.22 | 8.22 | 7.84 | 6.49 |
| 8[g] | OLYMPUS ® CF-Q160L | 8.30 | 4.71 | 8.28 | 4.56 | 7.18 | 4.84 |
| 9[h] | OLYMPUS ® CF-Q160L | 8.38 | 4.75 | 8.48 | 5.15 | 7.28 | 4.78 |
| 10[i] | OLYMPUS ® CF-Q160L | 8.23 | 5.10 | 8.91 | 7.20 | 7.90 | 5.86 |
| 11[j] | OLYMPUS ® CF-Q160L | 8.57 | 6.33 | | | | |
| | Average: | 8.48 | 5.60 | 8.14 | 7.02 | 7.70 | 5.32 |
| | Standard Deviation: | 0.16 | 0.82 | 0.42 | 1.38 | 0.33 | 0.56 |
| | | L2 - Air/Water (Flush/Flush) | | | | | |
| 1 | PENTAX ® EG-2910 | 8.49 | 4.64 | 7.44 | 5.43 | 8.06 | 5.33 |
| 2[a] | PENTAX ® EG-2910 | 8.45 | 4.66 | 7.79 | 7.46 | 8.02 | 6.06 |
| 3[b] | PENTAX ® EG-2910 | 8.30 | 5.89 | 8.03 | 7.41 | 7.86 | 5.73 |
| 4[c] | PENTAX ® EG-2910 | 8.71 | 6.02 | 8.27 | 8.22 | 7.44 | 4.94 |
| 5[d] | PENTAX ® EG-2910 | 8.71 | 6.30 | 8.27 | 6.84 | 7.44 | 5.37 |
| 6[e] | PENTAX ® EG-2910 | 8.51 | 4.58 | 7.70 | 6.10 | 7.94 | 5.78 |
| 7[f] | PENTAX ® EG-2910 | 8.60 | 7.71 | 8.22 | 8.22 | 7.84 | 7.80 |
| 8[g] | OLYMPUS ® CF-Q160L | 8.30 | 5.59 | 8.28 | 6.12 | 7.18 | 5.14 |
| 9[h] | OLYMPUS ® CF-Q160L | 8.38 | 4.88 | 8.48 | 5.72 | 7.28 | 4.98 |
| 10[i] | OLYMPUS ® CF-Q160L | 8.23 | 6.71 | 8.91 | 7.65 | 7.90 | 7.07 |
| 11[j] | OLYMPUS ® CF-Q160L | 8.57 | 6.40 | | | | |
| | Average: | 8.48 | 5.76 | 8.14 | 6.92 | 7.70 | 5.82 |
| | Standard Deviation: | 0.16 | 1.01 | 0.42 | 1.02 | 0.33 | 0.94 |

Notes1
[a]Two RDF cycles
[b]No water filter/cold water/2 hr. drying time (March 2005)
[c]With water filter/cold water
[d]Without water filter/cold water
[e]Flush/Brush/Flush Method of Recovery (July 2005)
[f]Hot tap water (September 2005)
[g]Cold tap water (April 2008)
[h]Cold RO water (April 2008)
[i]Cold RO water with continuous rinse (May 2008)
[j]10 Tap water with continuous rinse (September 2008)

Example 15

Cleaning of Organic Soils from Endoscopes with RDF Flow Regime

One criteria cleaning effectiveness used in the pharmaceutical industry is based on measuring the level of organic soil removal from surfaces of equipment and devices. Transfer of contamination from one drug to another due to the sue of the same equipment can lead to serious consequences which requires adhering to cleaning protocols approved by FDA. To apply these principles, two artificial soils, red soil (ISO 15883-5 Annex R) and black soil (ISO 15883-5 Annex P), were chosen to simulate patient soils encountered during various endoscopic procedures. These two soils were used to contaminate the endoscopes by applying the soil and allowing it to dry for at least one hour following application.

The commercial endoscopes tested were OLYMPUS® TJF-160VF duodenoscope and a PENTAX® ED-3470 duodenoscope. These endoscopes were chosen to represent some of the most difficult challenges for the cleaning system, with lumens ranging from 0.8-mm to 4.2-mm ID, and a total length in excess of three meters. Endoscope cleaning was performed using the apparatus described in Example 1 and shown diagrammatically in FIG. 4.

The cleaning efficacy was evaluated by testing water extracts from the cleaned lumens for residual total organic carbon (TOC) and protein. The following protocol was employed. Endoscope lumens were contaminated with black or red soils at a level given within Table 10. Contamination levels were based on recommendations contained within "Worst-case soiling levels for patient-used flexible endoscopes before and after cleaning," published by Michelle Alfa et al., in Amer. J. Infect. Control. 27:392-401, 1999. Total lumen lengths and internal diameters listed in the table were used to calculate total surface area. Cleaning tests included a 5-min cleaning cycle and 5-min rinse cycle with filtered tap water.

TABLE 10

Lumen Test Conditions

| Endoscope | Channel | Length (mm) | ID (mm) | Soil | Dose (ml) | Trials |
|---|---|---|---|---|---|---|
| OLYMPUS ® TJF-160VF | Suction/ Biopsy | 3048 | 4.2 | Control | 0.0 | 3 |
| | Air/Water | 3048 | 2.7 | Control | 0.0 | 3 |
| | Elevator Wire | 1537 | 0.9 | Control | 0.0 | 3 |
| | Suction/ Biopsy | 3048 | 4.2 | Black | 6.5 | 3 |
| | Air/Water | 3048 | 2.7 | Red | 1.0 | 3 |
| | Elevator Wire | 1537 | 0.9 | Red | 0.18 | 3 |
| PENTAX ® ED-3470 | Suction/ Biopsy | 3105 | 4.2 | Control | 0.0 | 3 |
| | Air/Water | 3105 | 2.5 | Control | 0.0 | 3 |
| | Suction/ Biopsy | 3105 | 4.2 | Black | 6.6 | 3 |
| | Air/Water | 3105 | 2.5 | Red | 1.0 | 3 |
| OLYMPUS ® TJF-160VF | Suction/ Biopsy | 3048 | 4.2 | Control | 0.0 | 1 |
| | Air/Water | 3048 | 2.7 | Control | 0.0 | 1 |
| | Suction/ Biopsy | 3048 | 4.2 | Black | 6.5 | 3 |
| | Air/Water | 3048 | 2.7 | Red | 1.0 | 3 |
| PENTAX ® ED-3470 | Suction/ Biopsy | 3105 | 4.2 | Control | 0.0 | 1 |
| | Air/Water | 3105 | 2.5 | Control | 0.0 | 1 |
| | Suction/ Biopsy | 3105 | 4.2 | Black | 6.6 | 3 |
| | Air/Water | 3105 | 2.5 | Red | 1.0 | 3 |

Three method controls (blanks) were performed in very test. These blanks were subjected to the RDF cleaning process (5-min) and rinsing with distilled water (5-min) prior to extraction of residual organic soil. Extraction was performed using deionized water and lumens with larger lumen dimensions (>1.6-mm) were brushed with lumen brushes per a validated method. Extracts were collected in clean glass vials and were analyzed for total organic carbon (TOC) and protein residues. Total organic carbon was determined using a Total Organic Carbon (TOC) analyzer model 1010 from OI Analytical, while protein was determined using a Fluorescence Spectrophotometer model RF 5301 from Shimadzu according to standard methods. The operational parameters included: 1) Air pressure for all lumens 28 psig; 2) Cleaning liquid: Composition 10A in Table 5; 3) Liquid flow rates as per flow mode maps and Example 2-7. Black soil was introduced into the biopsy port near the control handle area of the endoscopes using a syringe. Black soil was introduced into the suction port located at umbilical end of the endoscopes. Red soil was injected into the air/water channel port located at the umbilical end of the endoscopes. All soils were well distributed into their respective channels with multiple injections of air. Table 11 below details extractable residues recovered from endoscope lumens.

TABLE 11

Protein and TOC Residues Following RDF Cleaning of Soiled Lumens

| Endoscope | Channel | Protein ($\mu g/cm^2$) | TOC ($\mu g/cm^2$) |
|---|---|---|---|
| OLYMPUS ® TJF-160VF | Suction/Biopsy | ND, ND, 0.02 | 0.06, 0.04, 0.05 |
| | Air/Water | 0.02, ND, ND | 0.05, ND, ND |
| | Elevator Wire | 0.97, 0.46, 1.40 | 2.44, 1.17, 3.36 |
| PENTAX ® ED-3470 | Suction/Biopsy | ND, 0.19, 0.04 | ND, 0.15, 0.09 |
| | Air/Water | 0.08, 0.04, ND | 0.23, 0.06, ND |
| OLYMPUS ® TJF-160VF | Suction/Biopsy | 0.04, 0.12, ND | 0.09, 0.03, ND |
| | Air/Water | ND, ND, ND | 0.01, ND, ND |
| PENTAX ® ED-3470 | Suction/Biopsy | ND, ND, 0.10 | ND, ND, ND |
| | Air/Water | 0.08, 0.14, ND | 0.23, 0.25, ND |

ND = Non-Detect/Below the Limit of Detection

The results of this example demonstrate that RDF cleaning provided excellent cleaning capability for suction/biopsy and air/water channels of two commercially available endoscopes representing the range of standard lumen challenges. The RDF method also provided adequate cleaning capability for the elevator-wire channel of the OLYMPUS® TJF-160VF. These experiments demonstrate that the RDF method achieves high level removal organic soils recommended for testing endoscopes. This also confirms that RDF can meet and exceed the 6.2 ug/cm2 cleaning criteria set by Alfa et al for organic soils cleaning. These results are significantly better that liquid cleaning methods reported by Alfa et al. The above tests were repeated using ATS soil with similar results as in Table 11.

Example 16

Devices for Flow Sequencing for Cleaning Endoscopes

Figure 13:
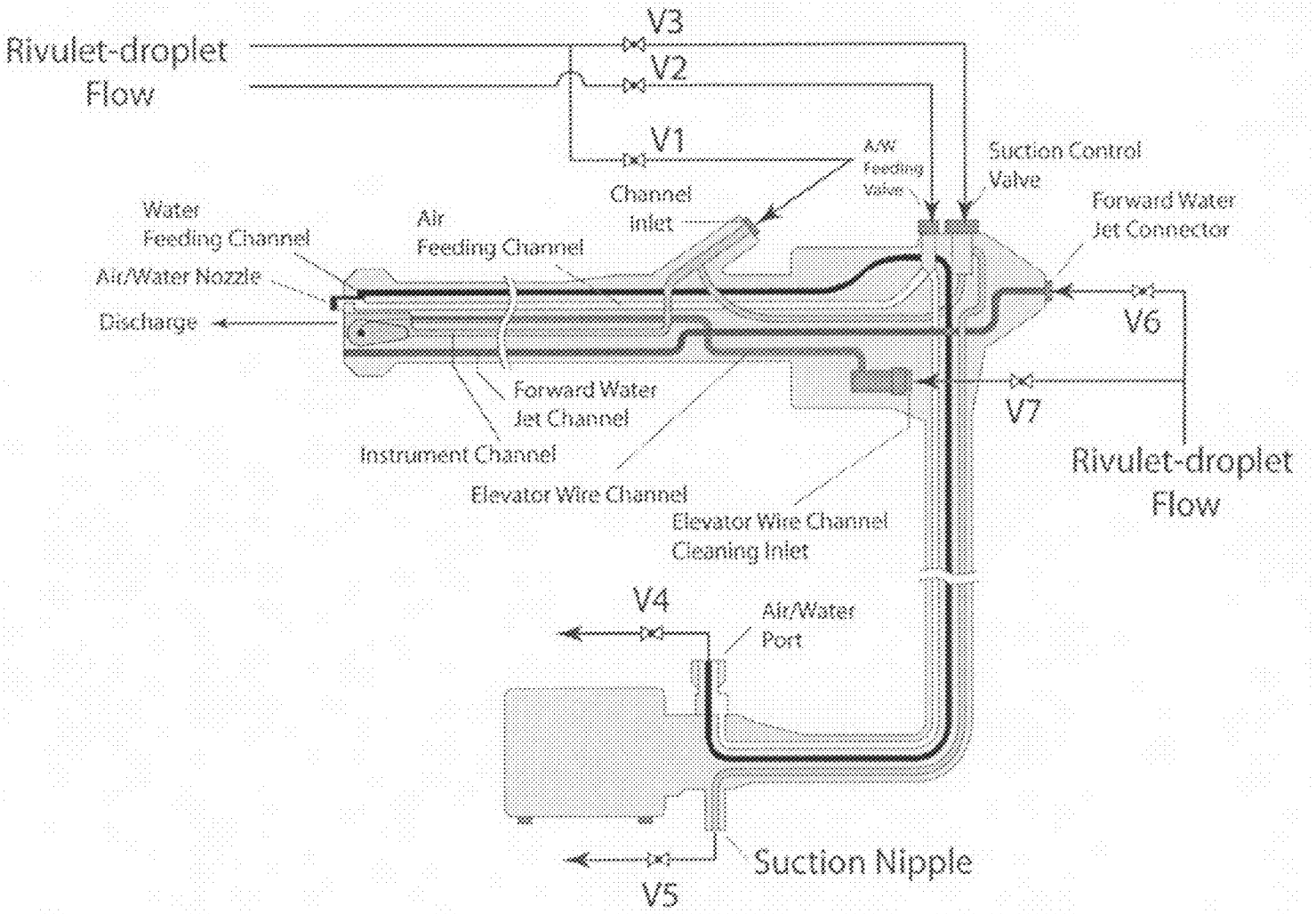
FIG. 13 is a schematic diagram of a multi-channel flow sequencing device for cleaning endoscopes according to flow sequence A described in Example 16.

This example illustrates devices to produce two flow sequences used for applying rivulet-droplet flow (RDF) and for discharging waste liquids during reprocessing. The two flow sequences are discussed below:

Scheme A. RDF cleaning through handle ports of the endoscope—Custom fabricated adapters are used to connect the endoscope internal channels to the fluid distribution manifold. The rivulet-droplet flow is introduced using two main flow paths: i) the first flow path is dedicated to the suction control port V3 and the biopsy channel inlet V1, and ii) the second flow path directs the RDF into the air-water feeding valve V2. Two separate single flow paths are dedicated to the forward water jet port V6 and elevator wire channel V7, as shown in FIG. 13. To enhance the cleaning for the air/water channel, V4 is closed during one step of cleaning, thus forcing all the RDF directly towards the distal end.

Figure 14:
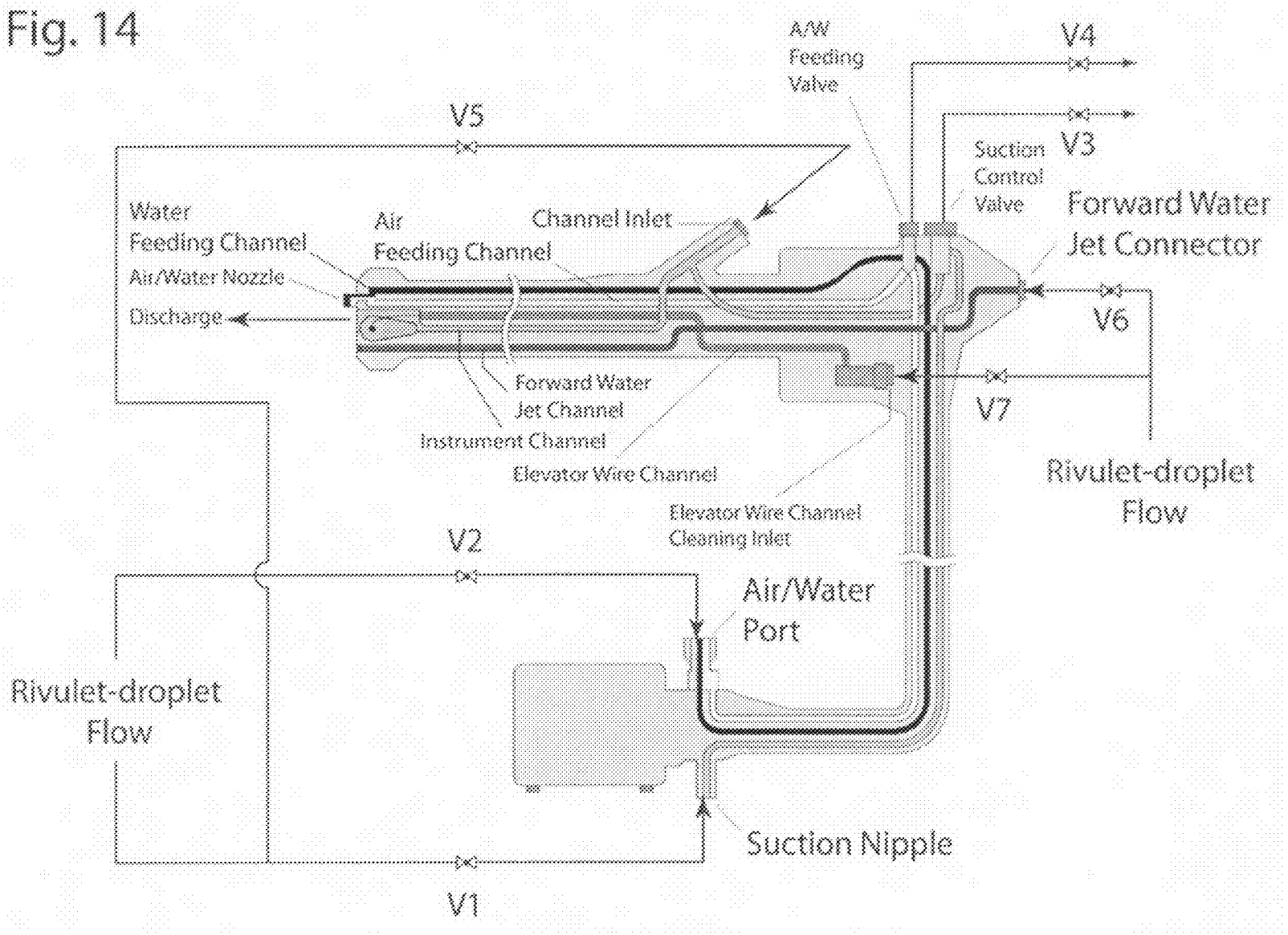
FIG. 14 is a schematic diagram of a multi-channel flow sequencing device for cleaning endoscopes according to flow sequence B described in Example 16.

Scheme B. TPF cleaning connected to the umbilical end—A second flow path is designed to introduce the RDF to the suction port and air/water inlet port at the umbilical end. RDF is introduced using two main flow paths: i) the first flow path is dedicated to the suction port V1* and the biopsy channel inlet V5*, and ii) the second flow path directs the fluid into the air/water inlet V2*. Exhaust fluids during reprocessing steps are discharged from the distal end, air/water feeder valve V4*, and suction control valve V3*, as shown in FIG. 14. Each cleaning step is associated with an ON and OFF cycle to ensure that the dead spaces in the biopsy channel inlet, air/water feeder valve and suction control valve are cleaned and rinsed. In the "ON" cycle, valves V3*, V4* and V5* are open. In the "OFF" cycle, these valves are closed. Cleaning can also be performed with both V3* and V4* closed.

Example 17

Determination of Treatment Number of Water

Analysis of high-speed images reveals that there is usually rivulet meandering and that such meandering mainly provides treatment of the inlet portion of tube. Sub-rivulets and sub-rivulets fragments (various cylindrical bodies, and droplets) are seen on the bottom of tube when this is not covered by the rivulet at certain moment. A set of sliding flow entities provides additional cleaning of the bottom half of tube.

Equation 27 (below) can be used to quantify treatment number of the upper half of tube because variations in the subrivulet fragment diameter are usually small for the images obtained at 30 psi air pressure and at a range of liquid flow rates. As a consequence, the variation in sliding velocity is not large as well because the sliding velocity depends on the fragment diameter, while its dependence on fragment length is weaker. Taking altogether into account, 27 takes form for treatment number by subrivulet fragments $$NT_{rf}=2t_{cl}d_{av}^{rf}U_{av}^{rf}N_{av}^{rf}/S \quad (27)$$

where $N_{av}^{rf}$ is the averaged number of subrivulet fragments per image, $U_{av}^{rf}$ is the average velocity of the fragment, $t_{cl}$ is the cleaning time (time over which the experiment was carried out) and $d_{av}^{rf}$ is the average diameter of the rivulet fragment observed. Since only the upper half of tube is inspected, the multiplier 2 appears because S/2 is used instead of S, where S is the area of tube section of the visual area under microscope at the magnification used.

Treatment number of pure water: This example illustrates a method for calculating the treatment number (NT) based on image analysis for the case of pure water. A tube with diameter 2.8 mm, length 200 cm was examined at 30 psi air pressure and water flow rate 20 mL/min. Images were obtained at 3 positions along tube length corresponding approximately to the beginning, middle and end of the tube. At the beginning of tube (28-cm position) there was no meandering. The bottom rivulet was well visible and occupied the entire bottom of tube. Meandering rivulet was visible at the middle (118-cm position) and at the end (208-cm position). The meandering occurs mainly across the lower half of tube. The rivulet is seen either in the bottom middle, left side, or right side of the tube.

In the case of water, sub-rivulets were present on 2 among 8 images at tube middle. No sub-rivulets were present on 8 images at tube end. Sub-rivulet fragments were present at the middle and the end of the tube. These sub-rivulet fragments were almost of the same diameter, about 100 um, while their length varies within a broad range.

The diameter of droplets was approximately one half of the diameter of sub-rivulet fragments, namely about 50 micron. The averaged values for the number of sub-rivulet fragments and droplets per image at the middle and end viewing areas of the tube are collected in Table 12.

TABLE 12

| Tube section | $N_{av}^{rf}$ | $N_{av}^{dr}$ |
|---|---|---|
| Middle | 6 | 2 |
| End | 6 | 2 |

For tube with diameter 2.8 mm, S=0.7 $cm^2$ per image. The substitution of these values and treatment time $t_{cl}$=300 seconds into Eq 15 yields the following treatment numbers arising for rivulet fragments and droplets:

$$\text{Middle Section: } NT_{av}=800(6\cdot10^{-2}U_{av}^{rf}+10^{-2}U_{av}^{dr}) \quad (28)$$

$$\text{End Section: } NT_{av}=800(6\cdot10^{-2}U_{av}^{rf}+10^{-2}U_{av}^{dr}) \quad (29)$$

This yields $NT_{av}$ for rivulet fragments of $48.U_{av}$. The NT term for droplets in this example is very small and can be ignored.

If the sub-rivulet cross section does not change along and its axis, it is straight and moves along tube axis, its role in cleaning is negligible. However, the sub-rivulet cross section was found to change more than about twice per image. Apart from weak meandering, no large kinks in its shape were found in the sub-rivulets. Taking into account about 4 kinks or meandering waves per images and the presence of wider section in the sub-rivulets, the treatment by sub-rivulet may be estimated with $d_{av}^{sub}$~$3.4\cdot10^{-2}$ cm, while $N_{av}^{sub}$=0.25. This yields:

$$NT_{sub}=800\cdot3\cdot10^{-2}U_{av}^{sub}=24\ U_{av}^{sub} \quad (30)$$

The sum of NT terms for rivulet fragments (rf), droplets (dr) and sub-rivulets (sub) yields total treatment number for water. In order to compute the above terms, the sliding velocity of the corresponding surface flow elements (rf, dr and sub) must be known. The average velocity of was found to 7 cm/sec for rivulet fragments, 4 cm/sec for droplets and 0.7 cm/sec for sub-rivulets. Substitution of these values for the sliding velocity of the appropriate surface flow entity gives an overall Treatment Number for water of 385 in this experiment, i.e., the channel are viewed is swept 385 times during the 300 second cleaning time.

Example 18

Influence of Surfactants on Treatment Number

Many surfactants were tested to assess their influence on sub-rivulet formation and further fragmentation to other surface flow entities and on treatment number. The measurement technique and analysis was similar to that described in Example 16. The conditions employed were: Tubing: 2.8 mm ID, 2 m long; Air Pressure: 30 psig; Liquid Flow Rate: 19.6 ml/min; Treatment Time: 300 sec. All the surfactant solutions (liquid cleaning medium) included: sodium metasilicate (1.3%); sodium triphosphate (SPT) (8.7%) and tetrasodium pyrophosphate (2.0%) and were prepared with deionized water.

The results are summarized in Table 13. The measured sliding velocities for the surface flow elements used to calculate the Treatment Numbers according to Eq 5 are Rivulet Fragments—7 cm/sec; Droplets—4 cm/sec; Sub-Rivulets—0.7 cm/sec

TABLE 13

| Liguid/Surfactant | Conc. (%) | Rivulet Fragments (rf) $NT_{rf}$(a) | Droplets (dr) $NT_{dr}$ (a) | Sub-rivulets (sub) $NT_{sub}$ (a) | Overall Treatment Number ( ΣNT |
|---|---|---|---|---|---|
| Pure Water | | 336 | 32 | 17 | 385 |
| Tallow amine 2EO ethoxylate (Surfonic T-2) | 0.05 | 392 | 15 | 10 | 417 |
| EO-PEO copolymer - HLB = 10.5 (Pluronic L43) | 0.05 | 266 | 92 | 175 | 533 |
| Octyl sulfate (NAS-8) | 0.05 | 504 | 32 | 17 | 553 |
| Tallow amine 5 EO ethoxylate (Surfonic T-5) | 0.05 | 490 | 208 | 17 | 715 |
| Butyl-terminated C12 alcohol ethoxylate (Dehypon LT-54) | 0.1 | 560 | 131 | 245 | 936 |
| Tallow amine 15EO ethoxylate (Surfonic T-15) | 0.05 | 700 | 248 | 20 | 968 |
| Acetelynic ethoxylate (HLB 17) (Surfynol 485) + Alkoxylated ether amine oxide (AO-455) | 0.036 + 0.024 | 1260 | 512 | 20 | 1792 |

Inspection of Table 13 indicates that the tallow amine 2EO ethoxylate (Surfonic T-2) which has a low HLB and is insoluble tends to form annular films (receding contact angle close to or equal to water) and provides a Treatment Number again comparable to water. Increasing the degree of ethoxylation to 5EO increases the Treatment Number somewhat while an increase in ethoxylation to 15 EO (Surfonic T-15) provides a much more effective cleaning medium exhibiting a 2.5 fold increase in Treatment Number.

It should be noted that the concentration of surfactant employed is also important parameter governing its ability to generate an optimal flow regime. For example, the Tallow 15 EO ethoxylated (Surfonic T-15) used in this experiment was 0.05%. However, when the concentration is increased to 0.1% the solution generates significant foam and the Treatment Number is found to decrease.

Table 14 also demonstrates mixed surfactant system composed of the Acetelynic ethoxylate (Surfynol 485) and the Alkoxylated ether amine oxide (AO-455) provides provides vastly increased Treatment Number that is 4.6 time more effective than water.

These results indicates that the proper selection of the surfactant and its concentration so as to meet the surface tension, wetting and foaming requirements described above is critical to its performance in the cleaning method of the present invention.

Example 19

Channel Cleaning with Discontinuous Plug Droplet Flow (DPDF)

To test the cleaning effectiveness of the Discontinuous Plug Droplet Flow flow regime (DPDF), we performed cleaning experiments using 2.8 mm diameter Teflon channel (2 meter long) contaminated with the black soil as described in Example 15. After contamination the channel was allowed to dry in the channel for 24 hour before cleaning. The cleaning conditions used were: 28 psig air; 19.6 mL/min liquid flow; cleaning liquid included Surynol 485 and AO-455 (designated Composition 10A in Table 5); treatment time 300 seconds; air and liquid used @ room temperature.

The cleaning procedure was based on introducing the cleaning liquid into the channel for 2-3 seconds without air and then introducing the air for 6 seconds. This mode of cleaning first resulted in creating a moving meniscus that swept the entire perimeter of the channel from the inlet to outlet. Almost concurrently, introducing the air transformed the cleaning liquid into surface flow entities including rivulets, sub-rivulets, rivulet fragments and droplets which covered the entire surface of channel during a portion of the time. The latter part of the air pulse resulted in complete dewetting and drying of the surface of the channel. The channel becomes ready to receive effective cleaning with the moving contact line during the next step. The above cleaning step was repeated for the 300 seconds or about 43 times. At the conclusion of cleaning with this mode, the channel was rinsed with water.

Sections were then cut at the beginning, middle and end of the channel for examination by electron microscopy. Representative scanning electron micrographs (SEMs) were acquired at 1000× and 5000× magnifications. Analysis of SEMs revealed that the DPDF flow regime is effective in achieving a high-level cleaning of similar quality as when air and cleaning liquid used in the RDF mode. This mode of cleaning allows better distribution of surface flow entities with three phase contact on the ceiling and bottom of the channel. It can be used alone or can be combined with other RDF mode to ensure achieving high treatment number for all parts of channel surface. High-speed images also indicated that the surface of the channel specially at both inlet and outlet portions of the channel receive more effective treatment and more uniform coverage with surface flow entities during cleaning with the DPDF. The results of this example support that periodic dewetting and drying of channel surface prevents adverse effects of liquid film formation on the surface of the channel which has been found to impede the cleaning with surface flow entities according the instant invention. The selection of the period of time for introducing the liquid, liquid flow rate, air pressure, air duration and surfactant type need to be selected to achieve effect effective cleaning. This cleaning mode is also effective during rinsing and pre-cleaning of endoscopes since it provides more uniform coverage of surface and minimizes incidents of low treatment number insome parts of the channels specially the bottom section and both inlet and outlet sections.

Example 20

Controlling Parameter for Endoscope Cleaning According to the Current Invention

Tables 14-16 provide the suggested liquid and gas flow rates at different pressures for generating optimal RDF flow regimes for cleaning the channels of most endoscopes currently available. The liquid cleaning used included 0.036% Surfynol-485W and 0.024% AO-455.

TABLE 14

Rivulet-droplet Flow Conditions: Endoscope - PENTAX ® EG-2901

| | Channel Inside Diameter (cm) | Flow Rate of Liquid Cleaning Solution (ml/min) | Set Pressure 18 psig Air Flow Rate (scfm) | 18 psig Pressure Drop (psid) | 18 psig Channel Outlet Velocity (m/s) | 18 psig Channel Inlet Velocity (m/s) | 24 psig Air Flow Rate (scfm) | 24 psig Pressure Drop (psid) | 24 psig Channel Outlet Velocity (m/s) | 24 psig Channel Inlet Velocity (m/s) | 30 psig Air Flow Rate (scfm) | 30 psig Pressure Drop (psid) | 30 psig Channel Outlet Velocity (m/s) | 30 psig Channel Inlet Velocity (m/s) |
|---|---|---|---|---|---|---|---|---|---|---|---|---|---|---|
| Flow from Umbilical End to Distal End | | | | | | | | | | | | | | |
| Air/Water | 0.18 | 15 | 0.04 | 12.5 | 3.3 | 1.8 | 0.07 | 22.4 | 6.6 | 2.6 | 0.14 | 27.5 | 12.8 | 4.5 |
| Suction | 0.38 | 45 | 0.21 | 12.8 | 8.8 | 4.7 | 1.36 | 15.4 | 56.7 | 27.7 | 1.01 | 26.8 | 41.9 | 14.9 |
| Flow from Control Handle to Distal End | | | | | | | | | | | | | | |
| Air/Water | 0.15 | 15 | 0.07 | 12.6 | 9.8 | 5.3 | 0.11 | 18.3 | 14.3 | 6.4 | 0.21 | 28.0 | 28.4 | 9.8 |
| Suction | 0.38 | 45 | 0.87 | 12.3 | 36.3 | 19.8 | 1.16 | 18.3 | 48.4 | 21.6 | 1.74 | 26.8 | 72.5 | 25.7 |
| Biopsy | 0.38 | 45 | 0.73 | 12.4 | 30.3 | 16.4 | 0.85 | 18.1 | 35.4 | 15.9 | 1.72 | 28.0 | 71.5 | 24.6 |
| Flow from Control Handle to Umbilical End | | | | | | | | | | | | | | |
| Air/Water | 0.18 | 15 | 1.37 | 12.6 | 127.5 | 68.7 | 1.61 | 18.4 | 149.6 | 66.5 | 1.91 | 24.0 | 177.0 | 67.2 |
| Suction | 0.38 | 45 | 1.97 | 12.0 | 81.9 | 45.1 | 2.67 | 18.0 | 111.0 | 49.9 | 3.42 | 24.6 | 142.2 | 53.2 |
| Biopsy | 0.38 | 45 | 1.95 | 12.3 | 81.2 | 44.3 | 2.47 | 18.1 | 103.0 | 46.1 | 3.19 | 25.0 | 132.8 | 49.2 |

TABLE 15

Rivulet-droplet Flow Conditions: Endoscope - PENTAX ® EC-3830TL)

| | Channel Inside Diameter (cm) | Flow Rate of Liquid Cleaning Solution (ml/min) | Set Pressure 18 psig Air Flow Rate (scfm) | 18 psig Pressure Drop (psid) | 18 psig Channel Outlet Velocity (m/s) | 18 psig Channel Inlet Velocity (m/s) | 24 psig Air Flow Rate (scfm) | 24 psig Pressure Drop (psid) | 24 psig Channel Outlet Velocity (m/s) | 24 psig Channel Inlet Velocity (m/s) | 30 psig Air Flow Rate (scfm) | 30 psig Pressure Drop (psid) | 30 psig Channel Outlet Velocity (m/s) | 30 psig Channel Inlet Velocity (m/s) |
|---|---|---|---|---|---|---|---|---|---|---|---|---|---|---|
| Flow from Umbilical End to Distal End | | | | | | | | | | | | | | |
| Air/Water | 0.18 | 15 | 0.11 | 16.5 | 10.3 | 4.9 | 0.21 | 22.3 | 19.7 | 7.8 | 0.22 | 28.1 | 20.1 | 6.9 |
| Suction | 0.38 | 45 | 1.83 | 16.0 | 76.1 | 36.4 | 2.19 | 22.0 | 91.1 | 36.5 | 2.56 | 27.6 | 106.5 | 37.0 |
| Flow from Control Handle to Distal End | | | | | | | | | | | | | | |
| Air/Water | 0.15 | 15 | 0.15 | 16.4 | 19.7 | 9.3 | 0.29 | 22.3 | 38.9 | 15.5 | 0.44 | 28.0 | 58.2 | 20.0 |
| Suction | 0.38 | 45 | 2.60 | 15.3 | 54.1 | 26.5 | 3.04 | 22.0 | 63.2 | 25.3 | 3.76 | 27.4 | 78.3 | 27.3 |
| Biopsy | 0.38 | 45 | 2.81 | 15.2 | 58.5 | 28.8 | 3.76 | 21.6 | 78.3 | 31.7 | 5.47 | 26.6 | 113.9 | 40.5 |
| Flow from Control Handle to Umbilical End | | | | | | | | | | | | | | |
| Air/Water | 0.18 | 15 | 1.65 | 16.0 | 152.6 | 73.1 | 2.05 | 23.6 | 190.4 | 73.1 | 2.44 | 25.8 | 226.1 | 82.1 |

TABLE 15-continued

| Rivulet-droplet Flow Conditions: Endoscope - PENTAX ® EC-3830TL) | | | | | | | | | | | | | | |
|---|---|---|---|---|---|---|---|---|---|---|---|---|---|---|
| | Channel Inside Diameter (cm) | Flow Rate of Liquid Cleaning Solution (ml/min) | Set Pressure | | | | | | | | | | | |
| | | | 18 psig | | | | 24 psig | | | | 30 psig | | | |
| | | | Air Flow Rate (scfm) | Pressure Drop (psid) | Channel Outlet Velocity (m/s) | Channel Inlet Velocity (m/s) | Air Flow Rate (scfm) | Pressure Drop (psid) | Channel Outlet Velocity (m/s) | Channel Inlet Velocity (m/s) | Air Flow Rate (scfm) | Pressure Drop (psid) | Channel Outlet Velocity (m/s) | Channel Inlet Velocity (m/s) |
| Suction | 0.38 | 45 | 2.62 | 15.2 | 109.2 | 53.7 | 3.26 | 21.9 | 135.7 | 54.2 | 3.94 | 27.5 | 163.8 | 57.1 |
| Biopsy | 0.38 | 45 | 2.29 | 15.2 | 95.3 | 46.8 | 2.84 | 23.0 | 118.1 | 46.0 | 4.08 | 27.5 | 169.7 | 59.1 |

TABLE 16

| Rivulet-droplet Flow Conditions: Endoscope - OLYMPUS ® TJF-160VF | | | | | | | | | | | | | | |
|---|---|---|---|---|---|---|---|---|---|---|---|---|---|---|
| | Channel Inside Diameter (cm) | Flow Rate of Liquid Cleaning Solution (ml/min) | Set Pressure | | | | | | | | | | | |
| | | | 30 psig | | | | 40 psig | | | | 60 psig | | | |
| | | | Air Flow Rate (scfm) | Pressure Drop (psid) | Channel Outlet Velocity (m/s) | Channel Inlet Velocity (m/s) | Air Flow Rate (scfm) | Pressure Drop (psid) | Channel Outlet Velocity (m/s) | Channel Inlet Velocity (m/s) | Air Flow Rate (scfm) | Pressure Drop (psid) | Channel Outlet Velocity (m/s) | Channel Inlet Velocity (m/s) |
| Flow from Control Handle to Distal End | | | | | | | | | | | | | | |
| Elevator | 0.085 | 3.8 | 0.050 | 26.0 | 82.8 | 29.9 | | | | | | | | |
| Elevator | 0.085 | 7.6 | 0.010 | 26.0 | 16.6 | 6.0 | 0.035 | 36.0 | 58.0 | 16.8 | 0.078 | 56.0 | 129.2 | 26.7 |
| Elevator | 0.085 | 11.5 | 0.001 | 26.0 | 1.7 | 0.6 | 0.014 | 36.0 | 22.4 | 6.5 | 0.050 | 56.0 | 82.8 | 17.2 |

While this invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

What is claimed is:

1. A method for cleaning an internal surface of a narrow diameter channel, method comprising the steps of:

i) flowing a liquid cleaning medium and a gas at a pressure of 35 psi or less through the narrow diameter channel under a flow regime that creates surface flow entities in contact with and sliding along the internal surface of the narrow diameter channel, said surface flow entities having three-phase contact lines and associated menisci, said surface flow entities detaching contaminants with which they come in contact from the internal surface of the narrow diameter channel, wherein the narrow diameter channel has a diameter of about 0.02 centimeter to about 1.6 centimeters, and a length of about 0.75 meter to about 5 meters, wherein the internal surface of the narrow diameter channel is a hydrophobic surface, and wherein the surface flow entities exhibit an advancing contact angle greater than 50 degrees and a receding contact angle greater than zero degree;

ii) rinsing the internal surface of the narrow diameter channel to remove residual liquid cleaning medium and detached contaminants from the internal surface of the narrow diameter channel;

wherein during step i):

the detachment of contaminants from the internal surface of the narrow diameter channel is produced by a sweeping of the internal surface of the narrow diameter channel with the three-phase contact lines of the surface flow entities, the cleaning medium is not predispersed in the gas as droplets before entering the channel, and less than 10% of the internal surface of the narrow diameter channel is covered by a contiguous annular film.

2. A method according to claim 1 wherein the flow rates of liquid and gas and the liquid cleaning medium are chosen such that foam is absent from at least about 75% of the channel on the basis of its total length.

3. A method according to claim 1 wherein the internal surface of the channel is either i) a hydrophobic polymer comprising polytetrafluoroethylene, fluorinated ethylene-propylene, polystyrene, polyvinylchloride, polyethylene, polypropylene, silicone, polyester, polyethylene tetraphthalate, polyurethane, or carbon tubules; or ii) a hydrophobic surface provided by surface modification with a surfactant, a polymer, or a mixture of a surfactant and a polymer.

4. A method according to claim 1 wherein the flow regime is rivulet droplet flow created by flowing the liquid cleaning medium through the internal surface of the narrow diameter channel under rivulet flow and simultaneously flowing the gas through the internal surface of the narrow diameter channel at a liquid flow rate and a gas flow rate sufficient to form meandering rivulets and fragments from the rivulet or rivulets that remain attached to and slide along the internal surface of the narrow diameter channel, said meandering rivulets and fragments detaching contaminants from the internal surface of the narrow diameter channel.

5. A method according to claim 4 wherein the liquid cleaning medium has a volumetric flow rate selected such that meandering rivulets and rivulet fragments provide a Treatment Number greater than about 10 over substantially the entire surface of the internal surface of the narrow diameter channel.

6. A method according to claim 4 wherein either or both the flows of liquid cleaning medium and gas are pulsed with a pulse time, $t_p$, defined as the time over which the either or both the liquid cleaning medium and gas flows through the internal surface of the narrow diameter channel, and a delay time, $t_d$, defined a the time interval between successive pulses.

7. A method according to claim 6 wherein the delay time, $t_d$, is sufficient to substantially remove liquid films from the channel surface by a combination of flow and evaporation before commencing another pulse.

8. A method according to claim 6 wherein the pulse time, $t_p$, is about 0.1 to about 15.0 sec and the delay time, $t_d$, is about 1.0 sec to about 20.0 sec.

9. A method according to claim 1 wherein the method comprises cleaning the internal surface of at least two channels, and the channels are separate channels of an endoscope wherein the flow rates of the liquid cleaning medium and gas are independently selected to optimize the amount of contaminants detached from the surface of each of the channels due to the movement of rivulets and rivulet fragments along the internal surface of each channel.

10. A method according to claim 9 wherein flowing liquid cleaning medium and gas are introduced into multiple channels of the endoscope from a single source.

11. A method according to claim 1 further comprising the steps of i) treating the internal surface of the narrow diameter channel with germicide, ii) rinsing the germicide with bacteria-free water, and iii) drying the internal surface of the narrow diameter channels by flowing first alcohol and then air through the channel.

12. A method according to claim 11 wherein either one or all of the germicide treatment, rinsing and drying steps takes place under RDF, DPF, DPDF, or their combination.

13. The method according to claim 1 wherein the liquid cleaning medium comprises a surfactant or a combination of surfactants that provides an equilibrium surface tension between about 33 and 50 dynes/cm; has a low potential to generate foam as measured by having a Ross Miles foam height measured at a surfactant concentration of 0.1% that is less than 50 mm; and provides a liquid cleaning medium that does not form a wetting film on the channel surface (the interior wall of the channel) as measured by a receding contact angle greater than zero degrees.

14. A method according to claim 13 wherein the surfactant is selected from the group consisting of polyethylene oxide-polypropylene oxide copolymers, glycidyl ether-capped acetylenic surfactants, alcohol ethoxylates, alkoxylated ether amine oxides, and alkyldiphenyloxide disulfonates and mixtures thereof.

15. A method according to claim 13 wherein the liquid cleaning medium further comprises one or more ingredients selected from the group consisting of pH adjusting agents, builders or sequestering agents, cloud point antifoams, dispersants, solvents, hydrotropes, oxidizing agents, and preservatives.

16. A method according to claim 1 wherein the liquid cleaning medium is derived by dilution of a concentrate, wherein said concentrate comprises one or more surfactants and optionally pH adjusting agents, builders, sequestering agent, cloud point antifoam, dispersant, solvent, hydrotrope, oxidizing agent, and preservative.

* * * * *

UNITED STATES PATENT AND TRADEMARK OFFICE

CERTIFICATE OF CORRECTION

PATENT NO. : 8,114,221 B2
APPLICATION NO. : 12/286749
DATED : February 14, 2012
INVENTOR(S) : Labib et al.

It is certified that error appears in the above-identified patent and that said Letters Patent is hereby corrected as shown below:

Title page item (57) Abstract: The Abstract should read

--A method for cleaning an internal surface of a narrow diameter channel includes steps of: flowing a liquid cleaning medium and a gas through the narrow diameter channel under a flow regime that creates surface flow entities in contact with and sliding along the internal surface of the narrow diameter channel, said surface flow entities having three-phase contact lines and associated menisci, said surface flow entities detaching contaminants with which they come in contact from the internal surface of the narrow diameter internal surface of the narrow diameter channel; and rinsing the internal surface of the narrow diameter channel to remove residual liquid cleaning medium and detached contaminants from the channel.--

In the Specification

Col. 5, line 36: “type hydrodynanic flow” should read --type hydrodynamic flow--

Col. 19, line 51: “section (volume lement)” should read --section (volume element)--

Col. 36, line 43: “to 29 m/min with” should read --to 29 ml/min with--

Signed and Sealed this
Seventh Day of October, 2014

Michelle K. Lee

Michelle K. Lee
*Deputy Director of the United States Patent and Trademark Office*